US007621729B2

(12) United States Patent
Matsumoto et al.

(10) Patent No.: US 7,621,729 B2
(45) Date of Patent: Nov. 24, 2009

(54) MULTISTAGE COMPRESSION TYPE ROTARY COMPRESSOR

(75) Inventors: Kenzo Matsumoto, Gunma-ken (JP); Hiroyuki Matsumori, Gunma-ken (JP); Takashi Sato, Kumagaya (JP); Takayasu Saito, Kumagaya (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 0 days.

(21) Appl. No.: 12/068,603

(22) Filed: Feb. 8, 2008

(65) Prior Publication Data

US 2008/0199338 A1 Aug. 21, 2008

Related U.S. Application Data

(62) Division of application No. 11/638,496, filed on Dec. 14, 2006, now Pat. No. 7,491,042.

(30) Foreign Application Priority Data

Dec. 16, 2005 (JP) ..... 2005-363632
Dec. 16, 2005 (JP) ..... 2005-363646
Dec. 16, 2005 (JP) ..... 2005-363658
Dec. 16, 2005 (JP) ..... 2005-363820

(51) Int. Cl.
*F04C 2/00* (2006.01)
*F03C 4/00* (2006.01)

(52) U.S. Cl. ..... 418/11; 418/60; 418/249; 418/270

(58) Field of Classification Search ..... 418/60, 418/11, 249, 270, DIG. 1
See application file for complete search history.

(56) References Cited

U.S. PATENT DOCUMENTS

| | | | | |
|---|---|---|---|---|
| 4,990,073 | A | 2/1991 | Kudo et al. | |
| 5,242,280 | A * | 9/1993 | Fujio | 418/11 |
| 5,322,424 | A | 6/1994 | Fujio | |
| 6,189,335 | B1 | 2/2001 | Ebara et al. | |
| 6,748,754 | B2 | 6/2004 | Matsumoto et al. | |
| 6,824,367 | B2 | 11/2004 | Matsumoto et al. | |
| 6,974,314 | B2 | 12/2005 | Matsumoto et al. | |

FOREIGN PATENT DOCUMENTS

| | | |
|---|---|---|
| JP | 62-29788 | 2/1987 |
| JP | 1-247785 | 10/1989 |
| JP | 2000045977 A * | 2/2000 |
| JP | 2000-105006 | 4/2000 |
| JP | 2003-172280 | 6/2003 |
| JP | 2004-027970 | 1/2004 |

* cited by examiner

*Primary Examiner*—Theresa Trieu
(74) *Attorney, Agent, or Firm*—Kratz, Quintos & Hanson, LLP

(57) ABSTRACT

An object is to provide a high inner pressure type multistage compression rotary compressor capable of avoiding beforehand generation of vane fly of a second rotary compression element and realizing a stabilized operation, the rotary compressor includes a communication path which connects an intermediate pressure region to a region having a low pressure as a suction pressure of a first rotary compression element; and a valve device which opens or closes this communication path, the rotary compressor applies a high pressure as a back pressure of an upper vane, and this valve device opens the communication path in a case where a pressure difference between the intermediate pressure and the low pressure increases a predetermined upper limit value before the intermediate pressure reaches the high pressure.

2 Claims, 24 Drawing Sheets

MULTISTAGE COMPRESSION TYPE ROTARY COMPRESSOR

RELATED APPLICATIONS

This application is a division of U.S. patent application Ser. No. 11/638,496, filed on Dec. 14, 2006 now U.S. Pat. No. 7,491,042, which application claims priority under 35 U.S.C. § 119 of Japanese Application Nos. 2005-363632, 2005-363646, 2005-363658 and 2005-363820, all filed on Dec. 16, 2005, and is related to co-pending U.S. patent application Ser. Nos. 12/086,604 and 12/086,605 all filed on Feb. 8, 2008 filed concurrently herewith, all of which are incorporated herein by reference.

BACKGROUND OF THE INVENTION

The present invention relates to a multistage compression type rotary compressor in which an intermediate pressure refrigerant gas compressed by a first rotary compression element and discharged therefrom is sucked in a second rotary compression element, compressed and then discharged therefrom.

In this type of multistage compression type rotary compressor such as a high inner pressure type multistage compression rotary compressor, there has heretofore been a constitution in which a refrigerant gas is sucked in a low pressure chamber side of a cylinder from a suction port of a first rotary compression element, compressed by operations of a roller and a vane to obtain an intermediate pressure, and discharged from a high pressure chamber side of the cylinder to a discharge muffling chamber through a discharge port. Moreover, the intermediate pressure refrigerant gas discharged to the discharge muffling chamber is sucked in the low pressure chamber side of the cylinder from a suction port of the second rotary compression element, secondarily compressed by operations of a roller and a vane to constitute a high-temperature high-pressure refrigerant gas, and discharged into a sealed vessel from the high pressure chamber side through the discharge port and the discharge muffling chamber. Subsequently, the gas is discharged from the rotary compressor (see, e.g., Japanese Patent Application Laid-Open No. 2004-27970).

Each vane is movably inserted into a guide grove disposed in a radial direction of the cylinder, and a back pressure chamber (a storage portion) is constituted behind each vane. The intermediate pressure which is a pressure of the first rotary compression element on a refrigerant discharge side is applied to the back pressure chamber of the first rotary compression element, and the high pressure of the sealed vessel is applied to the back pressure chamber of the second rotary compression element. Moreover, the vane of the first rotary compression element is urged toward a roller side by a spring disposed in the back pressure chamber behind the vane and the intermediate pressure applied to the back pressure chamber. The vane of the second rotary compression element is urged toward a roller side by a spring disposed in the back pressure chamber behind the vane and the high pressure applied to the back pressure chamber.

Moreover, an intermediate inner pressure type multistage compression rotary compressor has a constitution in which a refrigerant gas is sucked in a low pressure chamber side of a cylinder from a suction port of a first rotary compression element, compressed by operations of a roller and a vane to obtain an intermediate pressure, and discharged into a sealed vessel from a high pressure chamber side of the cylinder through a discharge port and a discharge muffling chamber.

Moreover, the intermediate pressure refrigerant in this sealed vessel is sucked in the low pressure chamber side of the cylinder from a suction port of a second rotary compression element, secondarily compressed by operations of a roller and a vane to constitute a high-temperature high-pressure refrigerant gas, and discharged from the high pressure chamber side through the discharge port and the discharge muffling chamber.

Each vane is movably inserted into a guide grove disposed in a radial direction of the cylinder, and a back pressure chamber (a storage portion) is constituted behind each vane. The intermediate pressure of the sealed vessel is applied to the back pressure chamber of the first rotary compression element, and the high pressure which is the pressure of a refrigerant discharge side of the second rotary compression element is applied to the back pressure chamber of the second rotary compression element. Moreover, the vane of the first rotary compression element is urged toward a roller side by a spring disposed in the back pressure chamber behind the vane and the intermediate pressure applied to the back pressure chamber. The vane of the second rotary compression element is urged toward a roller side by a spring disposed in the back pressure chamber behind the vane and the high pressure applied to the back pressure chamber (see, e.g., Japanese Patent Application Laid-Open No. 2003-172280).

In addition, in such a multistage compression type rotary compressor, a problem has been generated that a so-called pressure reverse phenomenon occurs in which a discharge pressure (the intermediate pressure) of the first rotary compression element and a discharge pressure (the high pressure) of the second rotary compression element are reversed. There is a possibility that the reverse phenomenon of the pressure occurs in a situation in which a refrigerant can sufficiently be compressed by an only compression work in the first rotary compression element at a time when the rotary compressor has a light load. In this case, since the compression work is not substantially performed in the second rotary compression element, the pressure decreases owing to a circulation resistance or the like in a process in which the refrigerant discharged from the first rotary compression element flows through the second rotary compression element on a discharge side. Therefore, the discharge side pressure of the second rotary compression element becomes lower than that of the first rotary compression element.

Moreover, in a case where an evaporation temperature of the refrigerant rises at a high outside air temperature, a suction pressure of the first rotary compression element rises. In consequence, the discharge pressure of the first rotary compression element also rises. On the other hand, the discharge pressure (the high pressure) of the second rotary compression element is regulated so that the pressure does not rise above a pressure set beforehand in accordance with the number of rotations or the like. Therefore, in a case where the intermediate pressure as the discharge pressure of the first rotary compression element rises in this manner, pressure reversal sometimes occurs in which the intermediate pressure and the high pressure are reversed.

When the discharge pressure of the first rotary compression element and the discharge pressure of the second rotary compression element are reversed in this manner, the pressure in the cylinder of the second rotary compression element (the pressure (the intermediate pressure) of the refrigerant sucked in the second rotary compression element) rises above the discharge pressure (the high pressure) of the second rotary compression element applied as a back pressure of the vane. Therefore, a problem has occurred that an urging force to urge the vane toward the roller is eliminated, vane fly of the second rotary compression element occurs, a noise is made and an operation of the second rotary compression element also becomes unstable.

Furthermore, even in a case where the above-described pressure reverse phenomenon does not occur, when the discharge pressure of the first rotary compression element becomes substantially equal to that of the second rotary compression element, the urging force to urge the vane toward the roller decreases. Therefore, the vane fly sometimes occurs in accordance with an operation situation (during transition or the like).

In addition, there has also been a disadvantage that once the vane fly occurs, much time is required until the vane follows the roller, that is, the vane fly is eliminated.

SUMMARY OF THE INVENTION

The present invention has been developed in order to solve such problems of a conventional technology, and an object thereof is to provide a multistage compression type rotary compressor capable of avoiding beforehand generation of vane fly of a second rotary compression element to realize a stabilized operation.

Moreover, another object is to provide a multistage compression type rotary compressor capable of canceling pressure reversal of discharge pressures of first and second rotary compression elements to realize a stabilized operation.

A multistage compression type rotary compressor of a first invention comprises, in a sealed vessel, a driving element; and first and second rotary compression elements driven by this driving element, the second rotary compression element comprising a cylinder; a roller fitted into an eccentric portion formed on a rotary shaft of the driving element to eccentrically rotate in the cylinder; and a vane which abuts on this roller to divide the inside of the cylinder into a low pressure chamber side and a high pressure chamber side, the rotary compressor being configured to suck, in the second rotary compression element, an intermediate pressure refrigerant gas compressed by the first rotary compression element and discharged, compress and discharge the refrigerant gas into the sealed vessel and apply a high pressure as a back pressure of the vane, the rotary compressor further comprising: a communication path which connects a region having an intermediate pressure to a region having a low pressure as a suction pressure of the first rotary compression element; and a valve device which opens or closes this communication path, the valve device being configured to open the communication path in a case where a pressure difference between the intermediate pressure and the low pressure increases to a predetermined upper limit value before the intermediate pressure reaches the high pressure.

In the multistage compression type rotary compressor of a second invention, the first invention is characterized in that the first rotary compression element includes a cylinder; a roller which is fitted into an eccentric portion formed on the rotary shaft of the driving element to eccentrically rotate in the cylinder; and a vane which abuts on this roller to divide the inside of the cylinder into a low pressure chamber side and a high pressure chamber side, and an intermediate pressure which is a discharge pressure of the first rotary compression element is applied as a back pressure of the vane.

A multistage compression type rotary compressor of a third invention comprises, in a sealed vessel, a driving element; and first and second rotary compression elements driven by this driving element, the second rotary compression element comprising a cylinder; a roller fitted into an eccentric portion formed on a rotary shaft of the driving element to eccentrically rotate in the cylinder; and a vane which abuts on this roller to divide the inside of the cylinder into a low pressure chamber side and a high pressure chamber side, the rotary compressor being configured to apply a high pressure which is a discharge pressure of the second rotary compression element as a back pressure of the vane, suck, in the second rotary compression element, an intermediate pressure refrigerant gas compressed by the first rotary compression element and discharged into the sealed vessel, compress and discharge the refrigerant gas, the rotary compressor further comprising: a communication path which connects a region having an intermediate pressure to a region having a low pressure as a suction pressure of the first rotary compression element; and a valve device which opens or closes this communication path, the valve device being configured to open the communication path in a case where a pressure difference between the intermediate pressure and the low pressure increases to a predetermined upper limit value before the intermediate pressure reaches the high pressure.

A multistage compression type rotary compressor of a fourth invention comprises, in a sealed vessel, a driving element; and first and second rotary compression elements driven by this driving element, the second rotary compression element comprising a cylinder; a roller fitted into an eccentric portion formed on a rotary shaft of the driving element to eccentrically rotate in the cylinder; and a vane which abuts on this roller to divide the inside of the cylinder into a low pressure chamber and a high pressure chamber, the rotary compressor being configured to apply a pressure of the second rotary compression element on a refrigerant discharge side as a back pressure of the vane, suck, in the second rotary compression element, an intermediate pressure refrigerant gas compressed by the first rotary compression element and discharged into the sealed vessel, compress and discharge the refrigerant gas, the rotary compressor further comprising: a communication path which connects a space in the sealed vessel to the first rotary compression element on a refrigerant suction side; and a valve device having one surface to which a pressure of the space in the sealed vessel is applied and having the other surface to which the back pressure of the vane is applied to open or close the communication path, the valve device being configured to open the communication path in a case where the pressure applied from the space in the sealed vessel to the one surface reaches a predetermined upper limit value.

A multistage compression type rotary compressor of a fifth invention comprises, in a sealed vessel, a driving element; and first and second rotary compression elements driven by this driving element, the second rotary compression element comprising a cylinder; a roller fitted into an eccentric portion formed on a rotary shaft of the driving element to eccentrically rotate in the cylinder; and a vane which abuts on this roller to separate a low pressure chamber side and a high pressure chamber side from each other, the rotary compressor being configured to apply a pressure of the second rotary compression element on a refrigerant discharge side as a back pressure of the vane, suck, in the second rotary compression element, an intermediate pressure refrigerant gas compressed by the first rotary compression element and discharged, compress and discharge the refrigerant gas, the rotary compressor further comprising: a communication path which connects a region having an intermediate pressure to a region having a low pressure as a suction pressure of the first rotary compression element or a region before reaching the intermediate pressure; and a valve device which opens or closes this communication path, the valve device being configured to open the communication path in a case where the intermediate pressure reaches a predetermined upper limit value or a pressure difference between the pressure of the second rotary compression element on the refrigerant discharge side and the intermediate pressure reaches a predetermined value.

A multistage compression type rotary compressor of a sixth invention comprises, in a sealed vessel, a driving element; and first and second rotary compression elements driven by this driving element, the second rotary compression element comprising a cylinder; a roller fitted into an eccentric portion formed on a rotary shaft of the driving element to eccentrically rotate in the cylinder; and a vane which abuts on this roller to divide the inside of the cylinder into a low pressure chamber side and a high pressure chamber side, the rotary compressor being configured to apply a pressure of the second rotary compression element on a refrigerant discharge side as a back pressure of the vane, suck, in the second rotary compression element, a refrigerant gas compressed by the first rotary compression element and discharged, compress and discharge the refrigerant gas, the rotary compressor further comprising: a communication path which connects a discharge muffling chamber of the first rotary compression element to a suction step region of the first rotary compression element or a region before reaching a discharge pressure of the first rotary compression element; and a valve device having one surface to which a pressure in the discharge muffling chamber of the first rotary compression element is applied and having the other surface to which a pressure in a discharge muffling chamber of the second rotary compression element is applied to open or close the communication path, the valve device being configured to open the communication path in a case where the pressure applied from the discharge muffling chamber of the first rotary compression element to the one surface reaches a predetermined upper limit value.

According to the first invention, the multistage compression type rotary compressor comprises, in the sealed vessel, the driving element; and the first and second rotary compression elements driven by this driving element. The second rotary compression element comprises: the cylinder; the roller fitted into the eccentric portion formed on the rotary shaft of the driving element to eccentrically rotate in the cylinder; and the vane which abuts on this roller to divide the inside of the cylinder into the low pressure chamber side and the high pressure chamber side. The rotary compressor sucks, in the second rotary compression element, the intermediate pressure refrigerant gas compressed by the first rotary compression element and discharged, compresses and discharges the refrigerant gas into the sealed vessel and applies the high pressure as the back pressure of the vane. The rotary compressor further comprises: the communication path which connects the region having the intermediate pressure to the region having the low pressure as the suction pressure of the first rotary compression element; and the valve device which opens or closes this communication path. The valve device opens the communication path in a case where the pressure difference between the intermediate pressure and the low pressure increases to the predetermined upper limit value before the intermediate pressure reaches the high pressure. Therefore, the intermediate pressure refrigerant gas compressed by the first rotary compression element can be released to the region having the low pressure which is the suction pressure of the first rotary compression element.

In consequence, the intermediate pressure can constantly be set to be lower than the high pressure which is the discharge pressure of the second rotary compression element. Therefore, it is possible to avoid beforehand a disadvantage that vane fly and unstable operation situation of the second rotary compression element occur. Therefore, it is possible to realize a stabilized operation of the multistage compression type rotary compressor.

Moreover, since the intermediate pressure refrigerant gas compressed by the first rotary compression element is released to the low pressure region of the first rotary compression element, an amount of a refrigerant to be sucked in the first rotary compression element decreases. Therefore, it is possible to obtain a power saving effect at a time when the compressor has a light load.

Furthermore, in the first invention, as in the second invention, the first rotary compression element includes the cylinder; the roller which is fitted into the eccentric portion formed on the rotary shaft of the driving element to eccentrically rotate in the cylinder; and the vane which abuts on this roller to divide the inside of the cylinder into the low pressure chamber side and the high pressure chamber side. The intermediate pressure which is the discharge pressure of the first rotary compression element is applied as the back pressure of the vane. In consequence, it is possible to eliminate a disadvantage that the vane of the first rotary compression element has an excessive back pressure.

According to the third invention, the multistage compression type rotary compressor comprises, in the sealed vessel, the driving element; and the first and second rotary compression elements driven by this driving element. The second rotary compression element comprises: the cylinder; the roller fitted into the eccentric portion formed on the rotary shaft of the driving element to eccentrically rotate in the cylinder; and the vane which abuts on this roller to divide the inside of the cylinder into the low pressure chamber side and the high pressure chamber side. The rotary compressor applies the high pressure which is the discharge pressure of the second rotary compression element as the back pressure of the vane, sucks, in the second rotary compression element, the intermediate pressure refrigerant gas compressed by the first rotary compression element and discharged into the sealed vessel, compresses and discharges the refrigerant gas. The rotary compressor further comprises: the communication path which connects the region having the intermediate pressure to the region having the low pressure as the suction pressure of the first rotary compression element; and the valve device which opens or closes this communication path. The valve device opens the communication path in a case where the pressure difference between the intermediate pressure and the low pressure increases to the predetermined upper limit value before the intermediate pressure reaches the high pressure. Therefore, the intermediate pressure refrigerant gas compressed by the first rotary compression element can be released to the region having the low pressure which is the suction pressure of the first rotary compression element.

In consequence, the intermediate pressure can constantly be set to be lower than the high pressure which is the discharge pressure of the second rotary compression element. Therefore, it is possible to avoid beforehand the disadvantage that the vane fly and the unstable operation situation of the second rotary compression element occur. Therefore, it is possible to realize the stabilized operation of the multistage compression type rotary compressor.

Moreover, since the intermediate pressure refrigerant gas compressed by the first rotary compression element is released to the low pressure region of the first rotary compression element, the amount of the refrigerant to be sucked in the first rotary compression element decreases. Therefore, it is possible to obtain the power saving effect at a time when the compressor has the light load.

According to the fourth invention, the multistage compression type rotary compressor comprises, in the sealed vessel, the driving element; and the first and second rotary compression elements driven by this driving element. The second rotary compression element comprises: the cylinder; the roller fitted into the eccentric portion formed on the rotary shaft of the driving element to eccentrically rotate in the cylinder; and the vane which abuts on this roller to divide the inside of the cylinder into the low pressure chamber and the high pressure chamber. The rotary compressor applies the pressure of the second rotary compression element on the refrigerant discharge side as the back pressure of the vane, sucks, in the second rotary compression element, the intermediate pressure refrigerant gas compressed by the first rotary compression element and discharged into the sealed vessel, compresses and discharges the refrigerant gas. The rotary compressor further comprises: the communication path which connects the space in the sealed vessel to the first rotary compression element on the refrigerant suction side; and the valve device having one surface to which the pressure of the space in the sealed vessel is applied and having the other surface to which the back pressure of the vane is applied to open or close the communication path. This valve device opens the communication path in a case where the pressure applied from the space in the sealed vessel to the one surface reaches the predetermined upper limit value. Therefore, for example, in a case where the pressure of the second rotary compression element on the refrigerant discharge side which is the vane back pressure is set to the upper limit value and the pressure applied from the space in the sealed vessel to the one surface of the valve device, that is, the pressure of the first rotary compression element on the refrigerant discharge side rises to or above the upper limit value or in a case where the pressure before reaching the vane communication path is set to the upper limit value and the pressure rises to this upper limit value, the communication path is opened. The refrigerant gas in the sealed vessel can then be released to the first rotary compression element on the refrigerant discharge side.

In consequence, since the pressure of the refrigerant gas in the sealed vessel, that is, the pressure of the first rotary compression element on the refrigerant discharge side can constantly be set to be equal to or lower than that of the second rotary compression element on the refrigerant discharge side, it is possible to eliminate pressure reversal of the refrigerant gas compressed by the first rotary compression element and the pressure of the refrigerant gas compressed by the second rotary compression element. Therefore, it is possible to eliminate at an early stage or avoid beforehand the vane fly and the unstable operation situation of the second rotary compression element.

Therefore, a disadvantage that the second rotary compression element comes into the unstable operation situation can be eliminated to realize the stabilized operation of the multistage compression type rotary compressor. Moreover, reduction of noises can be realized. Especially, since the valve device is operated by the vane back pressure as a factor for the vane fly and the pressure in the sealed vessel, it is possible to open or close the communication path more precisely. Furthermore, it is possible to simplify a structure.

According to the fifth invention, the multistage compression type rotary compressor comprises, in the sealed vessel, the driving element; and the first and second rotary compression elements driven by this driving element. The second rotary compression element comprises: the cylinder; the roller fitted into the eccentric portion formed on the rotary shaft of the driving element to eccentrically rotate in the cylinder; and the vane which abuts on this roller to separate the low pressure chamber side and the high pressure chamber side from each other. The rotary compressor applies the pressure of the second rotary compression element on the refrigerant discharge side as the back pressure of the vane, sucks, in the second rotary compression element, the intermediate pressure refrigerant gas compressed by the first rotary compression element and discharged, compresses and discharges the refrigerant gas. The rotary compressor further comprises: the communication path which connects the region having the intermediate pressure to the region having the low pressure as the suction pressure of the first rotary compression element or the region before reaching the intermediate pressure; and the valve device which opens or closes this communication path. This valve device opens the communication path in a case where the intermediate pressure reaches the predetermined upper limit value. For example, in a case where the intermediate pressure is equal to or larger than the high pressure which is the discharge pressure of the second rotary compression element, the intermediate pressure reaches the predetermined upper limit value before reaching the high pressure, or the pressure difference between the pressure of the second rotary compression element on the refrigerant discharge side and the intermediate pressure indicates a predetermined value, the valve device opens the communication path. The discharged intermediate pressure refrigerant gas compressed by the first rotary compression element can then be released to the region of the first rotary compression element having the low pressure.

In consequence, the intermediate pressure can constantly be set to be equal to or lower than the high pressure which is the discharge pressure of the second rotary compression element. Therefore, it is possible to eliminate the pressure reversal of the intermediate pressure and the high pressure. It is therefore possible to eliminate at the early stage or avoid beforehand the vane fly and the unstable operation situation of the second rotary compression element.

Moreover, since the discharged intermediate pressure refrigerant gas compressed by the first rotary compression element is released to the low pressure region of the first rotary compression element, the amount of the refrigerant to be sucked in the first rotary compression element decreases. Therefore, it is possible to obtain the power saving effect at the time when the compressor has the light load.

In consequence, the disadvantage that the second rotary compression element comes into the unstable operation situation can be eliminated to realize the stabilized operation of the multistage compression type rotary compressor.

According to the sixth invention, the multistage compression type rotary compressor comprises, in the sealed vessel, the driving element; and the first and second rotary compression elements driven by this driving element.

The second rotary compression element comprises: the cylinder; the roller fitted into the eccentric portion formed on the rotary shaft of the driving element to eccentrically rotate in the cylinder; and the vane which abuts on this roller to divide the inside of the cylinder into the low pressure chamber side and the high pressure chamber side. The rotary compressor applies the pressure of the second rotary compression element on the refrigerant discharge side as the back pressure of the vane, sucks, in the second rotary compression element, the refrigerant gas compressed by the first rotary compression element and discharged, compresses and discharges the refrigerant gas.

The rotary compressor further comprises: the communication path which connects the discharge muffling chamber of the first rotary compression element to the suction step region of the first rotary compression element or the region before reaching the discharge pressure of the first rotary compression element; and the valve device having one surface to which the pressure in the discharge muffling chamber of the first rotary compression element is applied and having the other surface to which the pressure in the discharge muffling chamber of the second rotary compression element is applied to open or close the communication path.

The valve device opens the communication path in a case where the pressure applied from the discharge muffling chamber of the first rotary compression element to the one surface reaches the predetermined upper limit value. Therefore, for example, in a case where the discharge pressure of the first rotary compression element applied to the one surface is not less than the pressure applied from the discharge muffling chamber of the second rotary compression element to the other surface or the pressure reaches the predetermined upper limit value before reaching the pressure of the discharge muffling chamber of the second rotary compression element, the valve device opens the communication path. The refrigerant gas compressed by the first rotary compression element and discharged to the discharge muffling chamber can then be released to the suction step region of the first rotary compression element.

In consequence, since the pressure of the refrigerant gas discharged to the discharge muffling chamber of the first rotary compression element can constantly be set to be equal to or lower than that of the refrigerant gas discharged to the discharge muffling chamber of the second rotary compression element, it is possible to eliminate pressure reversal of the refrigerant gas compressed by the first rotary compression element and the refrigerant gas compressed by the second rotary compression element. Therefore, it is possible to eliminate at the early stage or avoid beforehand the vane fly and the unstable operation situation of the second rotary compression element.

Moreover, since the refrigerant gas compressed by the first rotary compression element and discharged to the discharge muffling chamber is released to the suction step region of the first rotary compression element, the amount of the refrigerant to be sucked in the first rotary compression element decreases. Therefore, it is possible to obtain the power saving effect at the time when the compressor has the light load.

In consequence, the disadvantage that the second rotary compression element comes into the unstable operation situation can be eliminated to realize the stabilized operation of the multistage compression type rotary compressor.

DETAILED DESCRIPTION OF THE PREFERRED EMBODIMENTS

Embodiments of the present invention will be described hereinafter in detail with reference to the drawings.

Embodiment 1

Figure 1:
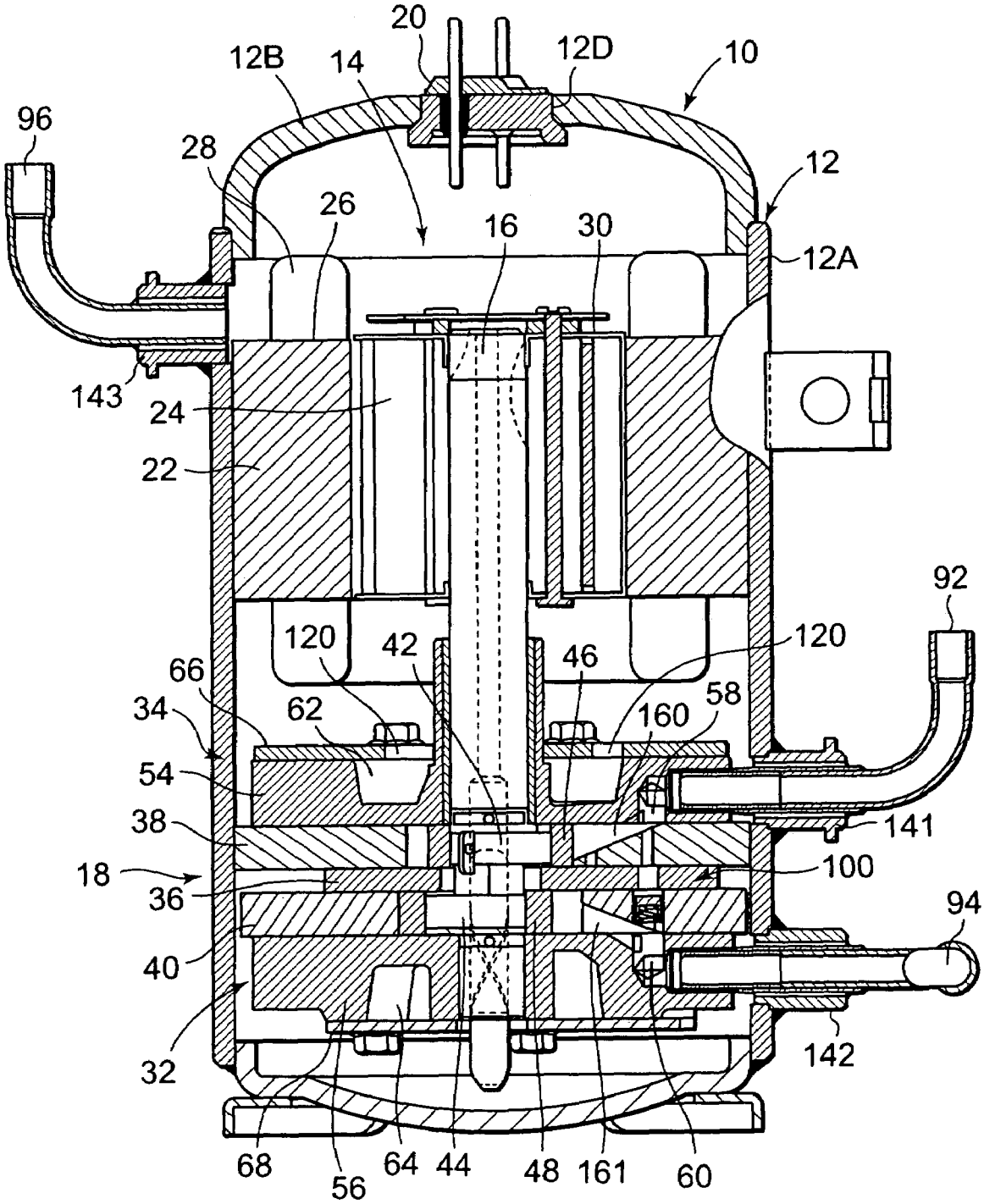
FIG. 1 is a vertical side view of a high inner pressure type multistage compression rotary compressor of one embodiment to which the present invention is applied (Embodiment 1)
Figure 2:
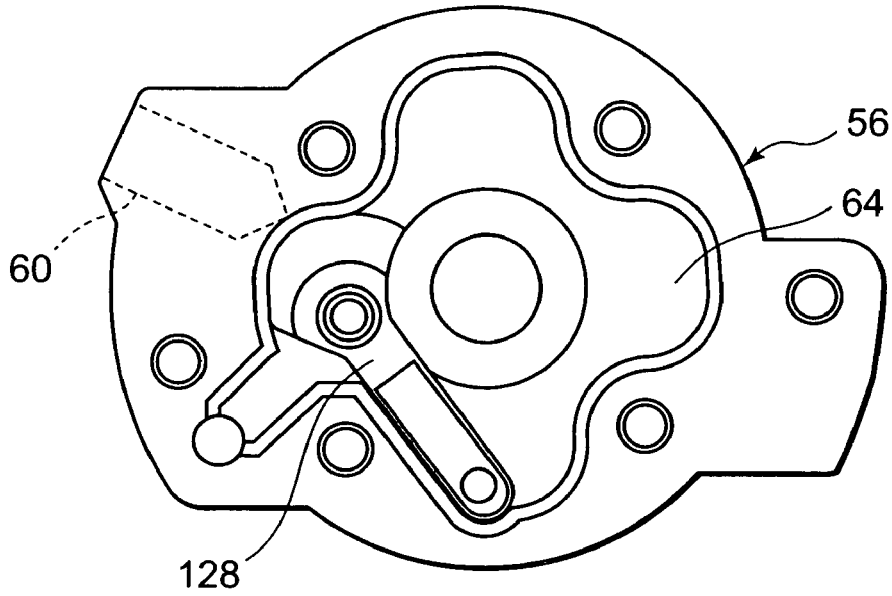
FIG. 2 is a bottom plan view of a lower support member in the multistage compression type rotary compressor of FIG. 1.
Figure 3:
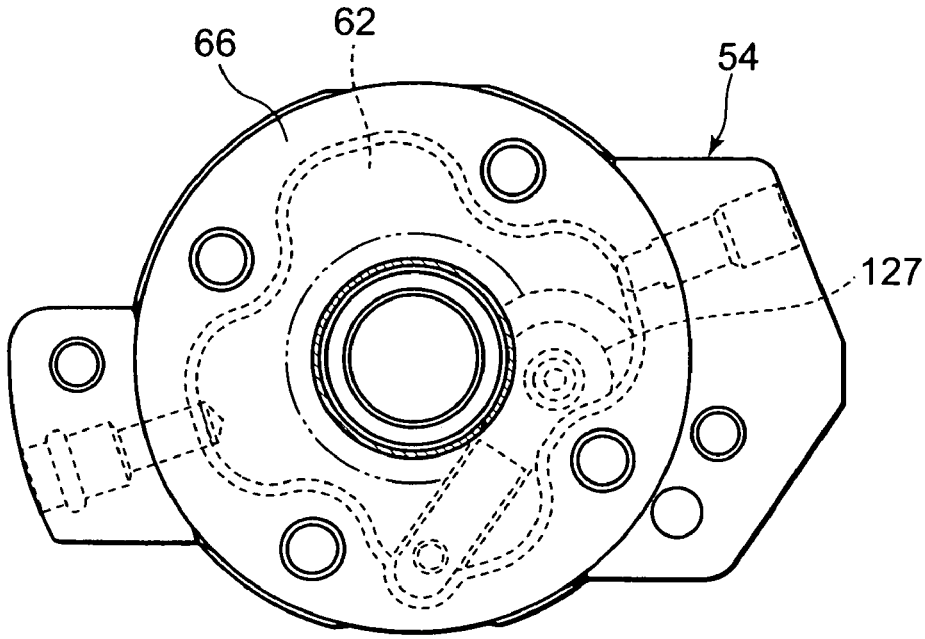
FIG. 3 is a plan view of an upper support member in the multistage compression type rotary compressor of FIG. 1 in a state in which an upper cover is attached.
Figure 4:
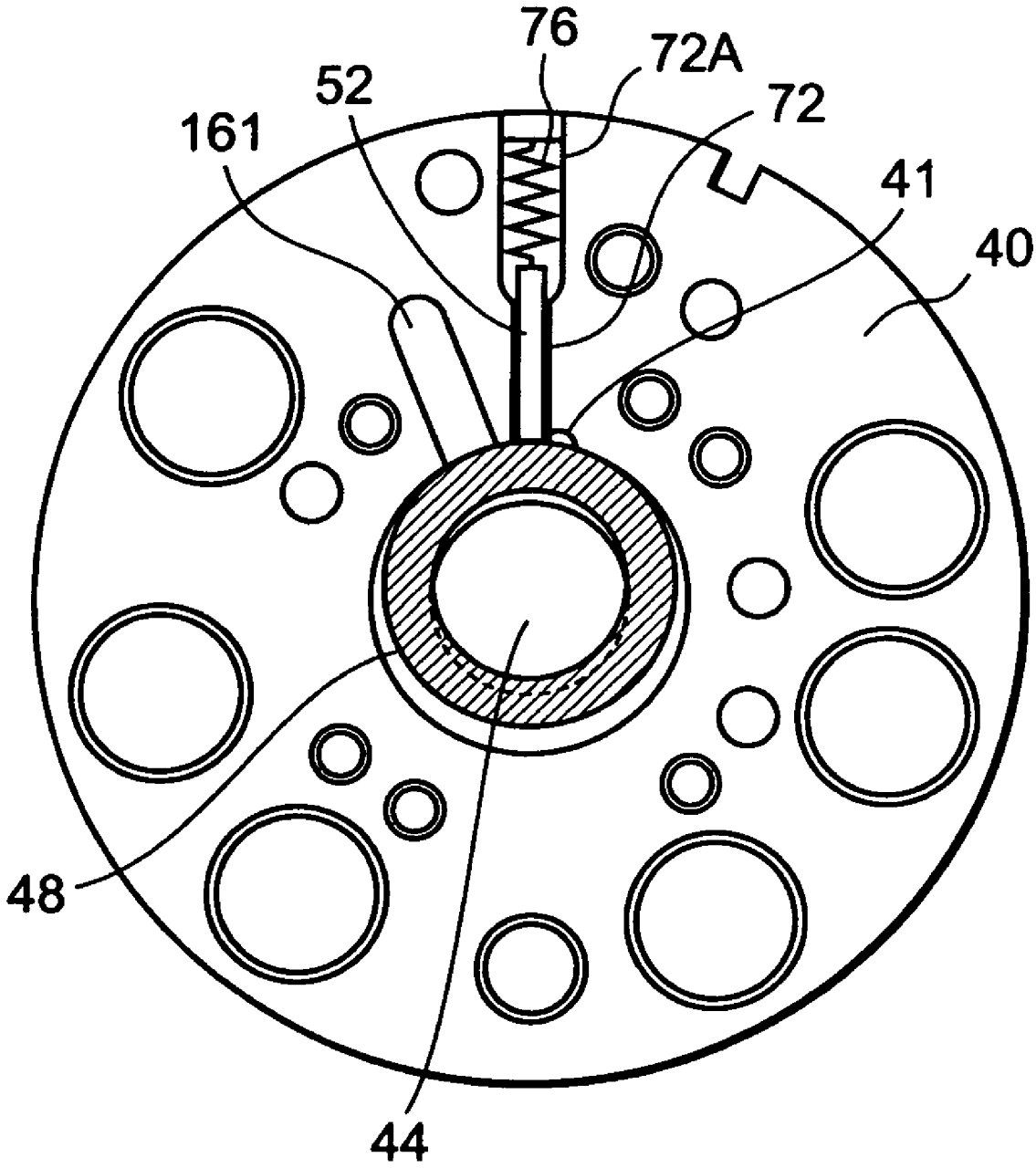
FIG. 4 is a bottom plan view of a cylinder of a first rotary compression element in the multistage compression type rotary compressor of FIG. 1.
Figure 5:
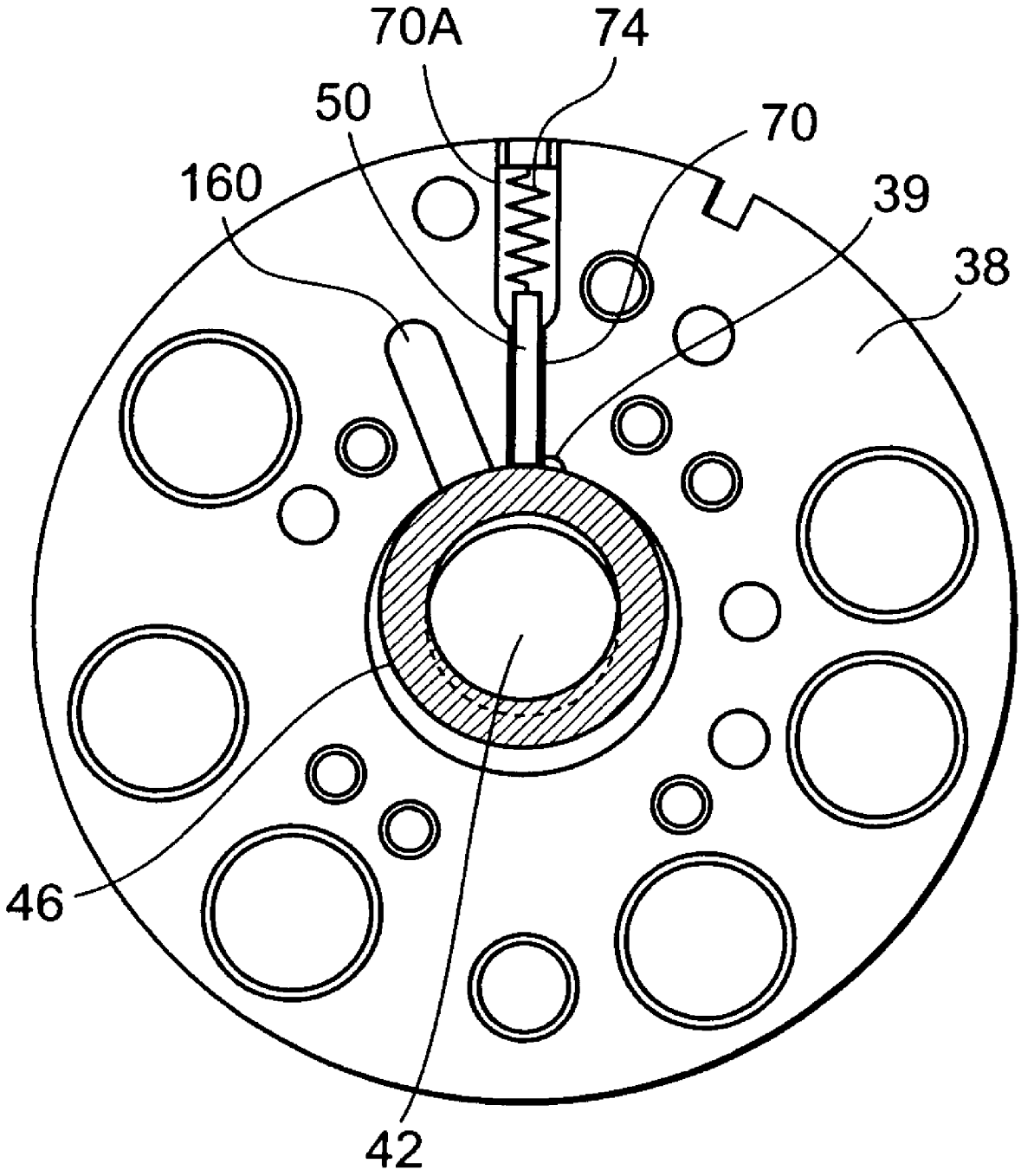
FIG. 5 is a plan view of a cylinder of a second rotary compression element in the multistage compression type rotary compressor of FIG. 1.

FIG. 1 is a vertical side view of a high inner pressure type multistage (two stages) compression rotary compressor 10 including first and second rotary compression elements 32, 34 as an embodiment of a multistage compression type rotary compressor of the present invention; FIG. 2 is a bottom plan view of a lower support member 56 of the first rotary compression element 32; FIG. 3 is a plan view of an upper support member 54 of the second rotary compression element 34 (in a state in which an upper cover is attached); FIG. 4 is a bottom plan view of a lower cylinder 40 of the first rotary compression element 32; and FIG. 5 is a plan view of an upper cylinder 38 as a cylinder constituting the second rotary compression element 34. In FIG. 1, the rotary compressor 10 of the embodiment is the high inner pressure type multistage compression rotary compressor which sucks, in the second rotary compression element, an intermediate pressure refrigerant gas compressed by the first rotary compression element 32 and discharged, compresses and discharges the refrigerant gas into the sealed vessel. The rotary compressor 10 includes, in a sealed vessel 12, an electromotive element 14 as a driving element and a rotary compression mechanism section 18 constituted of the first rotary compression element 32 and the second rotary compression element 34 which are driven by this electromotive element 14.

The sealed vessel 12 is constituted of a vessel main body 12A including a bottom portion as an oil reservoir and containing the electromotive element 14 and the rotary compression mechanism section 18; and a substantially bowl-like end cap (a lid member) 12B which blocks an upper opening of this vessel main body 12A. A circular attachment hole 12D is formed in an upper surface of this end cap 12B, and a terminal (a wiring line is omitted) 20 for supplying a power to the electromotive element 14 is attached to this attachment hole 12D.

The electromotive element 14 is constituted of an annular stator 22 welded and fixed along an inner peripheral surface of the sealed vessel 12; and a rotor 24 inserted into the element and disposed at a slight interval from an inner periphery of this stator 22. This rotor 24 is fixed to a rotary shaft 16 extending through the center of the element in a vertical direction.

The stator 22 has a laminated article 26 constituted by laminating donut-like electromagnetic steel plates; and a stator coil 28 wound around teeth portions of this laminated article 26 by a direct winding (concentrated winding) system. Moreover, the rotor 24 is formed of a laminated article 30 constituted of electromagnetic steel plates in the same manner as in the stator 22.

Moreover, the rotary compression mechanism section 18 is constituted of the first rotary compression element 32; the second rotary compression element 34; and an intermediate partition plate 36 sandwiched between the first rotary compression element 32 and the second rotary compression element 34. In the present embodiment, the first rotary compression element 32 is disposed below the intermediate partition plate 36, and the second rotary compression element 34 is disposed above the intermediate partition plate 36. The first rotary compression element 32 includes the lower cylinder 40 disposed on a lower surface of the intermediate partition plate 36; a lower roller 48 which is fitted into an eccentric portion 44 formed on the rotary shaft 16 of the electromotive element 14 to eccentrically rotate in the lower cylinder 40; a lower vane 52 which abuts on the lower roller 48 to divide the inside of the lower cylinder 40 into a low pressure chamber side and a high pressure chamber side; and the lower support member 56 which blocks a lower open surface of the lower cylinder 40 and which also serves as a bearing of the rotary shaft 16.

Here, the low pressure chamber side in the lower cylinder 40 is a space surrounded with the lower vane 52, the lower roller 48 and the lower cylinder 40, and is a region where a suction port 161 is present. The high pressure chamber side is a space surrounded with the lower vane 52, the lower roller 48 and the lower cylinder 40, and is a region where a discharge port 41 is present.

Furthermore, the second rotary compression element 34 includes the upper cylinder 38 which is disposed on an upper surface of the intermediate partition plate 36 and which is a cylinder constituting the second rotary compression element 34; an upper roller 46 which is fitted into an eccentric portion 42 formed on the rotary shaft 16 of the electromotive element 14 to eccentrically rotate in the upper cylinder 38; an upper vane 50 which abuts on the upper roller 46 to divide the inside of the upper cylinder 38 into a low pressure chamber side and a high pressure chamber side; and the upper support member 54 which blocks an upper open surface of the upper cylinder 38 and which also serves as a bearing of the rotary shaft 16. The eccentric portion 44 of the first rotary compression element 32 and the eccentric portion 42 of the second rotary compression element 34 are disposed with a phase difference of 180 degrees in the cylinders 38 and 40, respectively. It is to be noted that the low pressure chamber side in the upper cylinder 38 is a space surrounded with the upper vane 50, the upper roller 46 and the upper cylinder 38, and is a region where a suction port 160 is present. The high pressure chamber side is a space surrounded with the upper vane 50, the upper roller 46 and the upper cylinder 38, and is a region where a discharge port 39 is present.

In the upper and lower cylinders 38, 40, guide grooves 70, 72 to store the vanes 50, 52 are formed, and storage portions 70A, 72A (back pressure chambers) to store springs 74, 76 as spring members are formed on outer sides of the guide grooves 70, 72, that is, on back surface sides of the vanes 50, 52. The springs 74, 76 abut on back surface end portions of the vanes 50, 52, and constantly urge the vanes 50, 52 toward the rollers 46, 48. Moreover, the storage portion 70A opens on a guide groove 70 side and a sealed vessel 12 side (a vessel main body 12A side). Plugs (not shown) are disposed on the springs 74, 76 stored in the storage portions 70A, 72A on the sealed vessel 12 side, and have functions of preventing the springs 74, 76 from being detached. An O-ring (not shown) for sealing between the plug and an inner surface of the storage portion 72A is attached to a peripheral surface of the plug of the spring 76 to achieve a constitution in which a pressure in the sealed vessel 12 does not flow into the storage portion 72A.

Moreover, the storage portion 72A communicates with a discharge muffling chamber 64 described later via a communication path (not shown), and an intermediate pressure (a pressure of a refrigerant gas on a discharge side of the first rotary compression element 32, the gas being compressed by the first rotary compression element 32 and discharged to the discharge muffling chamber 64) which is a discharge pressure of the first rotary compression element 32 is applied to the storage portion 72A. That is, the intermediate pressure which is the discharge pressure of the first rotary compression element 32 is applied as a back pressure to the lower vane 52 of the first rotary compression element 32.

On the other hand, a peripheral surface of the plug of the spring 74 is not sealed. In consequence, a high pressure in the sealed vessel 12 (a pressure of the gas compressed by the second rotary compression element 34 and discharged into the sealed vessel 12) is applied to the storage portion 70A. That is, the high pressure which is the discharge pressure of the second rotary compression element 34 is applied as the back pressure to the upper vane 50 of the second rotary compression element 34.

The upper and lower support members 54, 56 include suction passages 58, 60 which communicate with the upper and lower cylinders 38, 40 via the suction ports 160, 161. The upper support member 54 is provided with the discharge muffling chamber 62 formed by depressing a part of the surface of the member opposite to the surface of the member which abuts on the upper cylinder 38, and blocking this depressed concave portion with a cover as a wall. That is, the discharge muffling chamber 62 is blocked with an upper cover 66 as the wall which defines the discharge muffling chamber 62.

A discharge valve 127 which openably blocks the discharge port 39 is disposed on a lower surface of the discharge muffling chamber 62. This discharge valve 127 includes an elastic member constituted of a metal plate which is vertically long and substantially rectangular, and a backer valve (not shown) as a discharge valve press plate is disposed above this discharge valve 127, and attached to the upper support member 54. Moreover, one side of the discharge valve 127 abuts on the discharge port 39 to seal the port, and the other side thereof is fixed, with a caulking pin or the like, to an attachment hole of the upper support member 54 which is disposed at a predetermined interval from the discharge port 39.

Moreover, the refrigerant gas compressed in the upper cylinder 38 to reach a predetermined pressure pushes up, from below in FIG. 1, the discharge valve 127 which closes the discharge port 39 to open the discharge port 39, and the gas is discharged into the discharge muffling chamber 62. At this time, the discharge valve 127 is fixed to the upper support member 54 on the other side. Therefore, one side of the valve which abuts on the discharge port 39 warps upwards to abut on the backer valve (not shown) which regulates an open amount of the discharge valve 127. In a case where it is a time to end the discharge of the refrigerant gas, the discharge valve 127 is detached from the backer valve, and the discharge port 39 is blocked.

On the other hand, the lower support member 56 is provided with the discharge muffling chamber 64 formed by depressing a part of the surface (the lower surface) of the member opposite to the surface of the member which abuts on the lower cylinder 40, and blocking this depressed concave portion with a cover as a wall. That is, the discharge muffling chamber 64 is blocked with a lower cover 68 as the wall which defines the discharge muffling chamber 64.

Moreover, a discharge valve 128 which openably blocks the discharge port 41 is disposed on an upper surface of the discharge muffling chamber 64. This discharge valve 128 includes an elastic member constituted of a metal plate which is vertically long and substantially rectangular, and a backer valve (not shown) as a discharge valve press plate is disposed below this discharge valve 128, and attached to the lower support member 56. Moreover, one side of the discharge valve 128 abuts on the discharge port 41 to seal the port, and the other side thereof is fixed, with a caulking pin or the like, to an attachment hole of the lower support member 56 which is disposed at a predetermined interval from the discharge port 41.

Furthermore, the refrigerant gas compressed in the lower cylinder 40 to reach a predetermined pressure pushes down, from above in FIG. 1, the discharge valve 128 which closes the discharge port 41 to open the discharge port 41, and the gas is discharged to the discharge muffling chamber 64. At this time, the discharge valve 128 is fixed to the lower support member 56 on the other side. Therefore, one side of the valve which abuts on the discharge port 41 warps upwards to abut on the backer valve (not shown) which regulates an open amount of the discharge valve 128. In a case where it is a time to end the discharge of the refrigerant gas, the discharge valve 128 is detached from the backer valve, and the discharge port 41 is blocked.

The discharge muffling chamber 62 of the second rotary compression element 34 communicates with the sealed vessel 12 via holes 120 which extend through the upper cover 66. The high pressure refrigerant gas compressed by the second rotary compression element 34 and discharged to the discharge muffling chamber 62 is discharged into the sealed vessel 12 from these holes.

In addition, on a side surface of the vessel main body 12A of the sealed vessel 12, sleeves 141, 142 and 143 are welded and fixed to positions corresponding to those of the suction passages 58, 60 of the upper and lower support members 54, 56 and an upper part of the electromotive element 14, respectively. The sleeve 141 is vertically adjacent to the sleeve 142.

Moreover, one end of a refrigerant introducing tube 92 for introducing the refrigerant gas into the upper cylinder 38 is inserted into the sleeve 141, and the one end of the refrigerant introducing tube 92 is connected to the suction passage 58 of the upper support member 54. This refrigerant introducing tube 92 passes above the sealed vessel 12 to reach a sleeve (not shown) which is welded and fixed to a position corresponding to that of the discharge muffling chamber 64 on the side surface of the vessel main body 12A. The other end of the tube is inserted into the sleeve and connected to the discharge muffling chamber 64 of the first rotary compression element 32.

Furthermore, one end of a refrigerant introducing tube 94 for introducing the refrigerant gas into the lower cylinder 40 is inserted into the sleeve 142, and the one end of this refrigerant introducing tube 94 communicates with the suction passage 60 of the lower support member 56. A refrigerant discharge tube 96 is inserted into and connected to the sleeve 143, and one end of this refrigerant discharge tube 96 communicates with the sealed vessel 12.

On the other hand, the rotary compressor 10 is provided with a communication path 100 of the present invention. This communication path 100 is a passage which connects a region having an intermediate pressure to a region having a low pressure which is a suction pressure of the first rotary compression element 32. The communication path 100 of the present embodiment connects the suction port 161 of the first rotary compression element 32 to the suction port 160 of the second rotary compression element 34. Here, the intermediate pressure region is a region ranging from a discharge step region (i.e., the high pressure chamber side of the first rotary compression element 32 at this time) of the first rotary compression element 32 where there exists the discharge port 41 surrounded with the lower roller 48, the lower vane 52 and the lower cylinder 40 positioned at a time when the discharge valve 128 of the first rotary compression element 32 starts to open. The intermediate pressure region ranges from the above region through the discharge muffling chamber 64 of the first rotary compression element 32 to a suction step region (i.e., the low pressure chamber side of the second rotary compression element 34 at this time) of the second rotary compression element 34 where there exists the suction port 160 surrounded with the upper roller 46, the upper vane 50 and the upper cylinder 38 positioned at a time when the discharge valve 127 of the second rotary compression element 34 starts to open.

Moreover, the low pressure region is a region on a refrigerant upstream side of the suction step region (i.e., the low pressure chamber side of the first rotary compression element 32 at this time) of the first rotary compression element 32 where there exists the suction port 161 surrounded with the lower roller 48, the lower vane 52 and the lower cylinder 40 positioned at a time when the discharge valve 128 of the first rotary compression element 32 starts to open. This low pressure region is a region ranging to the refrigerant introducing tube 94 in the rotary compressor 10 alone.

Furthermore, in the present embodiment, the high pressure is the discharge pressure of the second rotary compression element 34. Therefore, the high pressure region is a region on a refrigerant downstream side of a region ranging through the discharge muffling chamber 62 of the second rotary compression element 34 from the suction step region (i.e., the high pressure chamber side of the second rotary compression element 34 at this time) of the second rotary compression element 34 where there exists the discharge port 39 surrounded with the upper roller 46, the upper vane 50 and the upper cylinder 38 positioned at a time when the discharge valve 127 of the second rotary compression element 34 starts to open. This high pressure region is a region ranging to the refrigerant discharge tube 96 in the rotary compressor 10 alone.

Figure 6:
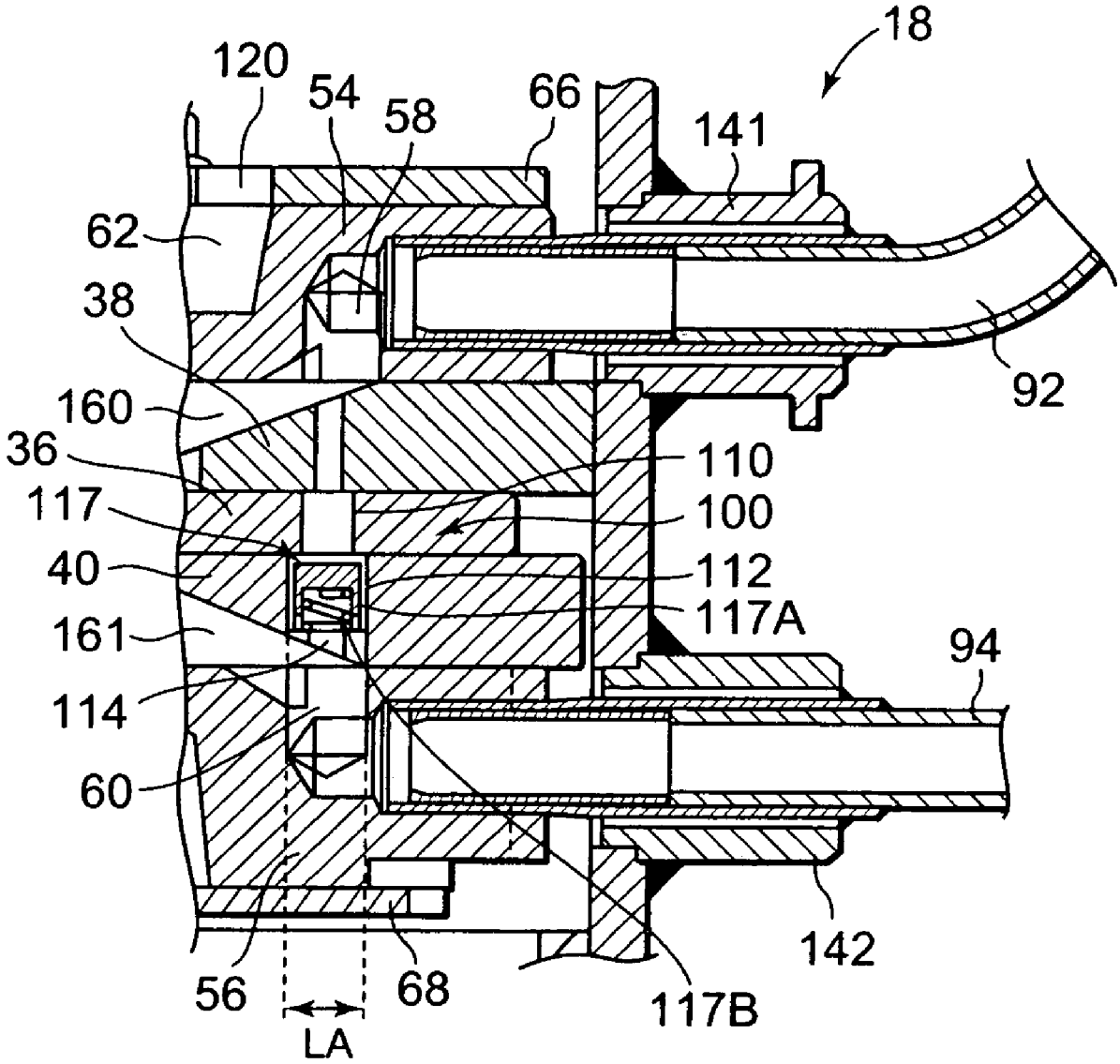
FIG. 6 is a partially enlarged view of the multistage compression type rotary compressor of FIG. 1.

On the other hand, as shown in FIG. 6, the communication path 100 includes a first passage 110 formed in an axial center direction (a vertical direction) of the upper cylinder 38 and the intermediate partition plate 36; a storage chamber 112 connected to this first passage 110 and formed in the lower cylinder 40; and a second passage 114 formed in an axial center direction (a vertical direction) of the lower cylinder 40. The first passage 110 is a passage which connects the suction port 160 on a suction side of the second rotary compression element 34 to the storage chamber 112, one end of the first passage communicates with the suction port 160, and the other end thereof communicates with one surface (an upper surface) of the storage chamber 112. The second passage 114 is a passage which connects the suction port 161 on a suction side of the first rotary compression element 32 to the storage chamber 112, one end of the second passage communicates with the other surface (a lower surface) of the storage chamber 112, and the other end thereof communicates with the suction port 161.

Figure 7:
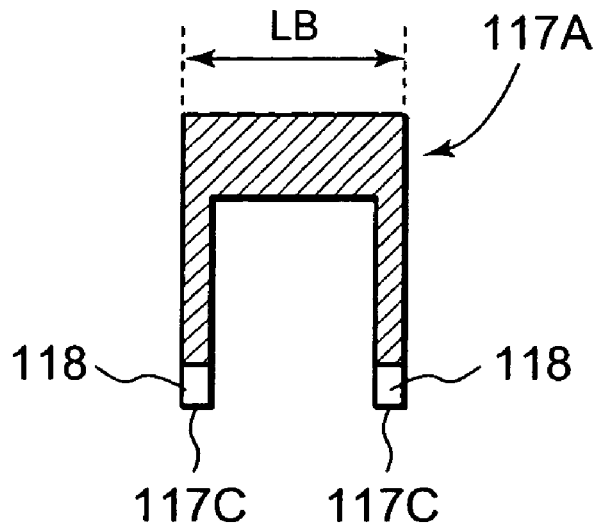
FIG. 7 is a vertical side view of a sealing portion of a valve device in a communication path of the multistage compression type rotary compressor of FIG. 1.
Figure 8:
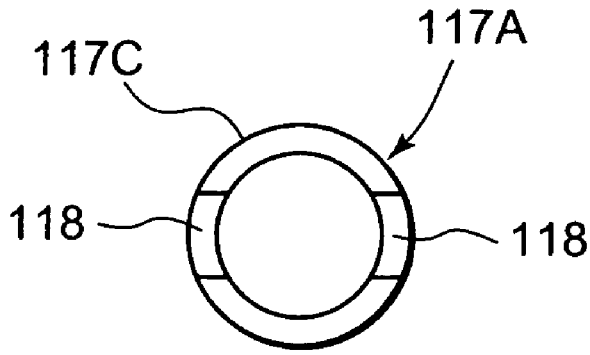
FIG. 8 is a bottom plan view of the sealing portion of the valve device of FIG. 7.

The storage chamber 112 is a cylindrical space in an axial direction (a vertical direction) of the lower cylinder 40, and a valve device 117 which opens or closes the communication path 100 is vertically movably stored in the storage chamber 112. The valve device 117 is constituted of a sealing portion 117A having a U-shaped section; and a spring member 117B having one end attached to the inside of the sealing portion 117A. The sealing portion 117A has a vertically long cylinder shape, and a space capable of storing the spring member 117B is formed in the sealing portion 117A. A side (an upper part) of the sealing portion 117A opposite to a side to which the spring member 117B is attached has a flat surface. When this surface is stored in the storage chamber 112, the surface is positioned on a side of one surface (an upper surface side) of the storage chamber 112, and openably blocks the storage chamber 112 and the first passage 110. As shown in FIGS. 7 and 8, edge portions 117C which are distant ends of a lower opening are provided with grooves 118 in a diametric direction. The grooves 118 connect the second passage 114 to the storage chamber 112 in a state in which the sealing portion 117A is positioned on the other surface (the lower surface) of the storage chamber 112 on the other end, that is, the edge portions 117C abut on the lower surface.

Moreover, a dimension LA of the sealing portion 117A in a horizontal direction (the diametric direction) is set to be smaller than a dimension LB (shown in FIG. 7) of the storage chamber 112 in the horizontal direction (the diametric direction). Therefore, in a state in which the sealing portion 117A is stored in the storage chamber 112, a predetermined clearance is constituted between the sealing portion 117A and the storage chamber 112 in the horizontal direction (the diametric direction).

The spring member 117B is a spring member having a predetermined spring force in a direction from a second passage 114 side to a first passage 110 side (in an upper direction of FIG. 6), and constantly urges the sealing portion 117A toward the first passage 110 (upwards). As to the spring force of the spring member 117B, in a case where a pressure difference between the intermediate pressure applied from above the valve device 117 and the low pressure applied from below is lower than a predetermined pressure difference (lower than a predetermined upper limit value), an upward urging force which is a sum of the low pressure and the spring member is larger than a downward urging force of the intermediate pressure. In a case where a pressure difference between the intermediate pressure applied from above the valve device 117 and the low pressure applied from below is not less than a predetermined pressure difference (the pressure difference increases to a predetermined upper limit value), the downward urging force of the intermediate pressure is set to be larger than the upward urging force which is the sum of the low pressure and the spring member. It is to be noted that the predetermined upper limit value is appropriately selected from a range of 3.5 MPa to 6.0 MPa in accordance with a use application, a type and the like of the rotary compressor 10. For example, in a case where the rotary compressor 10 is used as a hot water supply unit, when the pressure difference between the intermediate pressure and the low pressure rises to 5.0 MPa, the intermediate pressure as the discharge pressure of the first rotary compression element 32 and the high pressure as the discharge pressure of the first rotary compression element 32 are reversed, or both the pressures are substantially equal. There is a possibility that vane fly of the upper vane 50 of the second rotary compression element 34 occurs. Therefore, the upper limit value is set to be lower than 5.0 MPa (the upper limit value is set to, e.g., 4.5 MPa).

Furthermore, the intermediate pressure (which is the suction pressure of the second rotary compression element 34 and the discharge pressure of the first rotary compression element 32) applied into the suction port 160 through the first passage 110 is applied to the upper surface which is one surface of the valve device 117 (the sealing portion 117A side). The low pressure (the suction pressure of the first rotary compression element 32) in the suction port 161 is applied to the lower surface which is the other surface of the valve device 117 (the spring member 117B side) via the second passage 114.

In addition, the valve device 117 is constituted to open the communication path 100 in a case where the pressure difference between the intermediate pressure and the low pressure increases to a predetermined upper limit value before the intermediate pressure reaches the high pressure. Specifically, the valve device 117 of the present embodiment is constituted to open the communication path 100 in a case where the pressure difference between the suction pressure of the second rotary compression element 34 (the discharge pressure of the first rotary compression element 32) applied to one surface (the sealing portion 117A side) and the suction pressure of the first rotary compression element 32 applied to the other surface (the spring member 117B side) is not less than the predetermined upper limit value. It is to be noted that the predetermined upper limit value is set beforehand to a value of the pressure before the intermediate pressure reaches the high pressure.

That is, when the pressure, difference between the intermediate pressure applied from the suction port 160 to one surface (the sealing portion 117A side) and the low pressure applied from the suction port 161 to the other surface (the spring member 117B side) increases to the predetermined upper limit value set beforehand, the spring member 117B is compressed by the intermediate pressure from the suction port 160. Therefore, the valve device 117 moves toward the other end of the storage chamber 112. At this time, since the second passage 114 and the storage chamber 112 are not blocked by the grooves 118, the first passage 110 is connected to the second passage 114 via the storage chamber 112, and the communication path 100 is opened. In consequence, the refrigerant gas having the intermediate pressure which is the suction pressure of the second rotary compression element 34 (the discharge pressure of the first rotary compression element 32) flows, from the suction port 160 into the suction port 161 via the first passage 110, the storage chamber 112 and the second passage 114.

As described above, when the pressure difference between the intermediate pressure applied from the suction port 160 to one surface of the valve device 117 (the sealing portion 117A side) and the low pressure applied from the suction port 161 to the other surface (the spring member 117B side) increases to the predetermined upper limit value, the communication path 100 is opened. Therefore, the intermediate pressure refrigerant gas compressed by the first rotary compression element 32 can be released to the region having the low pressure which is the suction pressure of the first rotary compression element 32.

Next, there will be described an operation of the rotary compressor 10 constituted as described above. When a power is supplied to the stator coil 28 of the electromotive element 14 via the terminal 20 and the wiring line (not shown), the electromotive element 14 starts to rotate the rotor 24. When this rotor rotates, the upper and lower rollers 46, 48 are fitted into the upper and lower eccentric portions 42, 44 disposed integrally with the rotary shaft 16 to eccentrically rotate in the upper and lower cylinders 38, 40.

In consequence, after the low pressure refrigerant is sucked in the lower cylinder 40 on the low pressure chamber side from the suction port 161 via the refrigerant introducing tube 94 and the suction passage 60 formed in the lower support member 56, the refrigerant is compressed by operations of the lower roller 48 and the lower vane 52 to reach the intermediate pressure. The discharge valve 128 which closes the discharge port 39 is then pushed, the discharge port 41 opens, and the intermediate pressure refrigerant gas is discharged into the discharge muffling chamber 64.

The intermediate pressure refrigerant gas discharged into the discharge muffling chamber 64 is sucked in the upper cylinder 38 on the low pressure chamber side from the suction port 160 via the suction passage 58 formed in the upper support member 54 and the refrigerant introducing tube 92 connected to the discharge muffling chamber 64.

At this time, in a case where the pressure difference between the intermediate pressure which is the suction pressure of the second rotary compression element 34 (the discharge pressure of the first rotary compression element 32) and the low pressure which is the suction pressure of the first rotary compression element 32 is lower than the predetermined upper limit value, the valve device 117 (the sealing portion 117A) is pushed upwards by the urging force of the spring member 117B and the low pressure which is the suction pressure of the first rotary compression element 32, and the device is positioned at one end of the storage chamber 112 (in a lower part). Therefore, since the upper surface of the storage chamber 112 is blocked-by the sealing portion 117A of the valve device 117, the first passage 110 is not connected to the second passage 114. That is, the communication path 100 is blocked. Therefore, the intermediate pressure refrigerant gas discharged to the discharge muffling chamber 64 is all sucked in the upper cylinder 38 on the low pressure chamber side from the suction port 160 via the refrigerant introducing tube 92 and the suction passage 58 formed in the upper support member 54.

The sucked intermediate pressure refrigerant gas is secondarily compressed by operations of the upper roller 46 and the upper vane 50 to constitute a high-temperature high-pressure refrigerant gas. In consequence, the discharge valve 127 disposed in the discharge muffling chamber 62 is opened, and the discharge muffling chamber 62 communicates with the discharge port 39. Therefore, the gas is discharged from the high pressure chamber side of the upper cylinder 38 to the discharge muffling chamber 62 formed in the upper support member 54 through the discharge port 39. Moreover, the high pressure refrigerant gas discharged to the discharge muffling chamber 62 is discharged into the sealed vessel 12 from the discharge muffling chamber 62 via the holes 120 formed in the upper cover 66. In consequence, in the sealed vessel 12, the high pressure is achieved which is the discharge pressure of the second rotary compression element 34.

The high pressure refrigerant gas discharged into the sealed vessel 12 moves to the upper part of the sealed vessel 12 through a gap of the electromotive element 14, and is discharged from the rotary compressor 10 via the refrigerant discharge tube 96 connected to the upper part of the sealed vessel 12.

On the other hand, in a case where the pressure difference between the intermediate pressure which is the suction pressure of the second rotary compression element 34 (the discharge pressure of the first rotary compression element 32) and the low pressure which is the suction pressure of the first rotary compression element 32 increases to the predetermined upper limit value, the urging force of the suction pressure of the second rotary compression element 34 (the discharge pressure of the first rotary compression element 32) to push the valve device 117 toward the other side (downwards) is larger than the urging force constituted by combining the urging force of the spring member 117B to push the valve device 117 toward one side (upwards) and the suction pressure of the first rotary compression element 32. Therefore, the spring member 117B is compressed, the valve device 117 moves toward the other end of the storage chamber 112 (downwards), and the first passage 110 is connected to the second passage 114 via the storage chamber 112.

In consequence, the refrigerant gas having the intermediate pressure which is the suction pressure of the second rotary compression element 34 (the discharge pressure of the first rotary compression element 32) flows into the suction port 161 from the suction port 160 via the first passage 110, the storage chamber 112 and the second passage 114. Therefore, a part of the intermediate pressure refrigerant gas compressed by the first rotary compression element 32 and sucked in the second rotary compression element 34 can be released to the suction port 161 (the low pressure region) of the first rotary compression element 32.

In consequence, when the suction pressure (the intermediate pressure) of the second rotary compression element 34 drops and the pressure difference between the intermediate pressure and the low pressure is smaller than the predetermined upper limit value, the valve device 117 (the sealing portion 117A) returns to one end (the upper part) of the storage chamber 112. Therefore, one surface (the upper surface) of the valve device 117 blocks the first passage 110 and the communication path 100.

Thus, in a case where the pressure difference between the intermediate pressure applied from the suction port 160 to one surface (the sealing portion 117A side) of the valve device 117 and the low pressure applied from the suction port 161 to the other surface (the spring member 117B side) increases to the predetermined upper limit value, when the communication path 100 is opened, the communication path 100 is opened before the intermediate pressure reaches the high pressure which is the discharge pressure of the first rotary compression element 32. The intermediate pressure refrigerant gas compressed by the first rotary compression element 32 can be released to the suction port 161 of the region having the low pressure which is the suction pressure of the first rotary compression element. Therefore, the intermediate pressure which is the suction pressure of the second rotary compression element 34 (the discharge pressure of the first rotary compression element 32) can constantly be set to be lower than the high pressure which is the discharge pressure of the second rotary compression element 34.

In consequence, the pressure in the upper cylinder 38 of the second rotary compression element 34 does not rise above the high pressure (the discharge pressure of the second rotary compression element 34) in the sealed vessel 12 which is applied as the back pressure of the upper vane 50. The pressure in the upper cylinder 38 can constantly be set to be not more than the pressure of the storage portion 70A of the upper vane 50. Therefore, it is possible to avoid beforehand a disadvantage that the vane fly of the upper vane 50 occurs owing to the high pressure which is the discharge side pressure applied from the second rotary compression element 34 to such a storage portion 70A and the urging force of the spring 74, and it is possible to secure a stabilized operation situation of the second rotary compression element 34. Furthermore, the intermediate pressure which is the discharge pressure of the first rotary compression element 32 is applied as the back pressure of the lower vane 52 of the first rotary compression element 32 as described above. Therefore, when the intermediate pressure is lowered, it is possible to eliminate a disadvantage that the urging force of the lower vane 52 to the lower roller 48 becomes excessive to break or remarkably wear the lower vane 52.

Moreover, in a case where the intermediate pressure refrigerant gas compressed by the first rotary compression element 32 is released to the suction port 161 of the first rotary compression element 32 which is the low pressure region, an amount of the refrigerant to be sucked in the first rotary compression element 32 decreases. Therefore, it is possible to obtain a power saving effect at a time when the compressor has a light load.

In general, according to the present invention, it is possible to avoid beforehand a disadvantage that the second rotary compression element 34 comes into an unstable operation situation, and a stabilized operation of the multistage compression type rotary compressor 10 can be realized.

Embodiment 2

Figure 9:
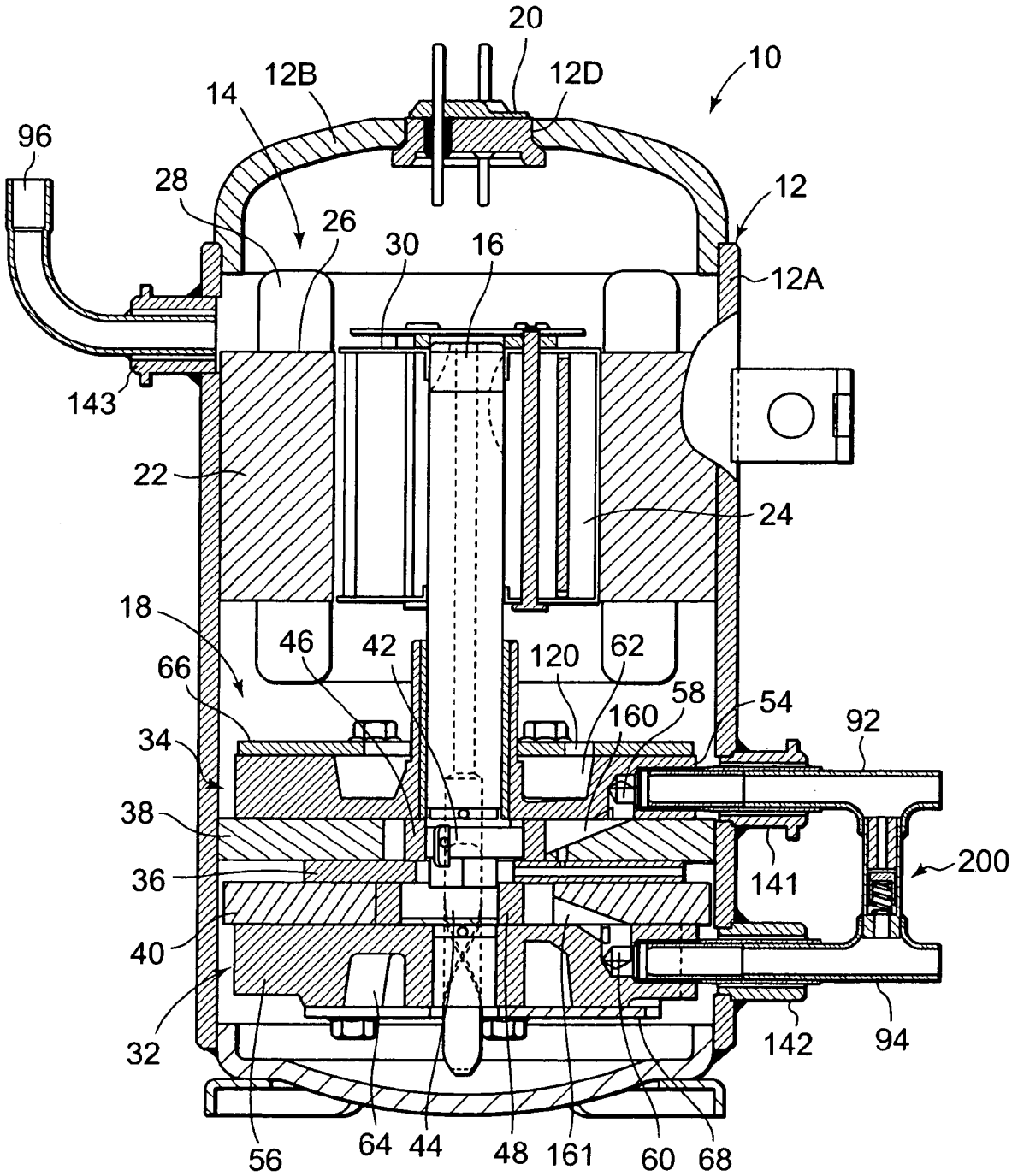
FIG. 9 is a vertical side view of a high inner pressure type multistage compression rotary compressor of a second embodiment to which the present invention is applied (Embodiment 2)
Figure 10:
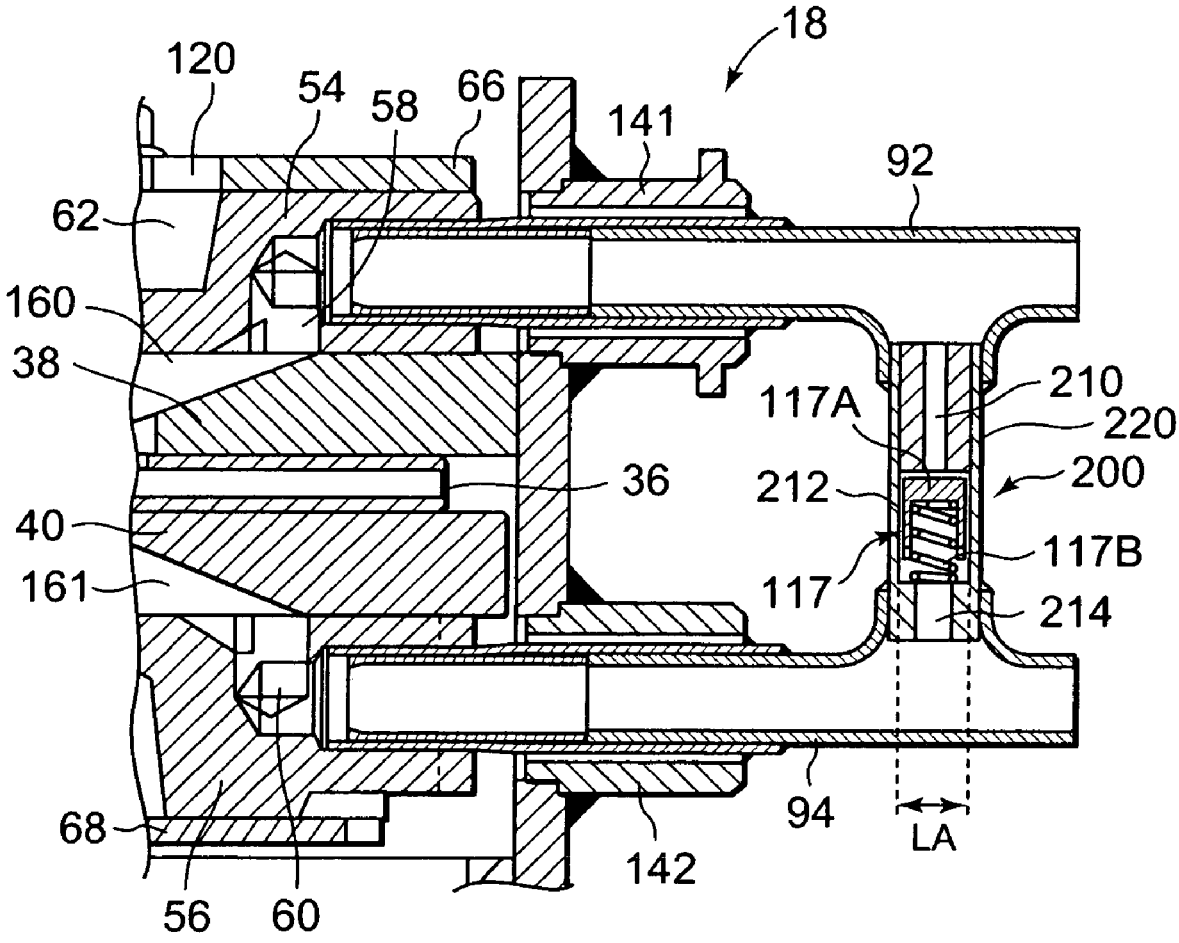
FIG. 10 is a partially enlarged view of the multistage compression type rotary compressor of FIG. 2.

It is to be noted that in the above embodiment (Embodiment 1), the communication path 100 is formed in the sealed vessel 12 of the rotary compressor 10 to connect the suction port 161 to the suction port 160. However, there is not any restriction on a position of the communication path 100 of the present invention as long as the intermediate pressure region is connected to a low pressure region. For example, the communication path may be formed in the outside of the sealed vessel 12. FIGS. 9 and 10 are diagrams showing one example of this case. It is to be noted that in FIGS. 9 and 10, components denoted with the same reference numerals as those of FIGS. 1 to 8 produce the same effect or a similar effect, and description thereof is therefore omitted.

In this case, a communication path 200 is constituted to be closably openable so that a refrigerant introducing tube 92 is connected to a refrigerant introducing tube 94 via a valve device 117. The communication path 200 is a passage to connect an intermediate pressure region to a region having a low pressure which is a suction pressure of a first rotary compression element 32 in the same manner as in the above embodiment. As shown in FIG. 10, the communication path 200 is formed in a pipe 220 which connects the refrigerant introducing tube 94 to the refrigerant introducing tube 92, and constituted of a first passage 210 having one end (an upper end) connected to the refrigerant introducing tube 92; a storage chamber 212 having one surface (an upper surface) connected to the other end (a lower end) of this first passage 210; and a second passage 214 having one end connected to the other surface (a lower surface) of the storage chamber 212 and having the other end connected to the refrigerant introducing tube 94. Moreover, the valve device 117 is vertically movably stored in the storage chamber 212. It is to be noted that since a structure of the valve device 117 is similar to that of the above embodiment, description thereof is omitted.

Furthermore, an intermediate pressure coming from the refrigerant introducing tube 92 through the first passage 210 (which is a suction pressure of a second rotary compression element 34 and a discharge pressure of the first rotary compression element 32) is applied to the upper surface (a sealing portion 117A side) which is one surface of the valve device 117. A low pressure in the refrigerant introducing tube 94 (the suction pressure of the first rotary compression element 32) is applied via the second passage 214 to the lower surface (a spring member 117B side) which is the other surface of the valve device 117.

Moreover, the valve device 117 is constituted to open the communication path 200 in a case where a pressure difference between the intermediate pressure and the low pressure increases to a predetermined upper limit value before the intermediate pressure reaches a high pressure. Specifically, the valve device 117 is constituted to open the communication path 200, when a pressure difference between the suction pressure of the second rotary compression element 34 (the discharge pressure of the first rotary compression element 32) applied to one surface (the sealing portion 117A side) and the suction pressure of the first rotary compression element 32 applied to the other surface (the spring member 117B side) reaches or exceeds a predetermined upper limit value.

That is, in a case where a pressure difference between the intermediate pressure applied from the refrigerant introducing tube 92 to one surface (the sealing portion 117A side) and the low pressure applied from the refrigerant introducing tube 94 to the other surface (the spring member 117B side) is a preset pressure before the intermediate pressure reaches the high pressure, the valve device 117 moves toward the other end of the storage chamber 212 (downwards) owing to the intermediate pressure from the refrigerant introducing tube 92. At this time, since the second passage 214 and the storage chamber 212 are not blocked by the above-described grooves 118, the first passage 210 is connected to the second passage 214 via the storage chamber 212, and the communication path 200 is opened. In consequence, a refrigerant gas having the intermediate pressure which is the suction pressure of the second rotary compression element 34 (the discharge pressure of the first rotary compression element 32) flows from the refrigerant introducing tube 92 into the communication path 200 via the first passage 210, the storage chamber 212 and the second passage 214.

Thus, when the pressure difference between the intermediate pressure applied from the refrigerant introducing tube 92 to one surface of the valve device 117 (the sealing portion 117A side) and the low pressure applied from the refrigerant introducing tube 94 to the other surface (the spring member 117B side) increases to the predetermined upper limit value, the communication path 200 is opened. Therefore, the intermediate pressure refrigerant gas compressed by the first rotary compression element 32 can be released to the region having the low pressure which is the suction pressure of the first rotary compression element 32.

In consequence, the intermediate pressure which is the suction pressure of the second rotary compression element 34 (the discharge pressure of the first rotary compression element 32) can constantly be set to be lower than the high pressure which is the discharge pressure of the second rotary compression element 34 in the same manner as in the above embodiment.

Therefore, a pressure in an upper cylinder 38 of the second rotary compression element 34 does not rise above a pressure in a sealed vessel 12 applied as a back pressure of an upper vane 50 (the discharge pressure of the second rotary compression element 34). The pressure in the upper cylinder 38 can constantly be set to be not more than a pressure of a storage portion 70A of the upper vane 50. Therefore, it is possible to avoid beforehand a disadvantage that vane fly of the upper vane 50 occurs owing to the high pressure which is the discharge pressure of the second rotary compression element 34 applied to such a storage portion 70A and an urging force of a spring 74. A stabilized operation situation of the second rotary compression element 34 can be secured.

Moreover, in a case where the intermediate pressure refrigerant gas compressed by the first rotary compression element 32 is released to the refrigerant introducing tube 94 which is the low pressure region, an amount of the refrigerant to be sucked in the first rotary compression element 32 decreases. Therefore, it is possible to obtain a power saving effect at a time when the compressor has a light load.

It is to be noted that the valve device for use in Embodiments 1 and 2 described above is not limited to the structure of each embodiment, and may have any shape as long as the device opens the communication path in a case where the pressure difference between the intermediate pressure and the low pressure increases to the predetermined upper limit value before the intermediate pressure reaches the high pressure.

Embodiment 3

Figure 11:
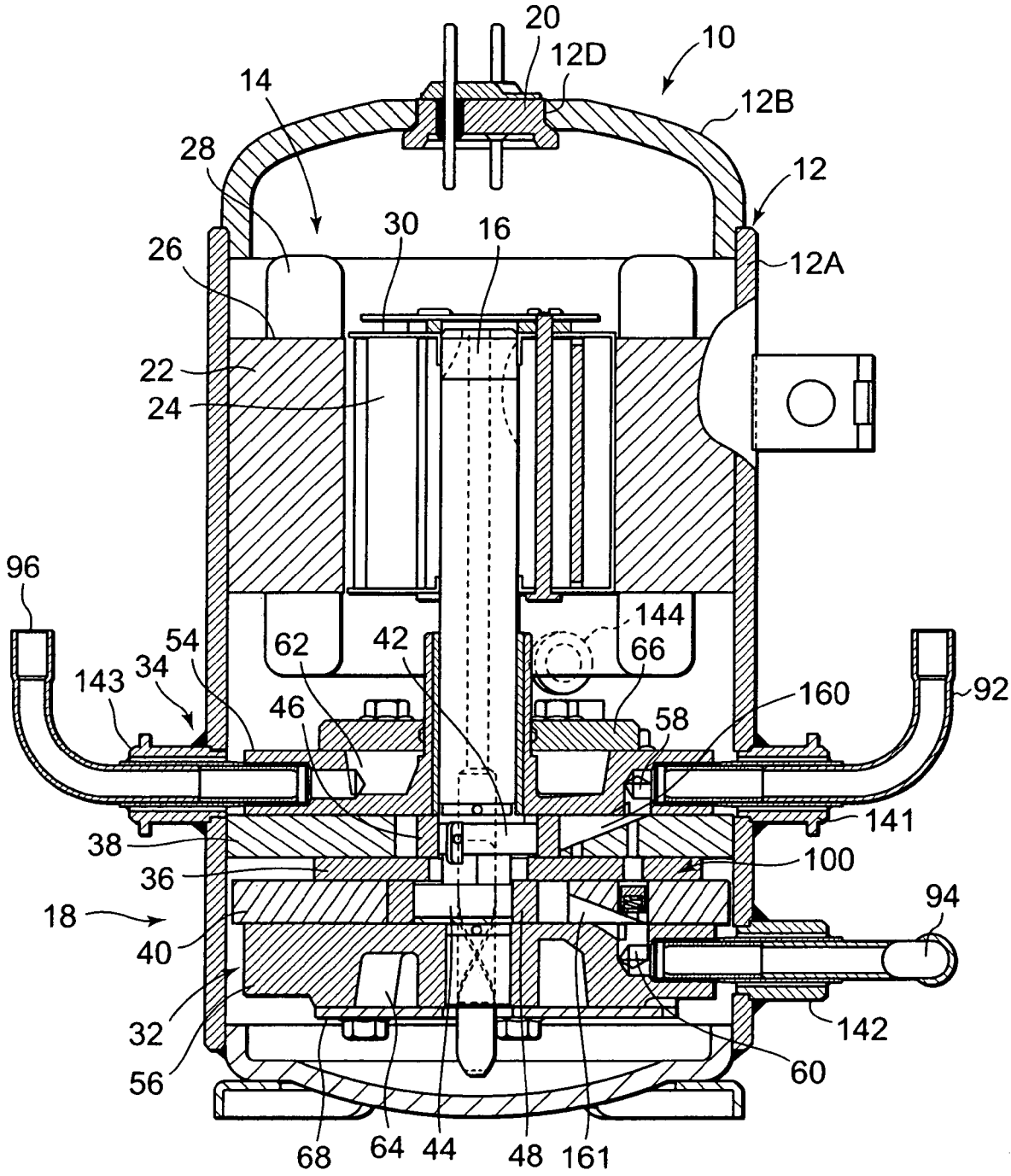
FIG. 11 is a vertical side view of an intermediate inner pressure type multistage compression rotary compressor of a third embodiment to which the present invention is applied (Embodiment 3)

FIG. 11 shows a vertical side view of an intermediate inner pressure type multistage (two stages) compression rotary compressor 10 including first and second rotary compression elements 32, 34 as a third embodiment of a multistage compression type rotary compressor of the present invention. It is to be noted that a bottom plan view of a lower support member 56 of the first rotary compression element 32 is similar to FIG. 2; a plan view of an upper support member 54 of the second rotary compression element 34 (in a state in which an upper cover is attached) is similar to FIG. 3; a bottom plan view of a lower cylinder 40 of the first rotary compression element 32 is similar to FIG. 4; and a plan view of an upper cylinder 38 as a cylinder constituting the second rotary compression element 34 is similar to FIG. 5, respectively.

In FIG. 11, the rotary compressor 10 of the embodiment is the intermediate inner pressure type multistage compression rotary compressor which sucks, in the second rotary compression element, an intermediate pressure refrigerant gas compressed by the first rotary compression element 32 and discharged into a sealed vessel 12, compresses and discharges the refrigerant gas. The rotary compressor 10 includes, in the sealed vessel 12, an electromotive element 14 as a driving element and a rotary compression mechanism section 18 constituted of the first rotary compression element 32 and the second rotary compression element 34 which are driven by this electromotive element 14.

The sealed vessel 12 is constituted of a vessel main body 12A including a bottom portion as an oil reservoir and containing the electromotive element 14 and the rotary compression mechanism section 18; and a substantially bowl-like end cap (a lid member) 12B which blocks an upper opening of this vessel main body 12A. A circular attachment hole 12D is formed in an upper surface of this end cap 12B, and a terminal (a wiring line is omitted) 20 for supplying a power to the electromotive element 14 is attached to this attachment hole 12D.

The electromotive element 14 is constituted of an annular stator 22 welded and fixed along an inner peripheral surface of the sealed vessel 12; and a rotor 24 inserted into the element and disposed at a slight interval from an inner periphery of this stator 22. This rotor 24 is fixed to a rotary shaft 16 extending through the center of the element in a vertical direction.

The stator 22 has a laminated article 26 constituted by laminating donut-like electromagnetic steel plates; and a stator coil 28 wound around teeth portions of this laminated article 26 by a direct winding (concentrated winding) system. Moreover, the rotor 24 is formed of a laminated article 30 constituted of electromagnetic steel plates in the same manner as in the stator 22.

Moreover, the rotary compression mechanism section 18 is constituted of the first rotary compression element 32; the second rotary compression element 34; and an intermediate partition plate 36 sandwiched between both of the rotary compression elements 32 and 34. In the present embodiment, the first rotary compression element 32 is disposed below the intermediate partition plate 36, and the second rotary compression element 34 is disposed above the intermediate partition plate 36. The first rotary compression element 32 includes the lower cylinder 40 disposed on a lower surface of the intermediate partition plate 36; a lower roller 48 which is fitted into an eccentric portion 44 formed on the rotary shaft 16 of the electromotive element 14 to eccentrically rotate in the lower cylinder 40; a lower vane 52 which abuts on the lower roller 48 to divide the inside of the lower cylinder 40 into a low pressure chamber side and a high pressure chamber side; and the lower support member 56 which blocks a lower open surface of the lower cylinder 40 and which also serves as a bearing of the rotary shaft 16.

Here, the low pressure chamber side in the lower cylinder 40 is a space surrounded with the lower vane 52, the lower roller 48 and the lower cylinder 40, and is a region where a suction port 161 is present. The high pressure chamber side is a space surrounded with the lower vane 52, the lower roller 48 and the lower cylinder 40, and is a region where a discharge port 41 is present.

Furthermore, the second rotary compression element 34 includes the upper cylinder 38 which is disposed on an upper surface of the intermediate partition plate 36 and which is a cylinder constituting the second rotary compression element 34; an upper roller 46 which is fitted into an eccentric portion 42 formed on the rotary shaft 16 of the electromotive element 14 to eccentrically rotate in the upper cylinder 38; an upper vane 50 which abuts on the upper roller 46 to divide the inside of the upper cylinder 38 into a low pressure chamber side and a high pressure chamber side; and the upper support member 54 which blocks an upper open surface of the upper cylinder 38 and which also serves as a bearing of the rotary shaft 16. The eccentric portion 44 of the first rotary compression element 32 and the eccentric portion 42 of the second rotary compression element 34 are disposed with a phase difference of 180 degrees in the cylinders 38 and 40, respectively. It is to be noted that the low pressure chamber side in the upper cylinder 38 is a space surrounded with the upper vane 50, the upper roller 46 and the upper cylinder 38, and is a region where a suction port 160 is present. The high pressure chamber side is a space surrounded with the upper vane 50, the upper roller 46 and the upper cylinder 38, and is a region where a discharge port 39 is present.

In the upper and lower cylinders 38, 40, guide grooves 70, 72 to store the vanes 50, 52 are formed, and storage portions 70A, 72A (back pressure chambers) to store springs 74, 76 as spring members are formed on outer sides of the guide grooves 70, 72, that is, on back surface sides of the vanes 50, 52. The springs 74, 76 abut on back surface end portions of the vanes 50, 52, and constantly urge the vanes 50, 52 toward the rollers 46, 48. Moreover, the storage portion 70A opens on a guide groove 70 side and a sealed vessel 12 side (a vessel main body 12A side). Plugs (not shown) are disposed on the springs 74, 76 stored in the storage portions 70A, 72A on the sealed vessel 12 side, and have functions of preventing the springs 74, 76 from being detached. An O-ring (not shown) for sealing between the plug and an inner surface of the storage portion 79A is attached to a peripheral surface of the plug of the spring 74 to achieve a constitution in which a pressure in the sealed vessel 12 does not flow into the storage portion 70A.

Moreover, the storage portion 70A communicates with a discharge muffling chamber 62 described later via a communication path (not shown), and a high pressure (a discharge side pressure of the refrigerant gas of the second rotary compression element 34, the gas being compressed by the second rotary compression element 34 and discharged to the discharge muffling chamber 62) which is a discharge pressure of the second rotary compression element 34 is applied to the storage portion 70A. That is, the high pressure which is the discharge pressure of the second rotary compression element 34 is applied as a back pressure to the upper vane 50 of the second rotary compression element 34.

On the other hand, a peripheral surface of the plug of the spring 76 is not sealed. In consequence, an intermediate pressure in the sealed vessel 12 (a pressure of the gas compressed by the first rotary compression element 32 and discharged into the sealed vessel 12) is applied to the storage portion 72A. That is, the intermediate pressure which is the discharge side pressure of the first rotary compression element 32 is applied as the back pressure to the lower vane 52 of the first rotary compression element 32.

The upper and lower support members 54, 56 include suction passages 58, 60 which communicate with the upper and lower cylinders 38, 40 via the suction ports 160, 161. The upper support member 54 is provided with the discharge muffling chamber 62 formed by depressing a part of the surface of the member opposite to the surface of the member which abuts on the upper cylinder 38, and blocking this depressed concave portion with a cover as a wall. That is, the discharge muffling chamber 62 is blocked with an upper cover 66 as the wall which defines the discharge muffling chamber 62.

A discharge valve 127 which openably blocks the discharge port 39 is disposed on a lower surface of the discharge muffling chamber 62. This discharge valve 127 includes an elastic member constituted of a metal plate which is vertically long and substantially rectangular, and a backer valve (not shown) as a discharge valve press plate is disposed above this discharge valve 127, and attached to the upper support member 54. Moreover, one side of the discharge valve 127 abuts on the discharge port 39 to seal the port, and the other side thereof is fixed, with a caulking pin or the like, to an attachment hole of the upper support member 54 which is disposed at a predetermined interval from the discharge port 39.

Moreover, the refrigerant gas compressed in the upper cylinder 38 to reach a predetermined pressure pushes up, from below in FIG. 11, the discharge valve 127 which closes the discharge port 39 to open the discharge port 39, and the gas is discharged into the discharge muffling chamber 62. At this time, the discharge valve 127 is fixed to the upper support member 54 on the other side. Therefore, one side of the valve which abuts on the discharge port 39 warps upwards to abut on the backer valve (not shown) which regulates an open amount of the discharge valve 127. In a case where it is a time to end the discharge of the refrigerant gas, the discharge valve 127 is detached from the backer valve, and the discharge port 39 is blocked.

On the other hand, the lower support member 56 is provided with a discharge muffling chamber 64 formed by depressing a part of the surface (the lower surface) of the member opposite to the surface of the member which abuts on the lower cylinder 40, and blocking this depressed concave portion with a cover as a wall. That is, the discharge muffling chamber 64 is blocked with a lower cover 68 as the wall which defines the discharge muffling chamber 64.

Moreover, a discharge valve 128 which openably blocks the discharge port 40 is disposed on an upper surface of the discharge muffling chamber 64. This discharge valve 128 includes an elastic member constituted of a metal plate which is vertically long and substantially rectangular, and a backer valve (not shown) as a discharge valve press plate is disposed below this discharge valve 128, and attached to the lower support member 56. Moreover, one side of the discharge valve 128 abuts on the discharge port 41 to seal the port, and the other side thereof is fixed, with a caulking pin or the like, to an attachment hole of the lower support member 56 which is disposed at a predetermined interval from the discharge port 41.

Furthermore, the refrigerant gas compressed in the lower cylinder 40 to reach a predetermined pressure pushes down, from above in FIG. 1, the discharge valve 128 which closes the discharge port 41 to open the discharge port 41, and the gas is discharged to the discharge muffling chamber 64. At this time, the discharge valve 128 is fixed to the lower support member 56 on the other side. Therefore, one side of the valve which abuts on the discharge port 41 warps upwards to abut on the backer valve (not shown) which regulates an open amount of the discharge valve 128. In a case where it is a time to end the discharge of the refrigerant gas, the discharge valve 128 is detached from the backer valve, and the discharge port 41 is blocked.

The discharge muffling chamber 64 of the first rotary compression element 32 communicates with the sealed vessel 12 via holes (not shown) which extend through the lower support member 56, the lower cylinder 40, the intermediate partition plate 36, the upper cylinder 38, the upper support member 54 and the upper cover 66. The intermediate pressure refrigerant gas compressed by the first rotary compression element 32 and discharged to the discharge muffling chamber 64 is discharged into the sealed vessel 12 from these holes.

In addition, sleeves 141, 142, 143 and 144 are welded and fixed to positions corresponding to positions of the suction passages 58, 60 of the upper and lower support members 54, 56, on a side opposite to the suction passage 58 of the upper support member 54 and a lower part of the rotor 24 (right under the electromotive element 14), respectively. The sleeve 141 is vertically adjacent to the sleeve 142, and the sleeve 143 is disposed substantially along a diagonal line of the sleeve 141.

Moreover, one end of a refrigerant introducing tube 92 for introducing the refrigerant gas into the upper cylinder 38 is inserted into the sleeve 141, and the one end of the refrigerant introducing tube 92 is connected to the suction passage 58 of the upper support member 54. This refrigerant introducing tube 92 passes from the sealed vessel 12 to reach the sleeve 144. The other end of the tube is inserted into the sleeve 144 to communicate with the sealed vessel 12.

Furthermore, one end of a refrigerant introducing tube 94 for introducing the refrigerant gas into the lower cylinder 40 is inserted into the sleeve 142, and the one end of this refrigerant introducing tube 94 communicates with the suction passage 60 of the lower support member 56. A refrigerant discharge tube 96 is inserted into and connected to the sleeve 143, and one end of this refrigerant discharge tube 96 communicates with the discharge muffling chamber 62.

On the other hand, the rotary compressor 10 is provided with a communication path 100 of the present invention. This communication path 100 is a passage which connects a region having an intermediate pressure to a region having a low pressure which is a suction pressure of the first rotary compression element 32. The communication path 100 of the present embodiment connects the suction port 161 of the first rotary compression element 32 to the suction port 160 of the second rotary compression element 34. Here, the intermediate pressure region is a region ranging from a discharge step region (i.e., the high pressure chamber side of the first rotary compression element 32 at this time) of the first rotary compression element 32 where there exists the discharge port 41 surrounded with the lower roller 48, the lower vane 52 and the lower cylinder 40 positioned at a time when the discharge valve 128 of the first rotary compression element 32 starts to open. The intermediate pressure region ranges from the above region through the discharge muffling chamber 64 of the first rotary compression element 32 to a suction step region (i.e., the low pressure chamber side of the second rotary compression element 34 at this time) of the second rotary compression element 34 where there exists the suction port 160 surrounded with the upper roller 46, the upper vane 50 and the upper cylinder 38 positioned at a time when the discharge valve 127 of the second rotary compression element 34 starts to open.

Moreover, the low pressure region is a region on a refrigerant upstream side of the suction step region (i.e., the low pressure chamber side of the first rotary compression element 32 at this time) of the first rotary compression element 32 where there exists the suction port 161 surrounded with the lower roller 48, the lower vane 52 and the lower cylinder 40 positioned at a time when the discharge valve 128 of the first rotary compression element 32 starts to open. This low pressure region is a region ranging to the refrigerant introducing tube 94 in the rotary compressor 10 alone.

Furthermore, in the present embodiment, the high pressure is the discharge pressure of the second rotary compression element 34. Therefore, the high pressure region is a region on a refrigerant downstream side of a region ranging through the discharge muffling chamber 62 of the second rotary compression element 34 from the suction step region (i.e., the high pressure chamber side of the second rotary compression element 34 at this time) of the second rotary compression element 34 where there exists the discharge port 39 surrounded with the upper roller 46, the upper vane 50 and the upper cylinder 38 positioned at a time when the discharge valve 127 of the second rotary compression element 34 starts to open. This high pressure region is a region ranging to the refrigerant discharge tube 96 in the rotary compressor 10 alone.

Figure 12:
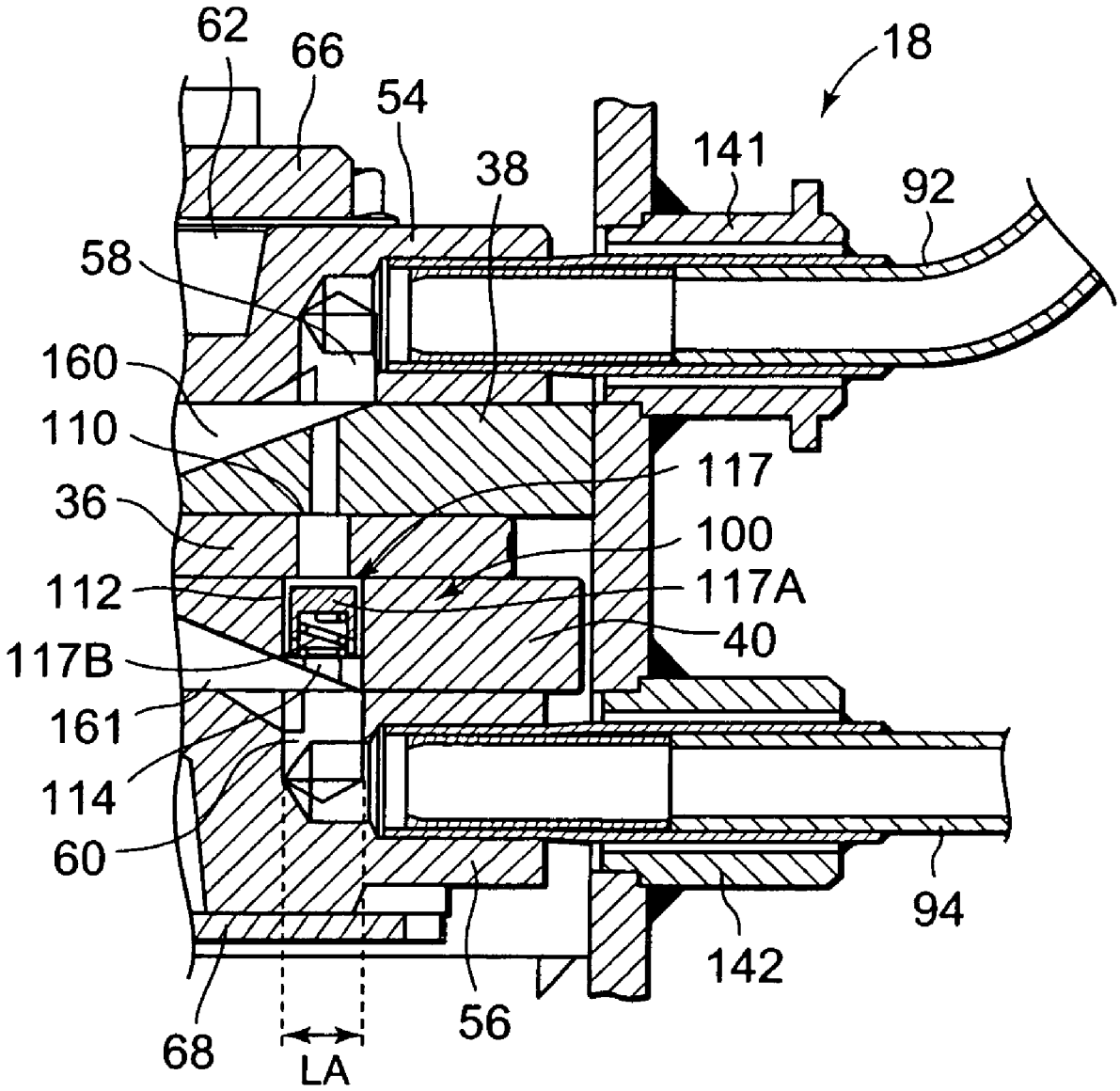
FIG. 12 is a partially enlarged view of the multistage compression type rotary compressor of FIG. 11.

On the other hand, as shown in FIG. 12, the communication path 100 includes a first passage 110 formed in an axial center direction (a vertical direction) of the upper cylinder 38 and the intermediate partition plate 36; a storage chamber 112 connected to this first passage 110 and formed in the lower cylinder 40; and a second passage 114 formed in an axial center direction (a vertical direction) of the lower cylinder 40. The first passage 110 is a passage which connects the suction port 160 on a suction side of the second rotary compression element 34 to the storage chamber 112, one end of the first passage communicates with the suction port 160, and the other end thereof communicates with one surface (an upper surface) of the storage chamber 112. The second passage 114 is a passage which connects the suction port 161 on a suction side of the first rotary compression element 32 to the storage chamber 112, one end of the second passage communicates with the other surface (a lower surface) of the storage chamber 112, and the other end thereof communicates with the suction port 161.

The storage chamber 112 is a cylindrical space formed in an axial direction (a vertical direction) of the lower cylinder 40, and a valve device 117 which opens or closes the communication path 100 is vertically movably stored in the storage chamber 112. The valve device 117 is constituted of a sealing portion 117A having a U-shaped section; and a spring member 117B having one end attached to the inside of the sealing portion 117A. The sealing portion 117A has a vertically long cylinder shape, and a space capable of storing the spring member 117B is formed in the sealing portion. A side (an upper part) of the sealing portion 117A opposite to a side to which the spring member 117B is attached has a flat surface. When this surface is stored in the storage chamber 112, the surface is positioned on a side of one surface (an upper surface side) of the storage chamber 112, and openably blocks the storage chamber 112 and the first passage 110. As shown in FIGS. 7 and 8, edge portions 117C which are distant ends of a lower opening are provided with grooves 118 in a diametric direction. The grooves 118 connect the second passage 114 to the storage chamber 112 in a state in which the sealing portion 117A is positioned on the other surface (the lower surface) of the storage chamber 112 on the other end, that is, the edge portions 117C abut on the lower surface.

Moreover, a dimension LA of the sealing portion 117A in a horizontal direction (the diametric direction) is set to be smaller than a dimension LB (shown in FIG. 7) of the storage chamber 112 in the horizontal direction (the diametric direction). Therefore, in a state in which the sealing portion 117A is stored in the storage chamber 112, a predetermined clearance is constituted between the sealing portion 117A and the storage chamber 112 in the horizontal direction (the diametric direction).

The spring member 117B is a spring member having a predetermined spring force in a direction from a second passage 114 side to a first passage 110 side (in an upper direction of FIG. 12), and constantly urges the sealing portion 117A toward the first passage 110 (upwards). As to the spring force of the spring member 117B, in a case where a pressure difference between the intermediate pressure applied from above the valve device 117 and the low pressure applied from below is lower than a predetermined pressure difference (lower than a predetermined upper limit value), an upward urging force which is a sum of the low pressure and the spring member is larger than a downward urging force of the intermediate pressure. When a pressure difference between the intermediate pressure applied from above the valve device 117 and the low pressure applied from below is not less than a predetermined pressure difference (the pressure difference increases to a predetermined upper limit value), the downward urging force of the intermediate pressure is set to be larger than the upward urging force which is the sum of the low pressure and the spring member. It is to be noted that the predetermined upper limit value is appropriately selected from a range of 3.5 MPa to 6.0 MPa in accordance with a use application, a type and the like of the rotary compressor 10. For example, in a case where the rotary compressor 10 is used as a hot water supply unit, when the pressure difference between the intermediate pressure and the low pressure rises to 5.0 MPa, the intermediate pressure as the discharge pressure of the first rotary compression element 32 and the high pressure as the discharge pressure of the first rotary compression element 32 are reversed, or both the pressures are substantially equal. There is a possibility that vane fly of the upper vane 50 of the second rotary compression element 34 occurs. Therefore, the upper limit value is set to be lower than 5.0 MPa (the upper limit value is set to, e.g., 4.5 MPa).

Furthermore, the intermediate pressure (which is the suction pressure of the second rotary compression element 34 and the discharge pressure of the first rotary compression element 32) applied into the suction port 160 through the first passage 110 is applied to the upper surface which is one surface of the valve device 117 (the sealing portion 117A side). The low pressure (the suction pressure of the first rotary compression element 32) in the suction port 161 is applied to the lower surface which is the other surface of the valve device 117 (the spring member 117B side) via the second passage 114.

In addition, the valve device 117 is constituted to open the communication path 100 in a case where the pressure difference between the intermediate pressure and the low pressure increases to a predetermined upper limit value before the intermediate pressure reaches the high pressure. Specifically, the valve device 117 of the present embodiment is constituted to open the communication path 100 in a case where the pressure difference between the suction pressure of the second rotary compression element 34 (the discharge pressure of the first rotary compression element 32) applied to one surface (the sealing portion 117A side) and the suction pressure of the first rotary compression element 32 applied to the other surface (the spring member 117B side) is not less than the predetermined upper limit value. It is to be noted that the predetermined upper limit value is set beforehand to a value of the pressure before the intermediate pressure reaches the high pressure.

That is, when the pressure difference between the intermediate pressure applied from the suction port 160 to one surface (the sealing portion 117A side) and the low pressure applied from the suction port 161 to the other surface (the spring member 117B side) increases to the predetermined upper limit value set beforehand, the spring member 117B is compressed by the intermediate pressure from the suction port 160. Therefore, the valve device 117 moves toward the other end of the storage chamber 112. At this time, since the second passage 114 and the storage chamber 112 are not blocked by the grooves 118, the first passage 110 is connected to the second passage 114 via the storage chamber 112, and the communication path 100 is opened. In consequence, the refrigerant gas having the intermediate pressure which is the suction pressure of the second rotary compression element 34 (the discharge pressure of the first rotary compression element 32) flows from the suction port 160 into the suction port 161 via the first passage 110, the storage chamber 112 and the second passage 114.

As described above, when the pressure difference between the intermediate pressure applied from the suction port 160 to one surface of the valve device 117 (the sealing portion 117A side) and the low pressure applied from the suction port 161 to the other surface (the spring member 117B side) increases to the predetermined upper limit value, the communication path 100 is opened. Therefore, the intermediate pressure refrigerant gas compressed by the first rotary compression element 32 can be released to the region having the low pressure which is the suction pressure of the first rotary compression element 32.

Next, there will be described an operation of the rotary compressor 10 constituted as described above. When a power is supplied to the stator coil 28 of the electromotive element 14 via the terminal 20 and the wiring line (not shown), the electromotive element 14 starts to rotate the rotor 24. When this rotor rotates, the upper and lower rollers 46, 48 are fitted into the upper and lower eccentric portions 42, 44 disposed integrally with the rotary shaft 16 to eccentrically rotate in the upper and lower cylinders 38, 40.

In consequence, after the low pressure refrigerant is sucked in the lower cylinder 40 on the low pressure chamber side from the suction port 161 via the refrigerant introducing tube 94 and the suction passage 60 formed in the lower support member 56, the refrigerant is compressed by operations of the lower roller 48 and the lower vane 52 to reach the intermediate pressure. The discharge valve 128 which closes the discharge port 39 is then pushed, the discharge port 41 opens, and the intermediate pressure refrigerant gas is discharged into the discharge muffling chamber 64.

The intermediate pressure refrigerant gas discharged into the discharge muffling chamber 64 is discharged from the discharge muffling chamber 64 into the sealed vessel 12 via holes (not shown). In consequence, the intermediate pressure which is the discharge side pressure of the first rotary compression element 32 is achieved in the sealed vessel 12. The intermediate pressure refrigerant gas discharged into the sealed vessel 12 exits from the sleeve 144 and is sucked in the upper cylinder 38 on the low pressure chamber side from the suction port 160 via the refrigerant introducing tube 92 and the suction passage 58 formed in the upper support member 54.

At this time, in a case where the pressure difference between the intermediate pressure which is the suction pressure of the second rotary compression element 34 (the discharge pressure of the first rotary compression element 32) and the low pressure which is the suction pressure of the first rotary compression element 32 is lower than the predetermined upper limit value, the valve device 117 (the sealing portion 117A) is pushed upwards by the urging force of the spring member 117B and the low pressure which is the suction pressure of the first rotary compression element 32, and the device is positioned at one end of the storage chamber 112 (in a lower part). Therefore, since the upper surface of the storage chamber 112 is blocked by the sealing portion 117A of the valve device 117, the first passage 110 is not connected to the second passage 114. That is, the communication path 100 is blocked. Therefore, the intermediate pressure refrigerant gas discharged into the sealed vessel 12 exits from the sleeve 144, and is all sucked in the upper cylinder 38 on the low pressure chamber side from the suction port 160 via the refrigerant introducing tube 92 and the suction passage 58 formed in the upper support member 54.

The sucked intermediate pressure refrigerant gas is secondarily compressed by operations of the upper roller 46 and the upper vane 50 to constitute a high-temperature high-pressure refrigerant gas. In consequence, the discharge valve 127 disposed in the discharge muffling chamber 62 is opened, and the discharge muffling chamber 62 communicates with the discharge port 39. Therefore, the gas is discharged from the high pressure chamber side of the upper cylinder 38 to the discharge muffling chamber 62 formed in the upper support member 54 via the discharge port 39. Moreover, the high pressure refrigerant gas discharged to the discharge muffling chamber 62 is discharged from the rotary compressor 10 via the refrigerant discharge tube 96.

On the other hand, in a case where the pressure difference between the intermediate pressure which is the suction pressure of the second rotary compression element 34 (the discharge pressure of the first rotary compression element 32) and the low pressure which is the suction pressure of the first rotary compression element 32 increases to the predetermined upper limit value, the urging force of the suction pressure of the second rotary compression element 34 (the discharge pressure of the first rotary compression element 32) to push the valve device 117 toward the other side (downwards) is larger than the urging force constituted by combining the urging force of the spring member 117B to push the valve device 117 toward one side (upwards) and the suction pressure of the first rotary compression element 32. Therefore, the spring member 117B is compressed, the valve device 117 moves toward the other end of the storage chamber 112 (downwards), and the first passage 110 is connected to the second passage 114 via the storage chamber 112.

In consequence, the refrigerant gas having the intermediate pressure which is the suction pressure of the second rotary compression element 34 (the discharge pressure of the first rotary compression element 32) flows into the suction port 161 from the suction port 160 via the first passage 110, the storage chamber 112 and the second passage 114. Therefore, a part of the intermediate pressure refrigerant gas compressed by the first rotary compression element 32 and sucked in the second rotary compression element 34 can be released to the suction port 161 (the low pressure region) of the first rotary compression element 32.

In consequence, when the suction pressure (the intermediate pressure) of the second rotary compression element 34 drops and the pressure difference between the intermediate pressure and the low pressure is smaller than the predetermined upper limit value, the valve device 117 (the sealing portion 117A) returns to one end (the upper part) of the storage chamber 112. Therefore, one surface (the upper surface) of the valve device 117 blocks the first passage 110 and the communication path 100.

Thus, in a case where the pressure difference between the intermediate pressure applied from the suction port 160 to one surface (the sealing portion 117A side) of the valve device 117 and the low pressure applied from the suction port 161 to the other surface (the spring member 117B side) increases to the predetermined upper limit value, when the communication path 100 is opened, the communication path 100 is opened before the intermediate pressure reaches the high pressure which is the discharge pressure of the first rotary compression element 32. The intermediate pressure refrigerant gas compressed by the first rotary compression element 32 can be released to the suction port 161 of the region having the low pressure which is the suction pressure of the first rotary compression element. Therefore, the intermediate pressure which is the suction pressure of the second rotary compression element 34 (the discharge pressure of the first rotary compression element 32) can constantly be set to be lower than the high pressure which is the discharge pressure of the second rotary compression element 34.

In consequence, the pressure in the upper cylinder 38 of the second rotary compression element 34 does not rise above the discharge pressure of the second rotary compression element 34 applied as the back pressure of the upper vane 50. The pressure in the upper cylinder 38 can constantly be set to be not more than the pressure of the storage portion 70A of the upper vane 50. Therefore, it is possible to avoid beforehand a disadvantage that the vane fly of the upper vane 50 occurs owing to the high pressure which is the discharge side pressure of the second rotary compression element 34 applied to such a storage portion 70A and the urging force of the spring 74, and it is possible to secure a stabilized operation situation of the second rotary compression element 34.

Furthermore, in a case where the intermediate pressure refrigerant gas compressed by the first rotary compression element 32 is released to the suction port 161 of the first rotary compression element 32 which is the low pressure region, an amount of the refrigerant to be sucked in the first rotary compression element 32 decreases. Therefore, it is possible to obtain a power saving effect at a time when the compressor has a light load.

In general, according to the present invention, it is possible to avoid beforehand a disadvantage that the second rotary compression element 34 comes into an unstable operation situation, and a stabilized operation of the multistage compression type rotary compressor 10 can be realized.

Embodiment 4

Figure 13:
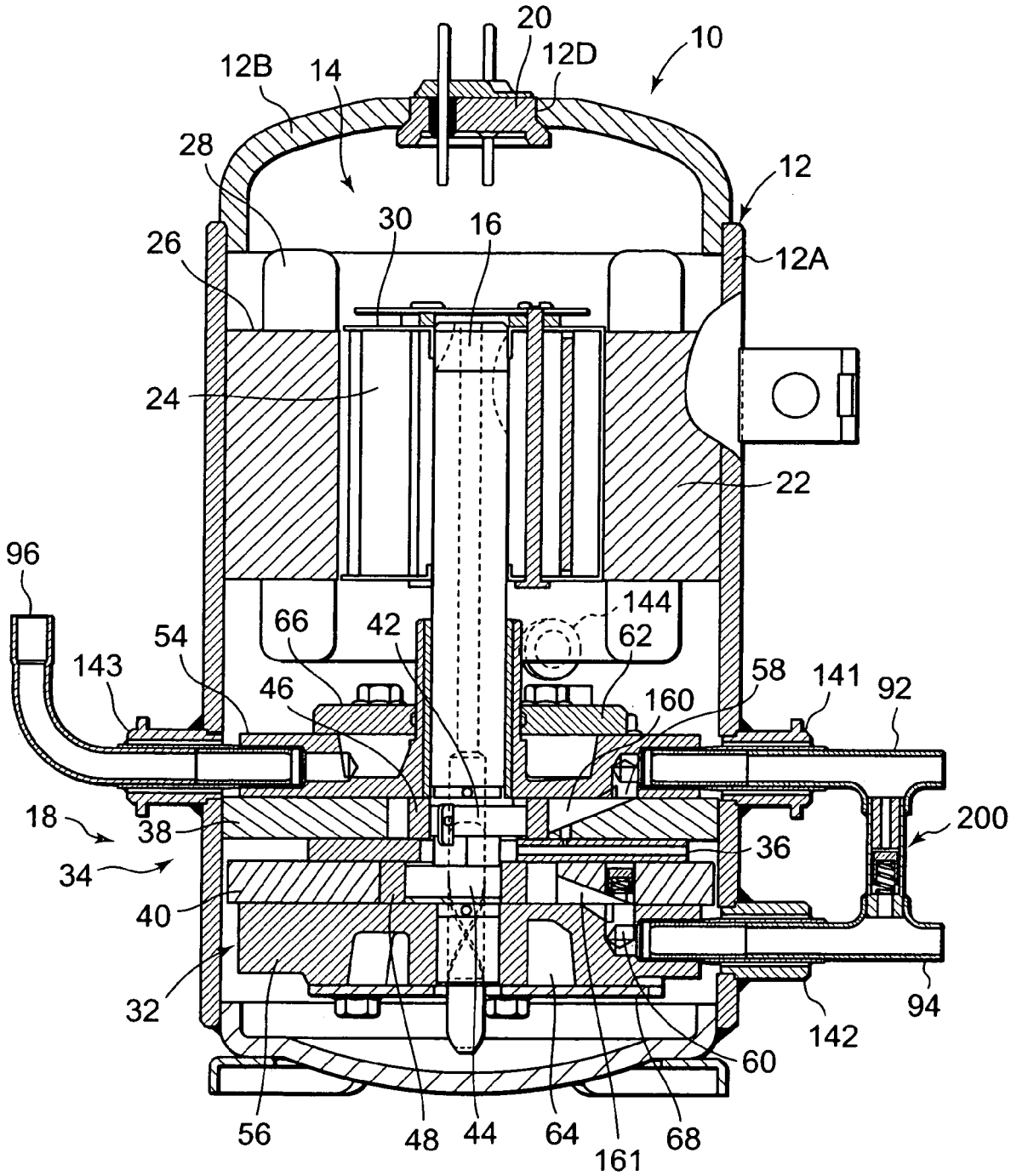
FIG. 13 is a vertical side view of an intermediate inner pressure type multistage compression rotary compressor of a fourth embodiment to which the present invention is applied (Embodiment 4)
Figure 14:
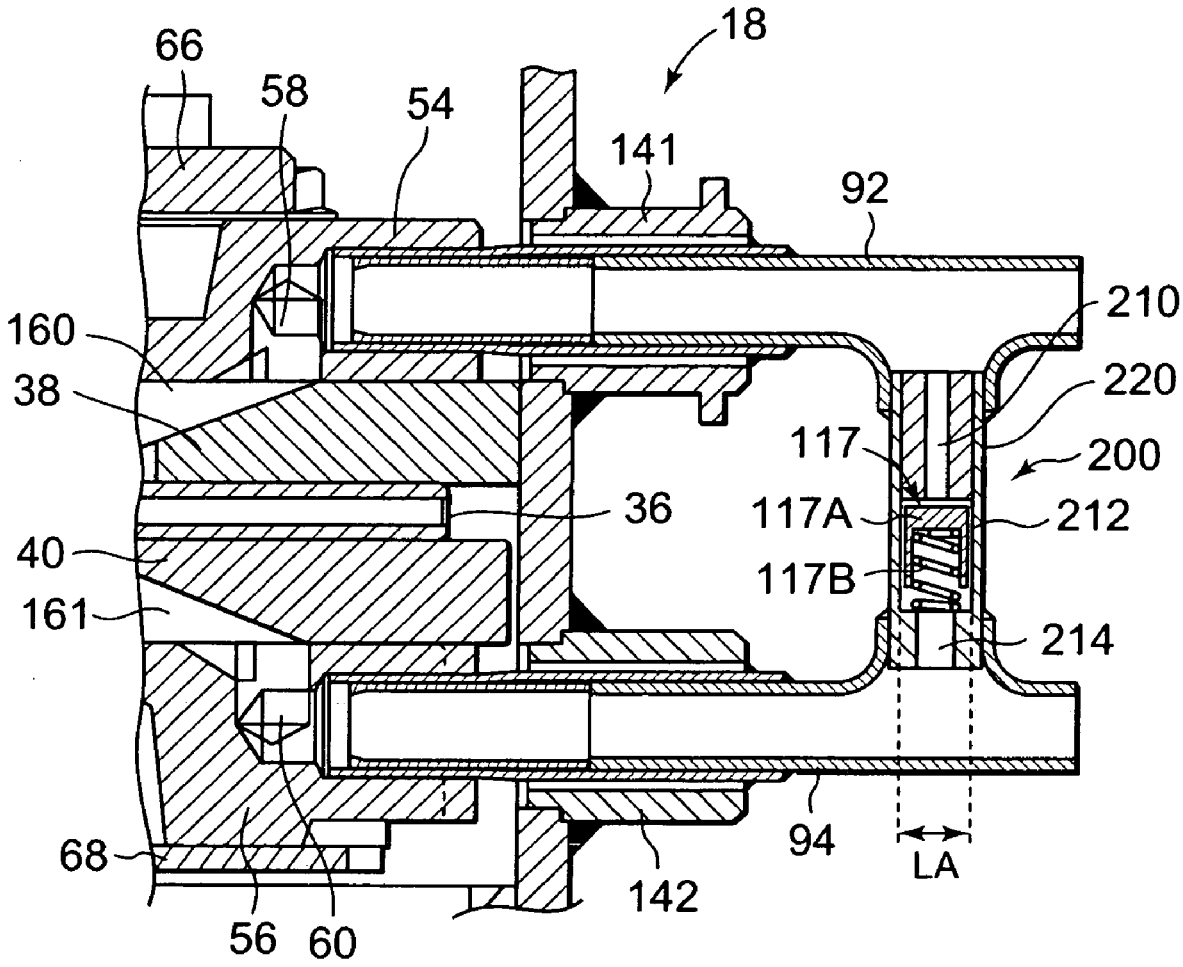
FIG. 14 is a partially enlarged view of the multistage compression type rotary compressor of FIG. 13.

It is to be noted that in the above embodiment (Embodiment 3), the communication path 100 is formed in the sealed vessel 12 of the rotary compressor 10 to connect the suction port 161 to the suction port 160. However, there is not any restriction on a position of the communication path 100 of the present invention as long as the intermediate pressure region is connected to a low pressure region. For example, the communication path may be formed in the outside of the sealed vessel 12. FIGS. 13 and 14 are diagrams showing one example of this case. It is to be noted that in FIGS. 13 and 14, components denoted with the same reference numerals as those of FIGS. 1 to 12 produce the same effect or a similar effect, and description thereof is therefore omitted.

In this case, a communication path 200 is constituted to be closably openable so that a refrigerant introducing tube 92 is connected to a refrigerant introducing tube 94 via a valve device 117. The communication path 200 is a passage to connect an intermediate pressure region to a region having a low pressure which is a suction pressure of a first rotary compression element 32 in the same manner as in the above embodiment. As shown in FIG. 13, the communication path 200 is formed in a pipe 220 which connects the refrigerant introducing tube 94 to the refrigerant introducing tube 92, and constituted of a first passage 210 having one end (an upper end) connected to the refrigerant introducing tube 92; a storage chamber 212 having one surface (an upper surface) connected to the other end (a lower end) of this first passage 210; and a second passage 214 having one end connected to the other surface (a lower surface) of the storage chamber 212 and having the other end connected to the refrigerant introducing tube 94. Moreover, the valve device 117 is vertically movably stored in the storage chamber 212. It is to be noted that since a structure of the valve device 117 is similar to that of the above embodiment, description thereof is omitted.

Furthermore, an intermediate pressure coming from the refrigerant introducing tube 92 through the first passage 210 (which is a suction pressure of a second rotary compression element 34 and a discharge pressure of the first rotary compression element 32) is applied to the upper surface (a sealing portion 117A side) which is one surface of the valve device 117. A low pressure in the refrigerant introducing tube 94 (the suction pressure of the first rotary compression element 32) is applied via the second passage 214 to the lower surface (a spring member 117B side) which is the other surface of the valve device 117.

Moreover, the valve device 117 is constituted to open the communication path 200 in a case where a pressure difference between the intermediate pressure and the low pressure increases to a predetermined upper limit value before the intermediate pressure reaches a high pressure. Specifically, the valve device 117 of the present embodiment is constituted to open the communication path 200, when a pressure difference between the suction pressure of the second rotary compression element 34 (the discharge pressure of the first rotary compression element 32) applied to one surface (the sealing portion 117A side) and the suction pressure of the first rotary compression element 32 applied to the other surface (the spring member 117B side) reaches or exceeds a predetermined upper limit value.

That is, in a case where a pressure difference between the intermediate pressure applied from the refrigerant introducing tube 92 to one surface (the sealing portion 117A side) and the low pressure applied from the refrigerant introducing tube 94 to the other surface (the spring member 117B side) is a preset pressure before the intermediate pressure reaches the high pressure, the valve device 117 moves toward the other end of the storage chamber 212 (downwards) owing to the intermediate pressure from the refrigerant introducing tube 92. At this time, since the second passage 214 and the storage chamber 212 are not blocked by the above-described grooves 118, the first passage 210 is connected to the second passage 214 via the storage chamber 212, and the communication path 200 is opened. In consequence, a refrigerant gas having the intermediate pressure which is the suction pressure of the second rotary compression element 34 (the discharge pressure of the first rotary compression element 32) flows from the refrigerant introducing tube 92 into the communication path 200 via the first passage 210, the storage chamber 212 and the second passage 214.

Thus, when the pressure difference between the intermediate pressure applied from the refrigerant introducing tube 92 to one surface of the valve device 117 (the sealing portion 117A side) and the low pressure applied from the refrigerant introducing tube 94 to the other surface (the spring member 117B side) increases to the predetermined upper limit value, the communication path 200 is opened. Therefore, the intermediate pressure refrigerant gas compressed by the first rotary compression element 32 can be released to the region having the low pressure which is the suction pressure of the first rotary compression element 32.

In consequence, the intermediate pressure which is the suction pressure of the second rotary compression element 34 (the discharge pressure of the first rotary compression element 32) can constantly be set to be lower than the high pressure which is the discharge pressure of the second rotary compression element 34 in the same manner as in the above embodiment.

Therefore, a pressure in an upper cylinder 38 of the second rotary compression element 34 does not rise above the discharge pressure of the second rotary compression element 34 applied as a back pressure of an upper vane 50. The pressure in the upper cylinder 38 can constantly be set to be not more than a pressure of a storage portion 70A of the upper vane 50. Therefore, it is possible to avoid beforehand a disadvantage that vane fly of the upper vane 50 occurs owing to the high pressure which is the discharge pressure of the second rotary compression element 34 applied to such a storage portion 70A and an urging force of a spring 74. A stabilized operation situation of the second rotary compression element 34 can be secured.

Moreover, in a case where the intermediate pressure refrigerant gas compressed by the first rotary compression element 32 is released to the refrigerant introducing tube 94 which is the low pressure region, an amount of the refrigerant to be sucked in the first rotary compression element 32 decreases. Therefore, it is possible to obtain a power saving effect at a time when the compressor has a light load.

It is to be noted that the valve device for use in Embodiments 3 and 4 described above is not limited to the structure of each embodiment, and may have any shape as long as the device opens the communication path in a case where the pressure difference between the intermediate pressure and the low pressure increases to the predetermined upper limit value before the intermediate pressure reaches the high pressure.

Moreover, in the above embodiments, as the rotary compressor 10, a two-stage compression type rotary compressor has been described, but the present invention may be applied to an intermediate inner pressure type rotary compressor including three or more stages of rotary compression elements.

Embodiment 5

Figure 15:
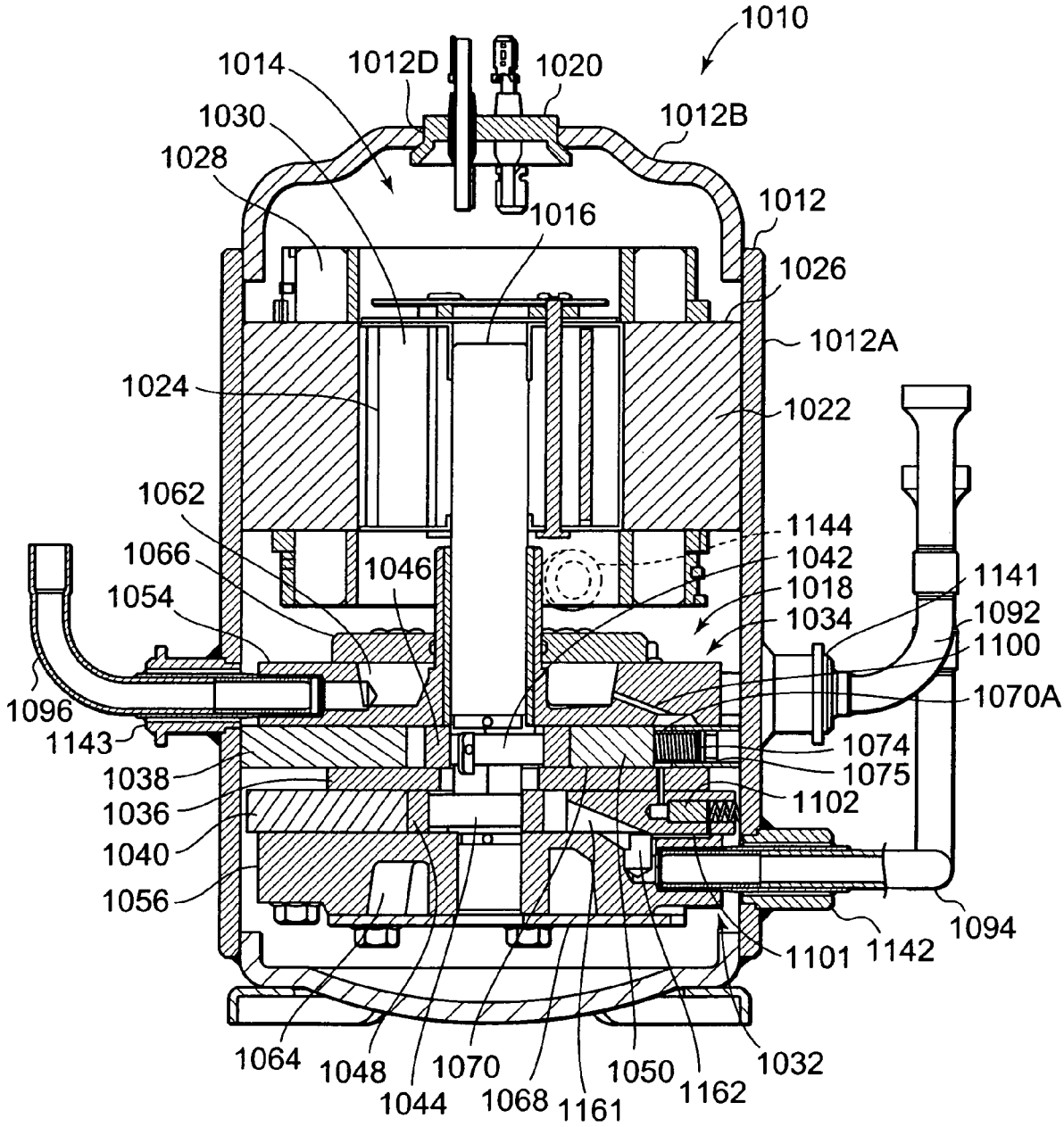
FIG. 15 is a vertical side view of a multistage compression type rotary compressor of a fifth embodiment to which the present invention is applied (Embodiment 5)
Figure 16:
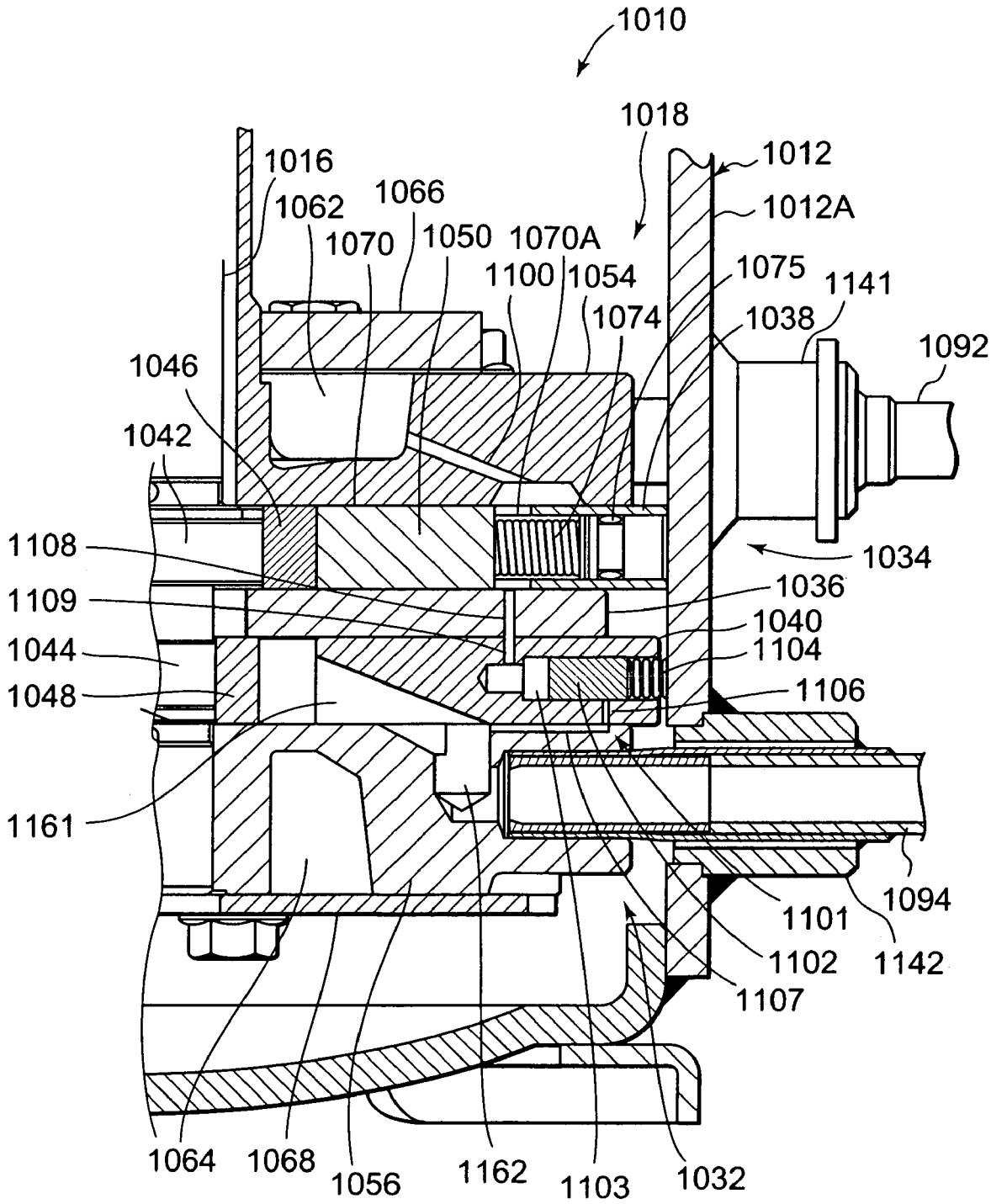
FIG. 16 is an enlarged vertical side view of an upper vane portion of a second rotary compression element in the multistage compression type rotary compressor of FIG. 15.
Figure 17:
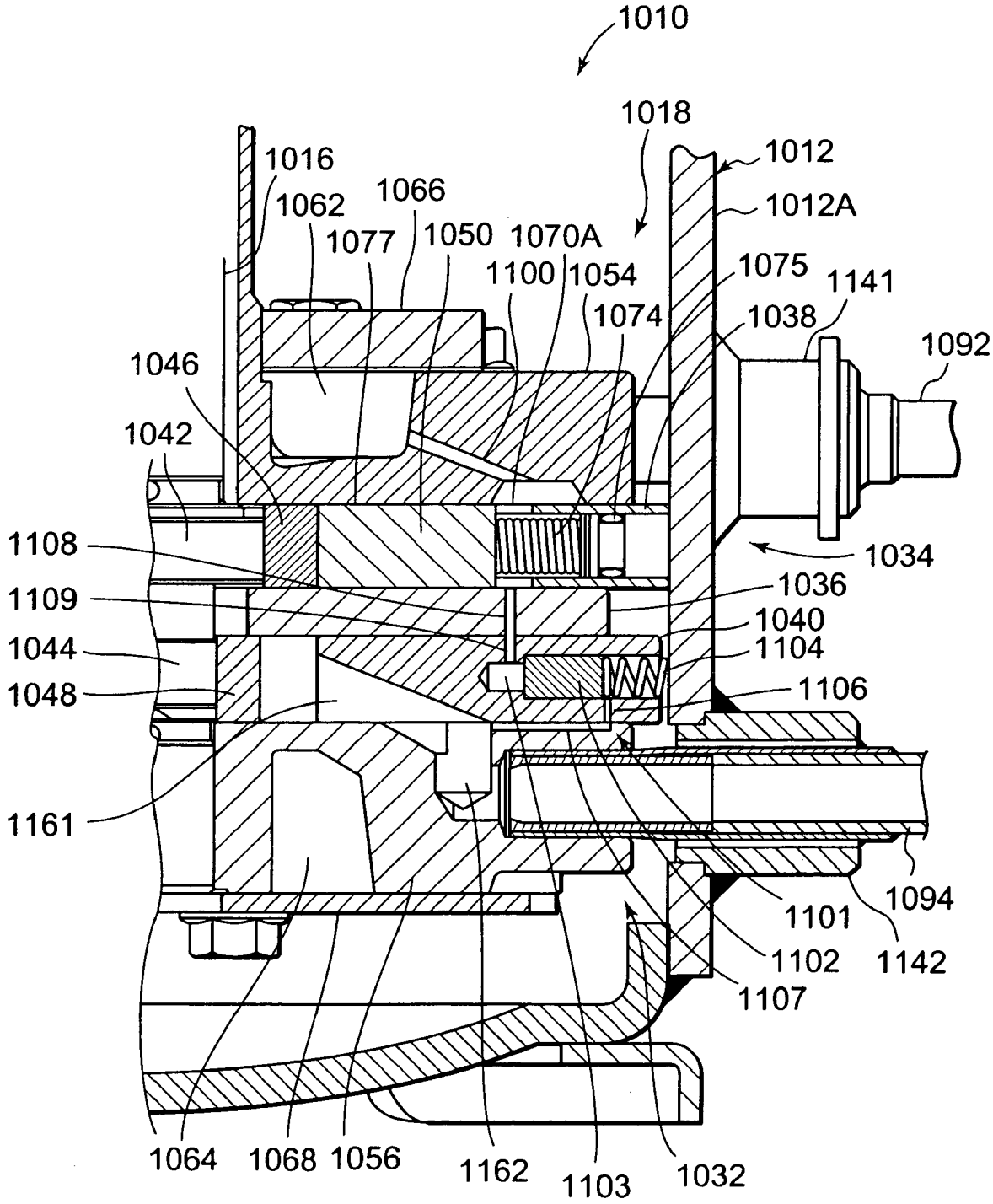
FIG. 17 is similarly an enlarged vertical side view of the upper vane portion of the second rotary compression element in the multistage compression type rotary compressor of FIG. 15.

FIG. 15 is a vertical side view of an intermediate inner pressure type multistage (two stages) compression rotary compressor 1010 including first and second rotary compression elements 1032, 1034 as an embodiment of a multistage compression type rotary compressor of the present invention. FIGS. 16 and 17 are enlarged vertical side views showing an upper vane 1050 portion of the second rotary compression element 1034 of the rotary compressor 1010 of FIG. 15.

In the drawings, the rotary compressor 1010 of the embodiment is the intermediate inner pressure type multistage compression rotary compressor which sucks, in the second rotary compression element 1034, an intermediate pressure refrigerant gas compressed by the first rotary compression element 1032 and discharged into a sealed vessel 1012, compresses and discharges the refrigerant gas. The rotary compressor 1010 includes, in the sealed vessel 1012, an electromotive element 1014 as a driving element and a rotary compression mechanism section 1018 constituted of the first rotary compression element 1032 and the second rotary compression element 1034 which are driven by this electromotive element 1014.

The sealed vessel 1012 is constituted of a vessel main body 1012A including a bottom portion as an oil reservoir and containing the electromotive element 1014 and the rotary compression mechanism section 1018; and a substantially bowl-like end cap (a lid member) 1012B which blocks an upper opening of this vessel main body 1012A. A circular attachment hole 1012D is formed in an upper surface of this end cap 1012B, and a terminal (a wiring line is omitted) 1020 for supplying a power to the electromotive element 1014 is attached to this attachment hole 1012D.

The electromotive element 1014 is constituted of an annular stator 1022 welded and fixed along an inner peripheral surface of the sealed vessel 1012; and a rotor 1024 inserted into the element and disposed at a slight interval from an inner periphery of this stator 1022. This rotor 1024 is fixed to a rotary shaft 1016 extending through the center of the element in a vertical direction.

The stator 1022 has a laminated article 1026 constituted by laminating donut-like electromagnetic steel plates; and a stator coil 1028 wound around teeth portions of this laminated article 1026 by a direct winding (concentrated winding) system. Moreover, the rotor 1024 is formed of a laminated article 1030 constituted of electromagnetic steel plates in the same manner as in the stator 1022.

Moreover, the rotary compression mechanism section 1018 is constituted of the first rotary compression element 1032; the second rotary compression element 1034; and an intermediate partition plate 1036 sandwiched between both of the rotary compression elements 1032 and 1034. In the present embodiment, the first rotary compression element 1032 is disposed below the intermediate partition plate 1036, and the second rotary compression element 1034 is disposed above the intermediate partition plate 1036. The first rotary compression element 1032 includes the lower cylinder 1040 disposed on a lower surface of the intermediate partition plate 1036; a lower roller 1048 which is fitted into an eccentric portion 1044 formed on the rotary shaft 1016 of the electromotive element 1014 to eccentrically rotate in the lower cylinder 1040; a lower vane (not shown) which abuts on this lower roller 1048 to divide the inside of the lower cylinder 1040 into a low pressure chamber and a high pressure chamber; and a lower support member 1056 which blocks a lower open surface of the lower cylinder 1040 and which also serves as a bearing of the rotary shaft 1016. Here, the low pressure chamber in the lower cylinder 1040 is a space surrounded with the lower vane, the lower roller 1048 and the lower cylinder 1040, and is a region where a suction port 1161 is present. The high pressure chamber is a space surrounded with the lower vane, the lower roller 1948 and the lower cylinder 1040, and is a region where a discharge port (not shown) is present.

Furthermore, the second rotary compression element 1034 includes an upper cylinder 1038 which is disposed on an upper surface of an intermediate partition plate 1036 and which is a cylinder constituting the second rotary compression element 1034; an upper roller 1046 which is fitted into an eccentric portion 1042 formed on the rotary shaft 1016 of the electromotive element 1014 to eccentrically rotate in the upper cylinder 1038; the upper vane 1050 which abuts on the upper roller 1046 to divide the inside of the upper cylinder 1038 into a low pressure chamber and a high pressure chamber; and an upper support member 1054 which blocks an upper open surface of the upper cylinder 1038 and which also serves as a bearing of the rotary shaft 1016. The eccentric portion 1044 of the first rotary compression element 1032 and the eccentric portion 1042 of the second rotary compression element 1034 are disposed with a phase difference of 180 degrees in the cylinders 1038 and 1040, respectively. It is to be noted that the low pressure chamber of the upper cylinder 1038 is a space surrounded with the upper vane 1050, the upper roller 1046 and the upper cylinder 1038, and is a region where a suction port (not shown) is present. The high pressure chamber is a space surrounded with the upper vane 1050, the upper roller 1046 and the upper cylinder 1038, and is a region where a discharge port (not shown) is present.

In the upper and lower cylinders 1038, 1040, guide grooves 1070 (the only guide groove of the upper vane 1050 is shown) to store the upper vane 1050 and the lower vane are formed, respectively. A back pressure chamber 1070A as a storage portion to store a spring 1074 as a spring member is formed on a back surface of the upper vane 1050. This spring 1074 abuts on a back surface end portion of the vane 1050 and constantly urges the vane 1050 toward the roller 1046. Moreover, the back pressure chamber 1070A opens on a guide groove 1070 side and a sealed vessel 1012 side (a vessel main body 1012A side). A plug 1075 is disposed on the spring 1074 stored in the back pressure chamber 1070A on the sealed vessel 1012 side, and has a function of preventing the spring 1074 from being detached (this also applies to the lower vane). An O-ring (not shown) for sealing between the plug 1075 and an inner surface of the back pressure chamber 1070A is attached to a peripheral surface of the plug 1075 of the spring 1074 to achieve a constitution in which a pressure in the sealed vessel 1012 does not flow into the back pressure chamber 1070A.

Moreover, the back pressure chamber 1070A communicates with a discharge muffling chamber 1062 described later via a communication path 1100 formed in the upper support member 1054, and a high pressure PH (a discharge side pressure of a refrigerant gas of the second rotary compression element 1034, the gas being compressed by the second rotary compression element 1034 and discharged to the discharge muffling chamber 1062) which is a discharge pressure of the second rotary compression element 1034 is supplied to the back pressure chamber 1070A. That is, the high pressure which is the discharge side pressure of the second rotary compression element 1034 is applied as a back pressure to the upper vane 1050 of the second rotary compression element 1034.

It is to be noted that a peripheral surface of the plug of the spring of the lower vane is not sealed. In consequence, an intermediate pressure PM in the sealed vessel 1012 (a pressure of the gas compressed by the first rotary compression element 1032 and discharged into the sealed vessel 1012) is supplied to the back pressure chamber of the lower vane. That is, the intermediate pressure which is the discharge pressure of the first rotary compression element 1032 is applied as the back pressure to the lower vane of the first rotary compression element 1032.

The upper and lower support members 1054, 1056 include suction passages 1162 (the suction passage for the lower support member 1056 and the lower cylinder 1040 only is shown) which communicate with the upper and lower cylinders 1038, 1040 via the suction ports 1161 formed in the upper and lower cylinders 1038, 1040. The upper support member 1054 is provided with the discharge muffling chamber 1062 formed by depressing a part of the surface (the upper surface) of the member opposite to the surface of the member which abuts on the upper cylinder 1038, and blocking this depressed concave portion with an upper cover 1066.

A discharge valve 1127 (shown in FIG. 18 of Embodiment 6 described later) which openably blocks the discharge port of the upper cylinder 1038 is disposed on a lower surface of the discharge muffling chamber 1062. Moreover, the refrigerant gas compressed in the upper cylinder 1038 to reach a predetermined pressure pushes up, from below in FIG. 15, the discharge valve 1127 which closes the discharge port to open the discharge port, and the gas is discharged into the discharge muffling chamber 1062. In a case where it is a time to end the discharge of the refrigerant gas, the discharge valve 1127 blocks the discharge port 39.

On the other hand, the lower support member 1056 is provided with a discharge muffling chamber 1064 formed by depressing a part of the surface (the lower surface) of the member opposite to the surface of the member which abuts on the lower cylinder 1040, and blocking this depressed concave portion with a lower cover 1068. A discharge valve is disposed on an upper surface of this discharge muffling chamber 1064 in the same manner as in the discharge muffling chamber 1062, and openably blocks the discharge port of the lower cylinder 1040. Furthermore, the refrigerant gas compressed in the lower cylinder 1040 to reach a predetermined pressure pushes down, from above in FIG. 15, the discharge valve which closes the discharge port to open the discharge port, and the gas is discharged to the discharge muffling chamber 1064. When it is a time to end the discharge of the refrigerant gas, the discharge valve blocks the discharge port.

The discharge muffling chamber 1064 of the first rotary compression element 1032 communicates with the sealed vessel 1012 via holes (not shown) which extend through the lower support member 1056, the lower cylinder 1040, the intermediate partition plate 1036, the upper cylinder 1038, the upper support member 1054 and the upper cover 1066. The intermediate pressure refrigerant gas compressed by the first rotary compression element 1032 and discharged to the discharge muffling chamber 1064 is discharged into a space (the space other than the electromotive element 1014 and the rotary compression mechanism section 1018 in the sealed vessel 1012) from these holes.

In addition, on a side surface of the vessel main body 1012A of the sealed vessel 1012, sleeves 1141, 1142, 1143 and 1144 are welded and fixed to positions corresponding to those of the suction passages 1162 (the passage of the only lower support member is shown) of the upper and lower support members 1054, 1056, the upper support member 1054 on a side opposite to the suction passage and a lower part of the rotor 1024 (right under the electromotive element 1014), respectively. The sleeve 1141 is slightly horizontally displaced from the sleeve 1142, and the sleeve 1143 is substantially disposed along a diagonal line of the sleeve 1141.

Moreover, one end of a refrigerant introducing tube 1092 for introducing the refrigerant gas into the upper cylinder 1038 is inserted into the sleeve 1141, and the one end of this refrigerant introducing tube 1092 is connected to the suction passage of the upper cylinder 1038. This refrigerant introducing tube 1092 extends from the sealed vessel 1012 to reach the sleeve 1144. The other end of the tube is inserted into the sleeve 1144 to communicate with the sealed vessel 1012.

Furthermore, one end of a refrigerant introducing tube 1094 for introducing the refrigerant gas into the lower cylinder 1040 is inserted into the sleeve 1142, and the one end of this refrigerant introducing tube 1094 communicates with the suction passage 1162 of the lower cylinder 1040. A path extending from this refrigerant introducing tube 1094 to the suction port 1161 via the suction passage 1162 is a refrigerant suction side of the first rotary compression element 1032. A refrigerant discharge tube 1096 is inserted into and connected to the sleeve 1143, and one end of this refrigerant discharge tube 1096 communicates with the discharge muffling chamber 1062.

Next, there will be described a communication path 1101 and a valve device 1102 with reference to FIG. 16. In the lower cylinder 1040 positioned below the back pressure chamber 1070A of the upper cylinder 1038, a valve storage chamber 1103 is formed, an inner end of this valve storage chamber 1103 is blocked before the suction port 1161, and an outer end thereof opens into the sealed vessel 1012. Moreover, the valve device 1102 is movably (movably in a radial direction of the lower cylinder 1040) stored in this suction port 1161, and a spring member 1104 (a weak spring) is interposed between one surface (an outer surface) of this valve device 1102 facing the inside of the sealed vessel 1012 and the vessel main body 1012A of the sealed vessel 1012. It is to be noted that this spring member 1104 constantly urges the valve device 1102 with a comparatively weak force so that the device moves toward the inside of the valve storage chamber 1103 (in an inner direction of the lower cylinder 1040). In consequence, the intermediate pressure of the sealed vessel 1012 and the urging force of the spring member 1104 are applied to one surface of the valve device 1102.

A first communication hole 1106 extending to a lower surface of the lower cylinder 1040 is formed in a bottom surface of the valve storage chamber 1103, and a communication groove 1107 is formed at a position of the upper surface of the lower support member 1056 corresponding to this communication hole 1106. This communication groove 1107 connects a lower end opening of the communication hole 1106 to the suction passage 1162 (on the refrigerant suction side of the first rotary compression element 1032. An upper end opening of the communication hole 1106 is constituted to be opened or closed by the valve device 1102 by movement of the valve device 1102. Moreover, these valve storage chamber 1103, communication hole 1106 and communication groove 1107 constitute the communication path 1101.

On the other hand, a second communication hole 1108 is formed to extend through the intermediate partition plate 1036 at a position corresponding to that of the back pressure chamber 1070A of the upper cylinder 1038. Furthermore, a third communication hole 1109 is formed in a position of the lower cylinder 1040 corresponding to a lower end opening of this communication hole 1108, and reaches an inner end portion of the valve storage chamber 1103. These communication holes 1108, 1109 connect the back pressure chamber 1070A to the inner end portion of the valve storage chamber 1103, and a high pressure which is a discharge side pressure of the second rotary compression element 1034 applied to the back pressure chamber 1070A is applied to the other surface (an inner surface) of the valve device 1102.

In addition, the valve device 1102 is constituted to open the communication path 1100 in a case where the intermediate pressure in the sealed vessel 1012 (the discharge pressure of the first rotary compression element 1032) reaches a predetermined upper limit value, and is not less than, for example, the high pressure which is the discharge pressure of the second rotary compression element 1034, or reaches a predetermined pressure before reaching the high pressure. Specifically, the valve device 1102 of the present embodiment is constituted to open the communication path 1101 in a case where the pressure (the intermediate pressure PM which is the discharge pressure of the first rotary compression element 1032) applied from the sealed vessel 1012 to one surface (the spring member 1104 side) is not less than a pressure (the high pressure PH) in the discharge muffling chamber 1062 of the second rotary compression element 1034 which is a pressure (a back pressure of the upper vane 1050) applied from the back pressure chamber 1070A to the other surface (an inner surface).

That is, when the intermediate pressure PM applied from the sealed vessel 1012 to one surface (the spring member 1104 side) is not less than the high pressure PH applied from the back pressure chamber 1070A to the other surface (an inner part), the pressure in the sealed vessel 1012 pushes inwards the valve device 1102 (toward the inner part) to move the outer end of the valve device 1102 from the upper end opening of the communication hole 1106 into the valve storage chamber 1103 (FIG. 17). In consequence, the space in the sealed vessel 1012 is connected to the suction passage 1162 via the communication path 1101 (the valve storage chamber 1103, the communication hole 1106 and the communication groove 1107), and the intermediate pressure refrigerant gas in the sealed vessel 1012 flows into the suction passage 1162 of the first rotary compression element 1032 (on the refrigerant suction side).

As described above, in a case where the intermediate pressure PM (the discharge pressure of the first rotary compression element 1032) applied from the sealed vessel 1012 to one surface (the spring member 1104 side) is not less than the high pressure PH (the pressure in the discharge muffling chamber 1062 of the second rotary compression element 1034) applied from the back pressure chamber 1070A to the other surface (the inner side), when the communication path 1101 is opened, the intermediate pressure refrigerant gas compressed by the first rotary compression element 1032 and the discharged into the sealed vessel 1012 can be released from the suction passage 1162 of the lower cylinder 1040 of the first rotary compression element 1032 to the suction port 1161.

Here, when the upper vane 1050 and the lower vane (not shown) of the upper and lower cylinders 1038, 1040 are viewed from above, the upper vane 1050 is disposed on the left side, and the lower vane is displaced toward the right side. The discharge port and the suction ports are formed adjacent to each other on opposite sides of the vane. In the present invention, when the upper cylinder 1038 is viewed from above, the suction port is formed on the right side of the upper vane 1050, and the discharge port is formed on the left side. When the lower cylinder 1040 is viewed from above, the suction port 1161 is formed on the left side of the lower vane, and the discharge port is formed on the right side.

Moreover, the back pressure chamber 1070A of the upper cylinder 1038, the valve storage chamber 1103 of the lower cylinder 1040 and the suction passage 1162 of the lower support member 1056 are arranged vertically (in an axial direction of the rotary shaft 1016 (FIG. 16). Moreover, the valve storage chamber 1103 is connected to the suction passage 1162 by the communication hole 1106 and the communication groove 1107 on the refrigerant suction side of the first rotary compression element 1032. Therefore, the communication holes 1108, 1109 and 1106 and the communication groove 1107 can connect the back pressure chamber 1070A to the valve storage chamber 1103 and connect the valve storage chamber 1103 to the suction passage 1162 with the shortest distances, respectively. The outer end of the valve storage chamber 1103 is opened into the sealed vessel 1012 to constitute the communication path 1101. In consequence, a structure for connecting the communication path 1101 in the rotary compression mechanism section 1018 or the back pressure chamber 1070A to the valve storage chamber 1103 is remarkably simplified. Therefore, it is possible to minimize a production cost for realizing a structure to release the pressure (the intermediate pressure) on the refrigerant discharge side of the first rotary compression element 1032 to the refrigerant suction side (the low pressure).

Next, there will be described an operation of the rotary compressor 1010 constituted as described above. When a power is supplied to the stator coil 1028 of the electromotive element 1014 via the terminal 1020 and the wiring line (not shown), the electromotive element 1014 starts to rotate the rotor 1024. When this rotor rotates, the upper and lower rollers 1046, 1048 are fitted into the upper and lower eccentric portions 1042, 1044 disposed integrally with the rotary shaft 1016 to eccentrically rotate in the upper and lower cylinders 1038, 1040.

In consequence, after the low pressure refrigerant is sucked in the low pressure chamber of the lower cylinder 1040 from the suction port 1161 via the refrigerant introducing tube 1094 and the suction passage 1162, the refrigerant is compressed by operations of the lower roller 1048 and the lower vane to reach the intermediate pressure. The discharge valve which closes the discharge port is then pushed to open the discharge port, and the intermediate pressure refrigerant gas is discharged into the discharge muffling chamber 1064.

The intermediate pressure refrigerant gas discharged into the discharge muffling chamber 1064 is discharged into the sealed vessel 1012 from the discharge muffling chamber 1064 via the holes (not shown). In consequence, the intermediate pressure (PM) which is the refrigerant discharge side pressure of the first rotary compression element 1032 is achieved in the sealed vessel 1012. At this time, when the intermediate pressure PM of the sealed vessel 1012 is lower than the high pressure PH of the refrigerant compressed by the second rotary compression element 1034 and supplied to the back pressure chamber 1070A via the discharge muffling chamber 1062, as shown in FIG. 16, the valve device 1102 is pushed by the high pressure of the refrigerant in the back pressure chamber 1070A, and positioned on the communication hole 1106. Therefore, since the upper end opening of the communication hole 1106 is closed by the valve device 1102 and the communication path 1101 is blocked, the refrigerant gas in the sealed vessel 1012 does not flow into the suction passage 1162.

The intermediate pressure refrigerant gas discharged into this sealed vessel 1012 exits from the sleeve 1144, and is sucked in the low pressure chamber of the upper cylinder 1038 from the suction port via the refrigerant introducing tube 1092 and the suction passage (not shown) formed in the cylinder 1038. The sucked intermediate pressure refrigerant gas is secondarily compressed by operations of the upper roller 1046 and the upper vane 1050 to constitute a high-temperature high-pressure refrigerant gas. In consequence, the discharge valve 1127 disposed in the discharge muffling chamber 1062 is opened, and the discharge muffling chamber 1062 communicates with the discharge port. Therefore, the gas is discharged from the high pressure chamber of the upper cylinder 1038 to the discharge muffling chamber 1062 formed in the upper support member 1054 through the discharge port. The high pressure refrigerant gas discharged to the discharge muffling chamber 1062 is discharged from the rotary compressor 1010 via the refrigerant discharge tube 1096.

On the other hand, when the pressure (the intermediate pressure PM) of the refrigerant discharged into the sealed vessel 1012 is not less than the high pressure PH of the refrigerant compressed by the second rotary compression element 1034 and supplied into the back pressure chamber 1070A via the discharge muffling chamber 1062, as shown in FIG. 17, the valve device 1102 is pushed inwards by the pressure applied from the sealed vessel 1012 to one surface, and the outer end of the device moves from the communication hole 1106 into the valve storage chamber 1103 (inwards). In consequence, since the upper end opening of the communication hole 1106 is opened, the communication path 1101 is opened, and the sealed vessel 1012 is connected to the suction passage 1162. In consequence, the refrigerant gas in the sealed vessel 1012 flows into the suction passage 1162 of the lower cylinder 1040 (on the refrigerant suction side) via the valve storage chamber 1103, the communication hole 1106 and the communication groove 1107. That is, a part of the intermediate pressure refrigerant gas compressed by the first rotary compression element 1032 and discharged into the sealed vessel 1012 can be released through the suction passage 1162 of the first rotary compression element 1032 to a suction step region in the lower cylinder 1040.

In consequence, the intermediate pressure refrigerant gas compressed by the first rotary compression element 1032 and sucked in the second rotary compression element 1034 is discharged to the discharge muffling chamber 1062 of the second rotary compression element 1034. The pressure of the refrigerant gas is not more than that of the refrigerant gas supplied as the back pressure of the upper vane 1050 to the back pressure chamber 1070A. Therefore, there is eliminated pressure reversal in the inner end of the upper vane 1050 (in the upper cylinder 1038) and the outer end (the back pressure). It is to be noted that when the pressure of the intermediate pressure refrigerant gas in the sealed vessel 1012 drops below the pressure of the refrigerant gas of the back pressure chamber 1070A, as shown in FIG. 16, the valve device 1102 moves outwards to block the upper end opening of the communication hole 1106. Therefore, the communication path 1101 is blocked.

As described above, when the pressure of the refrigerant discharged into the sealed vessel 1012 is not less than the high pressure of the refrigerant compressed by the second rotary compression element 1034 and supplied to the back pressure chamber 1070A through the discharge muffling chamber 1062, the communication path 1101 is opened as described above. The refrigerant gas in the sealed vessel 1012 can be released to the suction passage 1162 of the first rotary compression element 1032. Therefore, the pressure (the intermediate pressure PM) of the first rotary compression element 1032 on the refrigerant discharge side becomes lower than the pressure (the high pressure PH) of the second rotary compression element 1034 on the refrigerant discharge side. It is possible to eliminate reversal of the pressure of the refrigerant gas compressed by the first rotary compression element 1032 (the pressure of the inner end of the upper vane 1050) and the pressure of the refrigerant gas compressed by the second rotary compression element 1034 (the back pressure of the upper vane 1050).

In consequence, it is possible to eliminate at an early stage vane fly and unstable operation situation of the upper vane 1050 of the second rotary compression element 1034. Since complication of a structure of the rotary compression mechanism section 1018 can be minimized, rise of a production cost can be suppressed. That is, such a pressure reverse preventive structure is simplified, and the production cost can be reduced.

As described above, it is possible to eliminate a disadvantage that the second rotary compression element 1034 comes into the unstable operation situation, and a stabilized operation of the multistage compression type rotary compressor 1010 can be realized.

It is to be noted that when the rotary compressor 1010 stops, the valve device 1102 is quickly pressed into the valve storage chamber 1103 by the spring member 1104 as shown in FIG. 17. Therefore, the communication path 1101 is opened. In consequence, after the stop of the rotary compressor 1010, the pressure reversal of the whole refrigerant circuit can quickly be restored. Therefore, since during the next start the pressure reversal does not occur, the fly of the upper vane 1050 can be avoided from the start. Moreover, in the above embodiment, the spring member 1104 of the valve device 1102 is constituted of the weak spring. When the pressure applied from the sealed vessel 1012 to one surface (the spring member 1104 side) is not less than the pressure (the pressure in the discharge muffling chamber 1062 of the second rotary compression element 1034) applied from the back pressure chamber 1070A to the other surface (the inner side of the valve storage chamber 1103), the communication path 1101 is opened. However, the present invention is not limited to this embodiment. The spring member 1104 may be constituted of a usual spring. When the pressure applied from the sealed vessel 1012 to one surface reaches the predetermined upper limit value, for example, the predetermined upper limit value (e.g., the pressure immediately before reaching the high pressure PH) before reaching the pressure applied from the back pressure chamber 1070A to the other surface, the communication path 1101 may be connected.

In this case, the pressure of the refrigerant gas in the sealed vessel 1012 can constantly be set to be lower than that of the refrigerant gas supplied to the back pressure chamber 1070A through the discharge muffling chamber 1064 of the second rotary compression element 1034. Therefore, it is possible to secure the back pressure of the upper vane 1050 of the second rotary compression element 1034. That is, the pressure in the upper cylinder 1038 can constantly be set to be not more than the pressure of the back pressure chamber 1070A of the upper vane 1050. It is therefore possible to avoid beforehand a disadvantage that the vane fly of the upper vane 1050 occurs owing to such a high pressure PH which is the discharge side pressure of the second rotary compression element 1034 applied to the back pressure chamber 1070A and the urging force of the spring 1074. The stabilized operation situation of the second rotary compression element 1034 can be secured.

Embodiment 6

Figure 18:
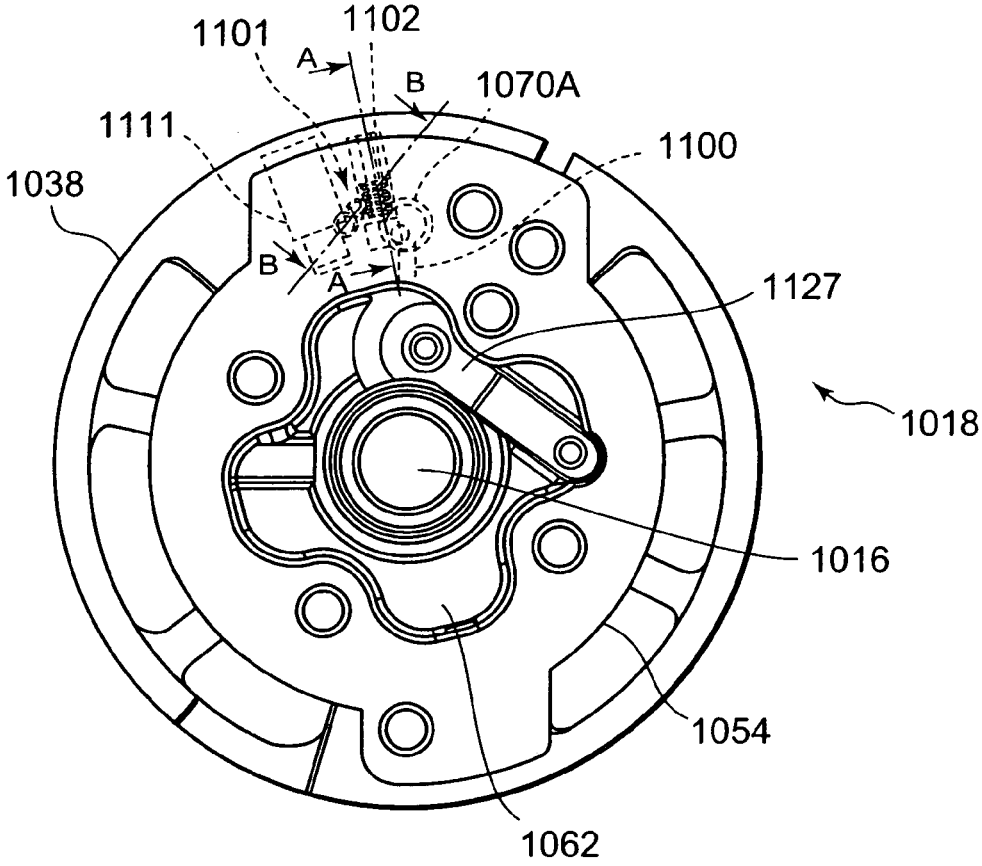
FIG. 18 is a plan view of a rotary compression mechanism section in a multistage compression type rotary compressor of a sixth embodiment to which the present invention is applied (Embodiment 6)
Figure 19:
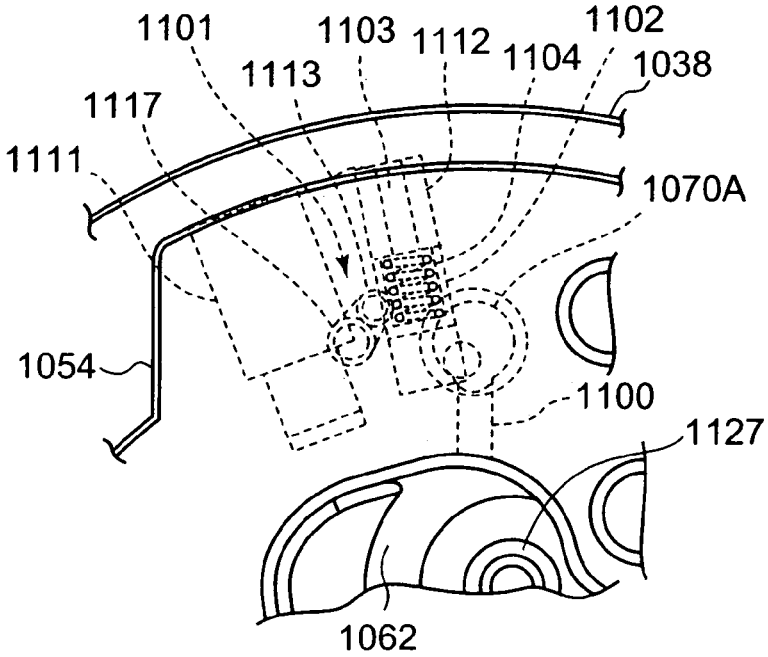
FIG. 19 is an enlarged view of a valve storage chamber portion in the rotary compression mechanism section of FIG. 18.
Figure 20:
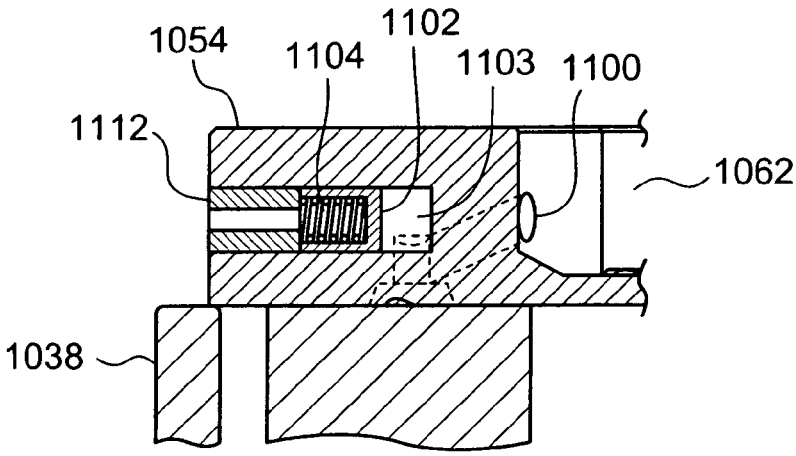
FIG. 20 is an enlarged vertical side view of the valve storage chamber portion of FIG. 18.
Figure 21:
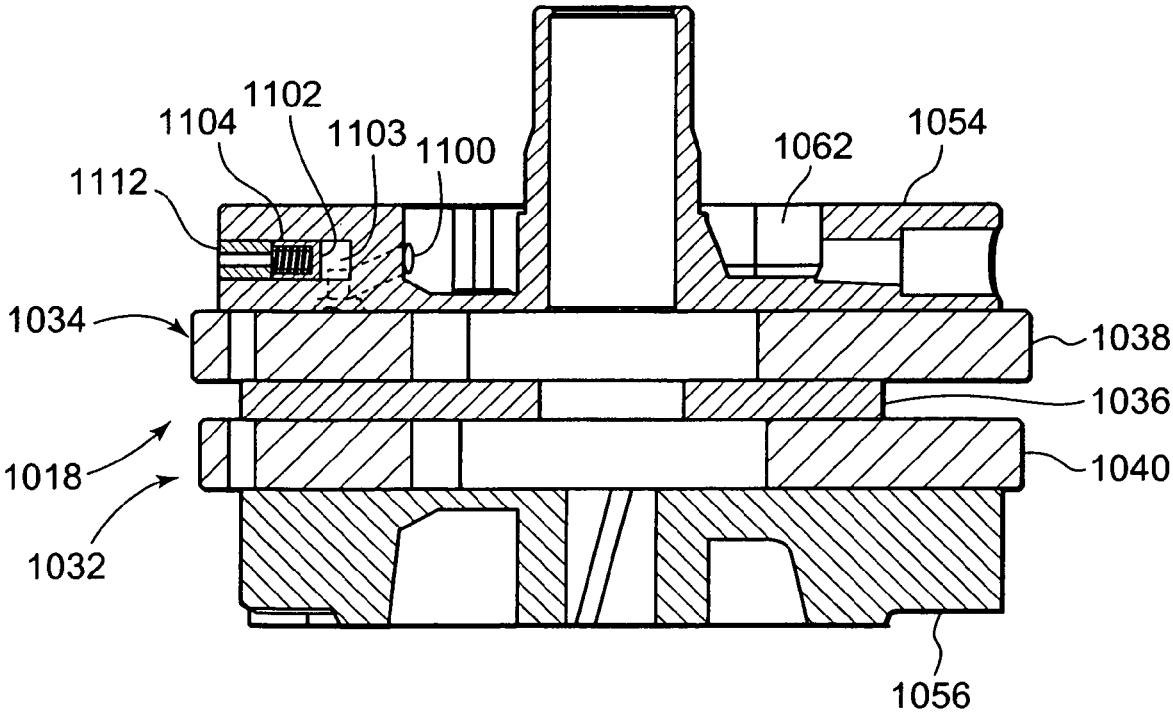
FIG. 21 is a sectional view cut along the A-A line of FIG. 18.
Figure 22:
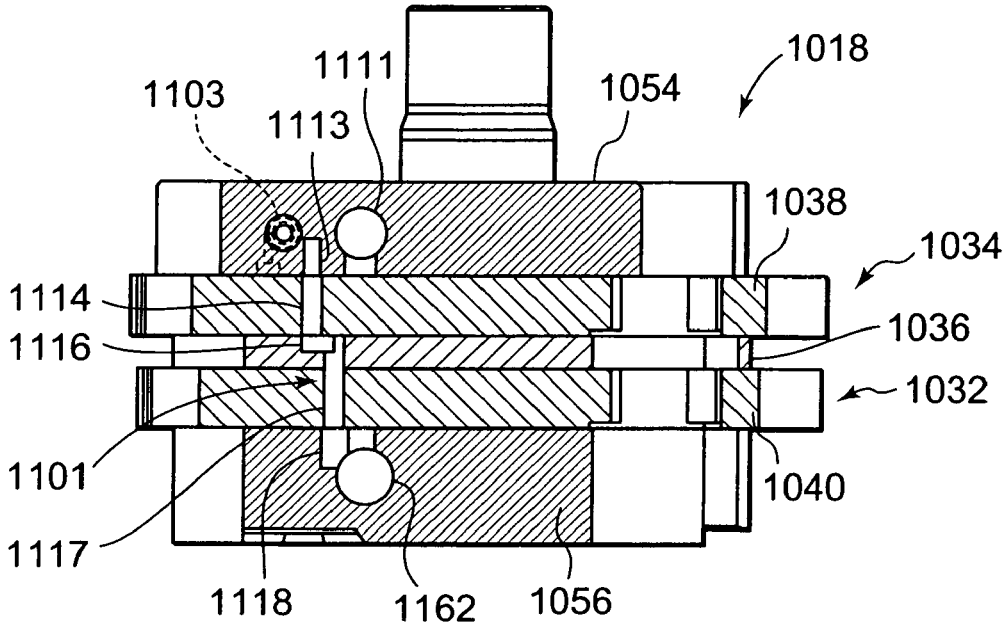
FIG. 22 is a sectional view cut along the B-B line of FIG. 18.
Figure 23:
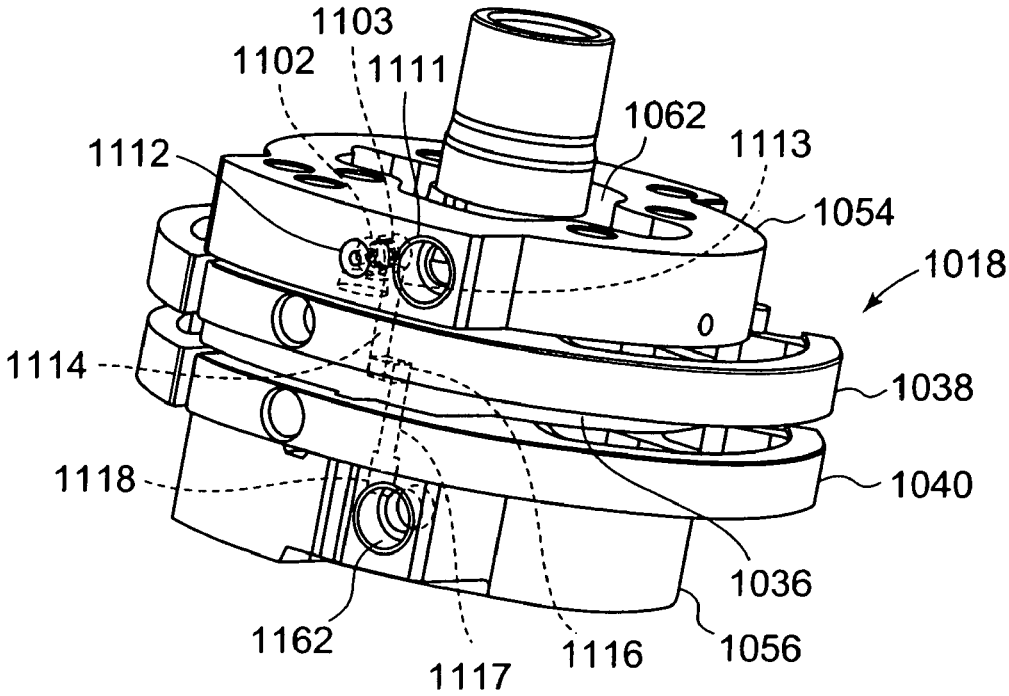
FIG. 23 is a perspective view of the rotary compression mechanism section of FIG. 18.

Next, a sixth embodiment of the present invention will be described with reference to FIGS. 18 to 23. It is to be noted that in the drawings, components denoted with the same reference numerals as those of FIGS. 15 to 17 perform similar functions. It is assumed that components which are not shown in the drawings are similar to those of FIGS. 15 to 17. FIG. 18 is a plan view of a rotary compression mechanism section 1018 in this case; FIG. 19 is an enlarged view of a valve storage chamber 1103 part of the rotary compression mechanism section 1018 of FIG. 18; FIG. 20 is an enlarged vertical side view of the valve storage chamber 1103 part of FIG. 18; FIG. 21 is a sectional view cut along the A-A line of FIG. 18; FIG. 22 is a sectional view cut along the B-B line of FIG. 18; and FIG. 23 is a perspective view of the rotary compression mechanism section 1018 of FIG. 18.

In the drawings, 1111 is a suction passage of a second rotary compression element 1034 formed in an upper support member 1054. In this embodiment, upper and lower vanes are vertically arranged in corresponding positions. As viewed from above the vanes, on the right side a suction port, the suction passage 1111 and a suction passage 1162 are vertically arranged in an axial direction of a rotary shaft 1016.

In this case, the valve storage chamber 1103 is formed adjacent to the suction passage 1111 of a communication path 1100 in an upper support member 1054, and an inner corner portion of this valve storage chamber communicates with a communication portion between the communication path 1100 and a back pressure chamber 1070A. The valve device 1102 is similarly movably in the valve storage chamber 1103 (movably in a radius direction of the upper support member 1054). An outer end of the valve storage chamber 1103 opens in a space of the sealed vessel 1012, and a valve seat 1112 is attached to an inner side of the outer end opening of the chamber. A spring member 1104 is interposed between this valve seat 1112 and one surface of the valve device 1102 (the surface on a valve seat 1112 side). This spring member 1104 constantly urges the valve device 1102 inwards, that is, so as to detach the valve device from the valve seat 1112.

In such a constitution, a pressure in the sealed vessel 1012 (an intermediate pressure PM) is applied to one surface of the valve device 1102, and a pressure (a high pressure PH) in the back pressure chamber 1070A is applied to the other surface (the surface on a communication path 1100 side).

Moreover, a communication hole 1113 is vertically formed in the upper support member 1054, and upper end of this communication hole 1113 opens in the valve storage chamber 1103 in the vicinity of the valve seat 1112. Moreover, communication holes 1114, 1116 and 1117 are formed in an upper cylinder 1038, an intermediate partition plate 1036 and a lower cylinder 1040 to vertically extend through them, respectively. An upper end of the communication hole 1114 corresponds to and communicates with a lower end of the communication hole 1113. An upper end of the communication hole 1116 corresponds to and communicates with a lower end of the communication hole 1114. An upper end of the communication hole 1117 corresponds to and communicates with a lower end of the communication hole 1116. Moreover, a communication hole 1118 is formed in the vicinity of the suction passage 1162 of a lower support member 1056, a lower end of the hole communicates with the suction passage 1162, and an upper end thereof corresponds to and communicates with a lower end of the communication hole 1117. These valve storage chamber 1103 and communication holes 1113, 1114, 1116, 1117 and 1118 constitute a communication path 1101 in this case.

In the above constitution, when the intermediate pressure PM of the sealed vessel 1012 is lower than the high pressure PH of a refrigerant compressed by the second rotary compression element 1034 and supplied to the back pressure chamber 1070A through a discharge muffling chamber 1062 and the communication path 1100, as shown in FIGS. 20, 21, the valve device 1102 is pushed by the high pressure of the refrigerant in the back pressure chamber 1070A and pressed onto the valve seat 1112 to close the upper end opening of the communication hole 1113. Therefore, since the communication path 1101 is brought into a blocked state, the refrigerant gas in the sealed vessel 1012 does not flow into the suction passage 1162.

On the other hand, when the pressure (the intermediate pressure PM) of the refrigerant discharged into the sealed vessel 1012 is not less than the high pressure PH of the refrigerant compressed by the second rotary compression element 1034 and supplied into the back pressure chamber 1070A through the discharge muffling chamber 1062 and the communication path 1100, the valve device 1102 detaches from the valve seat 1112 and is pressed inwards (the communication path 1100 side) by the pressure applied from the sealed vessel 1012 to one surface of the valve device 1102. The outer end of the valve device moves from the upper end opening of the communication hole 1113 into the valve storage chamber 1103 (inwards). In consequence, since the upper end opening of the communication hole 1113 is opened, the communication path 1101 is opened to connect the sealed vessel 1012 to the suction passage 1162. In consequence, the refrigerant gas in the sealed vessel 1012 flows into the suction passage 1162 of the lower cylinder 1040 (on a refrigerant suction side) via the communication holes 1113, 1114, 1116, 1117 and 1118. That is, a part of the intermediate pressure refrigerant gas compressed by the first rotary compression element 1032 and discharged into the sealed vessel 1012 escapes to a suction step region in the lower cylinder 1040 via the suction passage 1162 of the first rotary compression element 1032.

In consequence, it is possible to eliminate a pressure reverse phenomenon and avoid generation of fly of the upper vane 1050 in the same manner as in Embodiment 5 described above. Especially in this case, the valve device 1102 is not stored in the cylinder, and is stored in the upper support member 1054. Therefore, a restriction on a processing precision is relaxed. Furthermore, since the pressure can be applied to the opposite surfaces of the valve device 1102 at positions remarkably close to both of the back pressure chamber 1070A and the sealed vessel 1012, there is an effect that a precision of an open/close control of the communication path 1101 improves.

It is to be noted that in Embodiments 5 and 6 described above, as the rotary compressor 1010, the two-stage compression type rotary compressor has been described, but the present invention may be applied to a rotary compressor including three or more stages of rotary compression elements.

Embodiment 7

Figure 24:
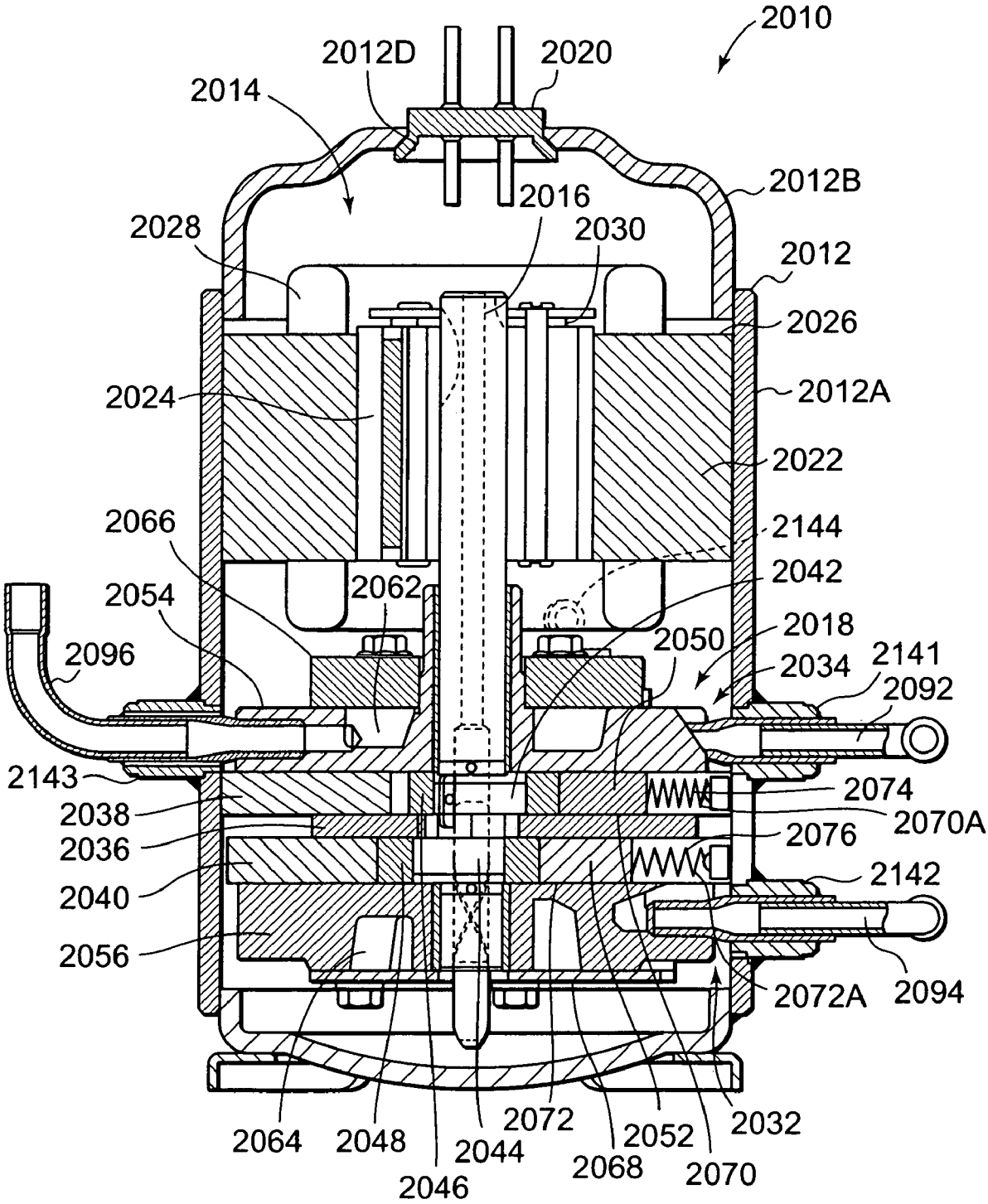
FIG. 24 is a vertical side view of a multistage compression type rotary compressor of a seventh embodiment to which the present invention is applied (Embodiment 7)
Figure 25:
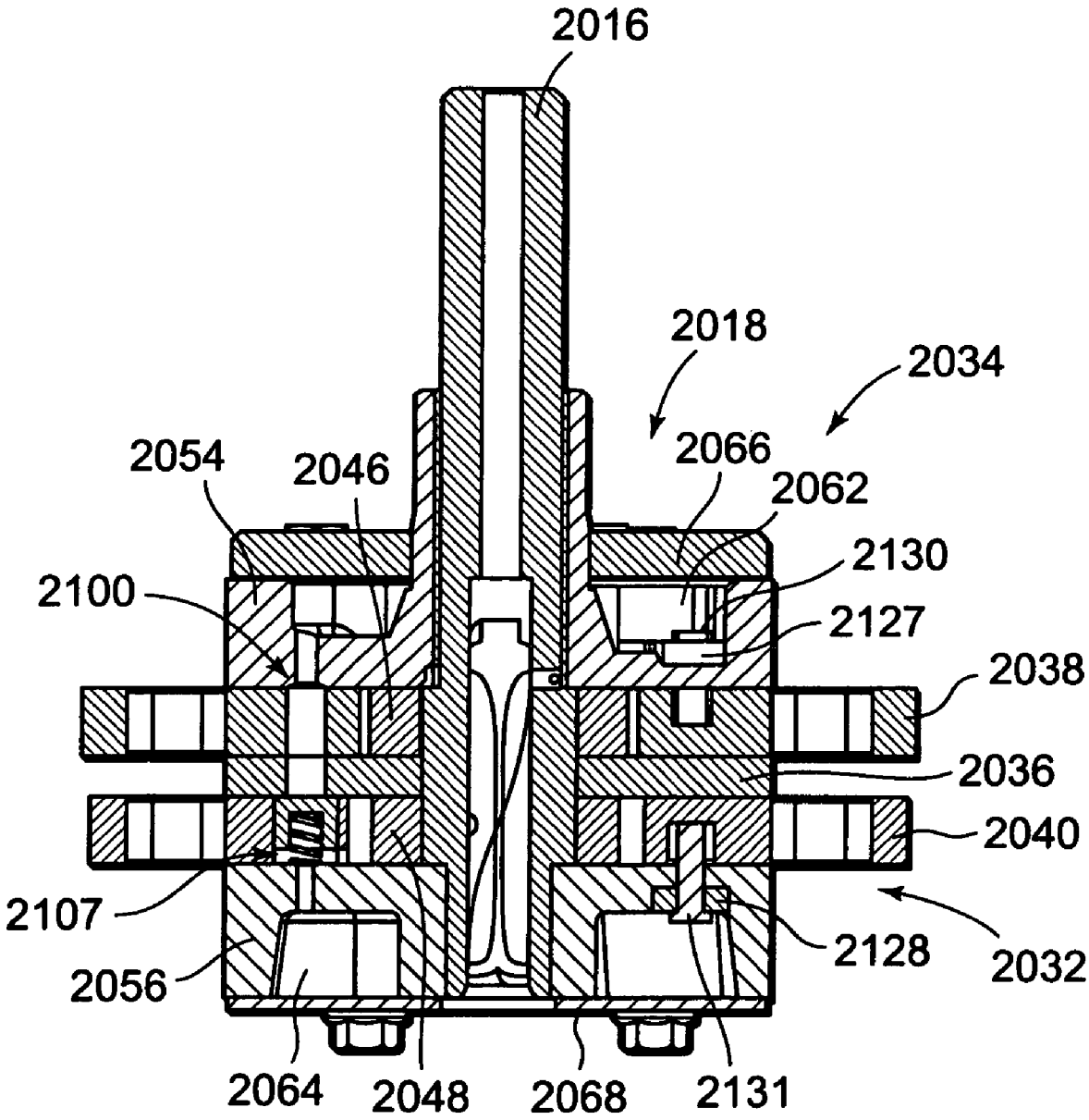
FIG. 25 is a vertical side view of the multistage compression type rotary compressor of FIG. 24.
Figure 26:
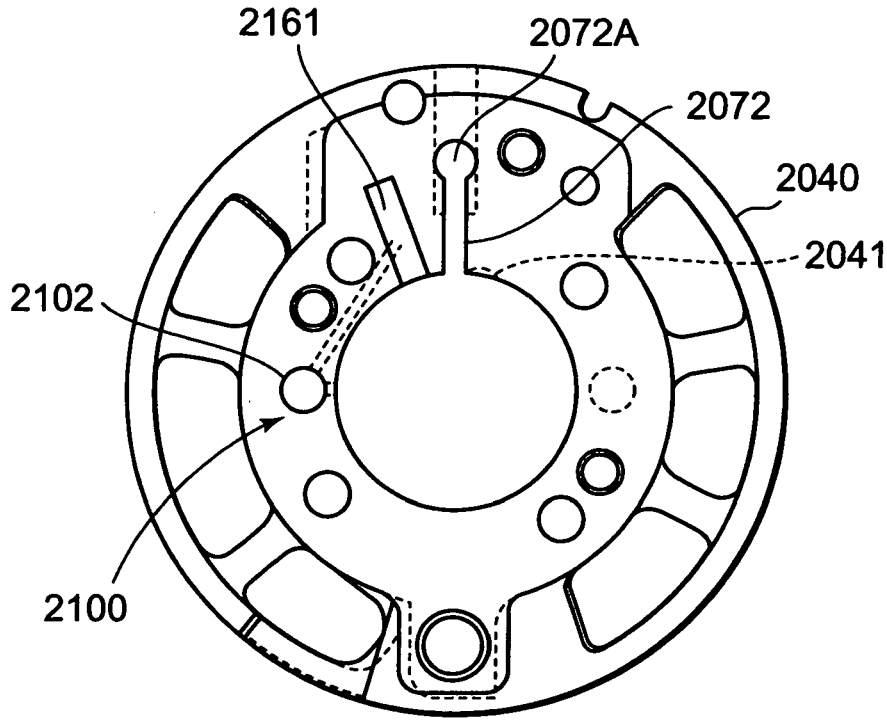
FIG. 26 is a plan view of a cylinder of a first rotary compression element in the multistage compression type rotary compressor of FIG. 24.
Figure 27:
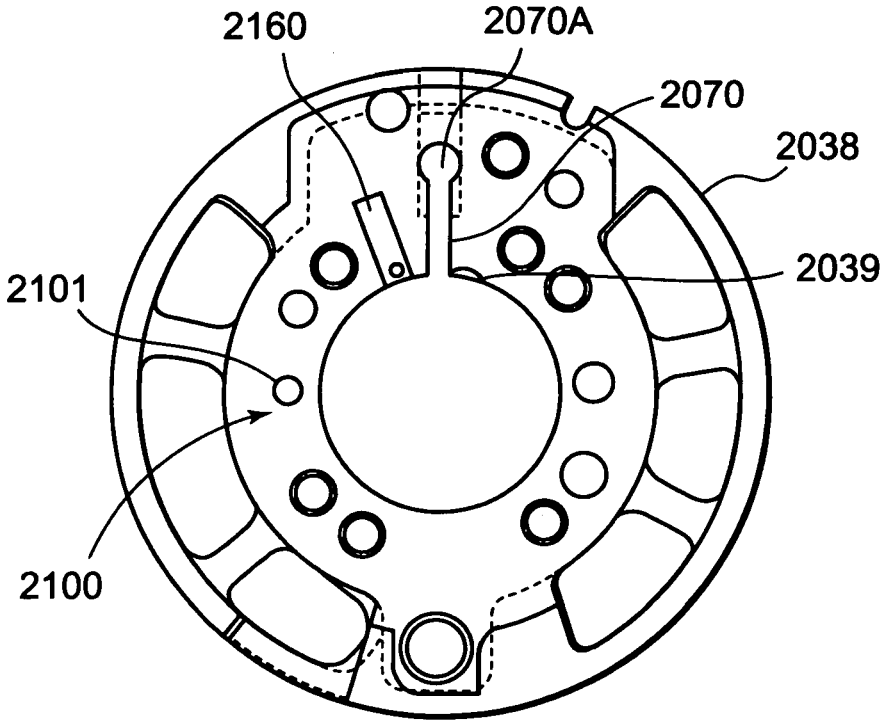
FIG. 27 is a plan view of a cylinder of a second rotary compression element in the multistage compression type rotary compressor of FIG. 24.
Figure 28:
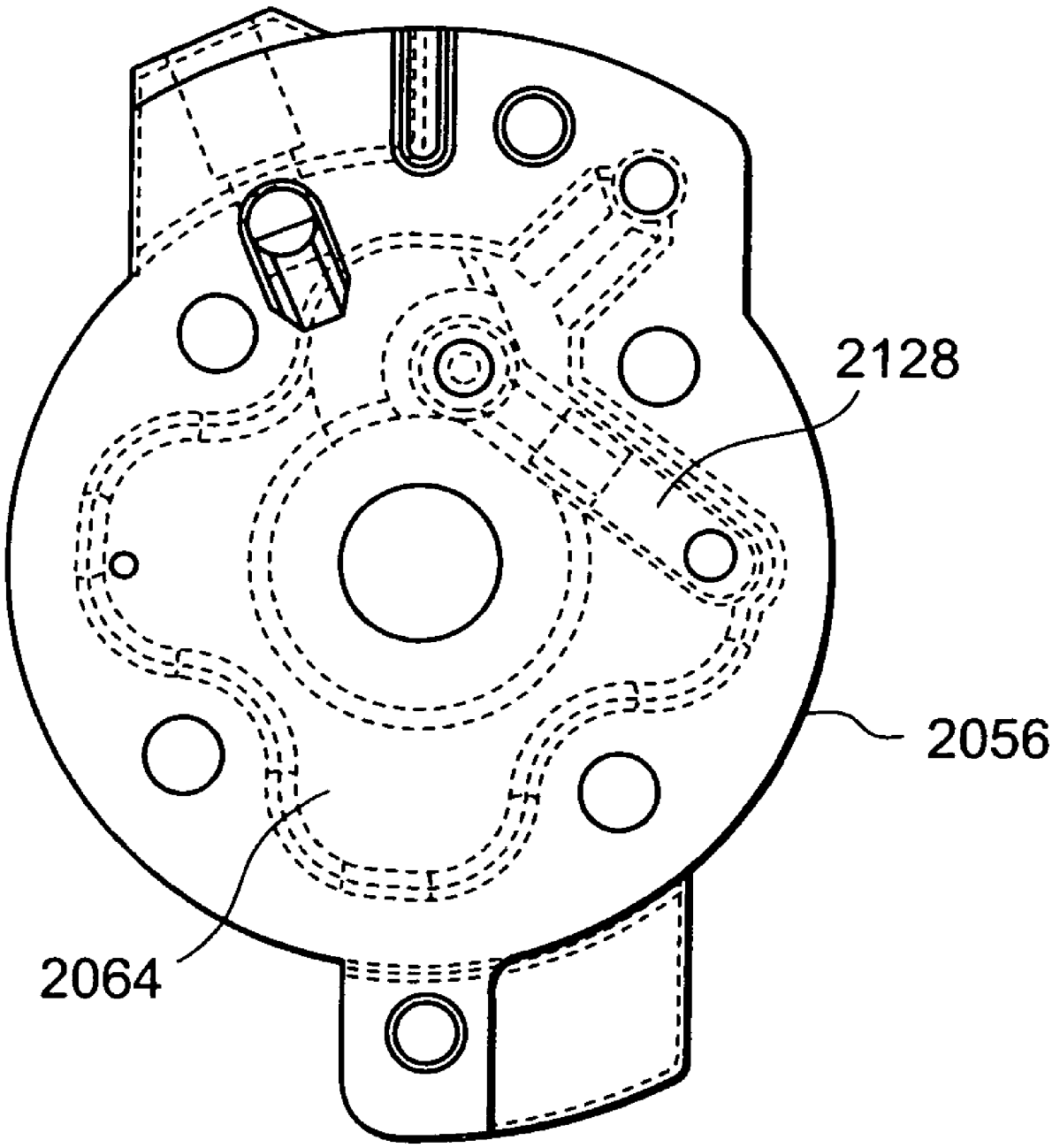
FIG. 28 is a plan view of a lower support member of the first rotary compression element in the multistage compression type rotary compressor of FIG. 24.

Next, FIG. 24 is a vertical side view of an intermediate inner pressure type multistage (two stages) compression rotary compressor 2010 including first and second rotary compression elements 2032, 2034 as a seventh embodiment of a multistage compression type rotary compressor of the present invention; FIG. 25 is a vertical sectional view (a section is different from that of FIG. 24) of a rotary shaft 2016 and a rotary compression mechanism section 2018 of the rotary compressor 2010 of FIG. 24; FIG. 26 is a plan view of a lower cylinder 2040 of the first rotary compression element 2032 of the rotary compression mechanism section 2018; FIG. 27 is a plan view of an upper cylinder 2038 constituting the second rotary compression element 2034 of the rotary compression mechanism section 2018; and FIG. 28 is a plan view of a lower support member 2056 of the first rotary compression element 2032. In the drawings, the rotary compressor 2010 of the embodiment is the intermediate inner pressure type multistage compression rotary compressor which sucks, in the second rotary compression element, an intermediate pressure refrigerant gas compressed by the first rotary compression element 2032 and discharged into a sealed vessel 2012, compresses and discharges the refrigerant gas. The rotary compressor 2010 includes, in the sealed vessel 2012, an electromotive element 2014 as a driving element and the rotary compression mechanism section 2018 constituted of the first rotary compression element 2032 and the second rotary compression element 2034 which are driven by this electromotive element 2014.

The sealed vessel 2012 is constituted of a vessel main body 2012A including a bottom portion as an oil reservoir and containing the electromotive element 2014 and the rotary compression mechanism section 2018; and a substantially bowl-like end cap (a lid member) 2012B which blocks an upper opening of this vessel main body 2012A. A circular attachment hole 2012D is formed in an upper surface of this end cap 2012B, and a terminal (a wiring line is omitted) 2020 for supplying a power to the electromotive element 2014 is attached to this attachment hole 2012D.

The electromotive element 2014 is constituted of an annular stator 2022 welded and fixed along an inner peripheral surface of the sealed vessel 2012; and a rotor 2024 inserted into the element and disposed at a slight interval from an inner periphery of this stator 2022. This rotor 2024 is fixed to the rotary shaft 2016 extending through the center of the element in a vertical direction.

The stator 2022 has a laminated article 2026 constituted by laminating donut-like electromagnetic steel plates; and a stator coil 2028 wound around teeth portions of this laminated article 2026 by a direct winding (concentrated winding) system. Moreover, the rotor 2024 is formed of a laminated article 2030 constituted of electromagnetic steel plates in the same manner as in the stator 2022.

Moreover, the rotary compression mechanism section 2018 is constituted of the first rotary compression element 2032; the second rotary compression element 2034; and an intermediate partition plate 2036 sandwiched between both of the rotary compression elements 2032 and 2034. In the present embodiment, the first rotary compression element 2032 is disposed below the intermediate partition plate 2036, and the second rotary compression element 2034 is disposed above the intermediate partition plate 2036. The first rotary compression element 2032 includes the lower cylinder 2040 disposed on a lower surface of the intermediate partition plate 2036; a lower roller 2048 which is fitted into an eccentric portion 2044 formed on the rotary shaft 2016 of the electromotive element 2014 to eccentrically rotate in the lower cylinder 2040; a lower vane 2052 which abuts on the lower roller 2048 to divide the inside of the lower cylinder 2040 into a low pressure chamber side and a high pressure chamber side; and the lower support member 2056 which blocks a lower open surface of the lower cylinder 2040 and which also serves as a bearing of the rotary shaft 2016. Here, the low pressure chamber side in the lower cylinder 2040 is a space surrounded with the lower vane 2052, the lower roller 2048 and the lower cylinder 2040, and is a region where a suction port 2161 is present. The high pressure chamber side is a space surrounded with the lower vane 2052, the lower roller 2048 and the lower cylinder 2040, and is a region where a discharge port 2041 is present.

Furthermore, the second rotary compression element 2034 includes the upper cylinder 2038 which is disposed on an upper surface of the intermediate partition plate 2036 and which is a cylinder constituting the second rotary compression element 2034; an upper roller 2046 which is fitted into an eccentric portion 2042 formed on the rotary shaft 2016 of the electromotive element 2014 to eccentrically rotate in the upper cylinder 2038; an upper vane 2050 which abuts on the upper roller 2046 to divide the inside of the upper cylinder 2038 into a low pressure chamber side and a high pressure chamber side; and an upper support member 2054 which blocks an upper open surface of the upper cylinder 2038 and which also serves as a bearing of the rotary shaft 2016. The eccentric portion 2044 of the first rotary compression element 2032 and the eccentric portion 2042 of the second rotary compression element 2034 are disposed with a phase difference of 180 degrees in the cylinders 2038 and 2040, respectively. It is to be noted that the low pressure chamber side in the upper cylinder 2038 is a space surrounded with the upper vane 2050, the upper roller 2046 and the upper cylinder 2038, and is a region where a suction port 2160 is present. The high pressure chamber side is a space surrounded with the upper vane 2050, the upper roller 2046 and the upper cylinder 2038, and is a region where a discharge port 2039 is present.

In the upper and lower cylinders 2038, 2040, guide grooves 2070, 2072 to store the vanes 2050, 2052 are formed, and storage portions 2070A, 2072A (back pressure chambers) to store springs 2074, 2076 as spring members are formed on outer sides of the guide grooves 2070, 2072, that is, on back surface sides of the vanes 2050, 2052. The springs 2074, 2076 abut on back surface end portions of the vanes 2050, 2052, and constantly urge the vanes 2050, 2052 toward the rollers 2046, 2048. Moreover, the storage portion 2070A opens on a guide groove 2070 side and a sealed vessel 2012 side (a vessel main body 2012A side). Plugs (not shown) are disposed on the springs 2074, 2076 stored in the storage portions 2070A, 2072A on the sealed vessel 2012 side, and have functions of preventing the springs 2074, 2076 from being detached. An O-ring (not shown) for sealing between the plug and an inner surface of the storage portion 2070A is attached to a peripheral surface of the plug of the spring 2074 to achieve a constitution in which a pressure in the sealed vessel 2012 does not flow into the storage portion 2070A.

Moreover, the storage portion 2070A communicates with a discharge muffling chamber 2062 described later via a communication path (not shown), and a high pressure (a pressure of a refrigerant gas on a discharge side of the second rotary compression element 2034, the gas being compressed by the second rotary compression element 2034 and discharged to the discharge muffling chamber 2062) which is a discharge pressure of the second rotary compression element 2034 is applied to the storage portion 2070A. That is, the high pressure which is the discharge pressure of the second rotary compression element 2034 is applied as a back pressure to the upper vane 2050 of the second rotary compression element 2034.

On the other hand, a peripheral surface of the plug of the spring 2076 is not sealed. In consequence, an intermediate pressure in the sealed vessel 2012 (a pressure of the gas compressed by the first rotary compression element 2032 and discharged into the sealed vessel 2012) is applied to the storage portion 2072A. That is, the intermediate pressure which is the discharge side pressure of the first rotary compression element 2032 is applied as the back pressure to the lower vane 2052 of the first rotary compression element 2032.

The upper and lower support members 2054, 2056 include suction passages (not shown) which communicate with the upper and lower cylinders 2038, 2040 via the suction ports 2160, 2161, respectively. The upper support member 2054 is provided with the discharge muffling chamber 2062 formed by depressing a part of the surface of the member opposite to the surface of the member which abuts on the upper cylinder 2038, and blocking this depressed concave portion with a cover as a wall. That is, the discharge muffling chamber 2062 is blocked with an upper cover 2066 as the wall which defines the discharge muffling chamber 2062.

A discharge valve 2127 which openably blocks the discharge port 2039 is disposed on a lower surface of the discharge muffling chamber 2062. This discharge valve 2127 includes an elastic member constituted of a metal plate which is vertically long and substantially rectangular, and a backer valve (not shown) as a discharge valve press plate is disposed above this discharge valve 2127, and attached to the upper support member 2054. Moreover, one side of the discharge valve 2127 abuts on the discharge port 2039 to seal the port, and the other side thereof is fixed, with a caulking pin 2130, to an attachment hole of the upper support member 2054 which is disposed at a predetermined interval from the discharge port 2039.

Moreover, the refrigerant gas compressed in the upper cylinder 2038 to reach a predetermined pressure pushes up, from below in FIG. 25, the discharge valve 2127 which closes the discharge port 2039 to open the discharge port 2039, and the gas is discharged into the discharge muffling chamber 2062. At this time, the discharge valve 2127 is fixed to the upper support member 2054 on the other side. Therefore, one side of the valve which abuts on the discharge port 2039 warps upwards to abut on the backer valve (not shown) which regulates an open amount of the discharge valve 2127. In a case where it is a time to end the discharge of the refrigerant gas, the discharge valve 2127 is detached from the backer valve, and the discharge port 2039 is blocked.

On the other hand, the lower support member 2056 is provided with the discharge muffling chamber 2064 formed by depressing a part of the surface (the lower surface) of the member opposite to the surface of the member which abuts on the lower cylinder 2040, and blocking this depressed concave portion with a cover as a wall. That is, the discharge muffling chamber 2064 is blocked with a lower cover 2068 as the wall which defines the discharge muffling chamber 2064.

Moreover, a discharge valve 2128 which openably blocks the discharge port 2041 is disposed on an upper surface of the discharge muffling chamber 2064. This discharge valve 2128 includes an elastic member constituted of a metal plate which is vertically long and substantially rectangular, and a backer valve (not shown) as a discharge valve press plate is disposed below this discharge valve 2128, and attached to the lower support member 2056. Moreover, one side of the discharge valve 2128 abuts on the discharge port 2041 to seal the port, and the other side thereof is fixed, with a caulking pin 2131, to an attachment hole of the lower support member 2056 which is disposed at a predetermined interval from the discharge port 2041.

Furthermore, the refrigerant gas compressed in the lower cylinder 2040 to reach a predetermined pressure pushes down, from above in FIG. 25, the discharge valve 2128 which closes the discharge port 2041 to open the discharge port 2041, and the gas is discharged to the discharge muffling chamber 2064. At this time, the discharge valve 2128 is fixed to the lower support member 2056 on the other side. Therefore, one side of the valve which abuts on the discharge port 2041 warps upwards to abut on the backer valve (not shown) which regulates an open amount of the discharge valve 2128. In a case where it is a time to end the discharge of the refrigerant gas, the discharge valve 2128 is detached from the backer valve, and the discharge port 2041 is blocked.

The discharge muffling chamber 2064 of the first rotary compression element 2032 communicates with the sealed vessel 2012 via holes (not shown) which extend through the lower cylinder 2040, the intermediate partition plate 2036, the upper cylinder 2038, the upper support member 2054 and the upper cover 2066. The intermediate pressure refrigerant gas compressed by the first rotary compression element 2032 and discharged to the discharge muffling chamber 2064 is discharged into the sealed vessel 12 from these holes.

In addition, on a side surface of the vessel main body 2012A of the sealed vessel 2012, sleeves 2141, 2142, 2143 and 2144 are welded and fixed to positions corresponding to positions of suction passages (not shown) of the upper and lower support members 2054, 2056, on a side opposite to the suction passage of the upper support member 2054 and a lower part of the rotor 2024 (right under the electromotive element 2014), respectively. The sleeve 2141 is vertically adjacent to the sleeve 2142, and the sleeve 2143 is disposed substantially along a diagonal line of the sleeve 2141.

Moreover, one end of a refrigerant introducing tube 2092 for introducing the refrigerant gas into the upper cylinder 2038 is inserted into the sleeve 2141, and the one end of the refrigerant introducing tube 2092 communicates with the suction passage of the upper cylinder 2038. This refrigerant introducing tube 2092 extends from the sealed vessel 2012 to reach the sleeve 2144. The other end of the tube is inserted into the sleeve 2144 and connected to the sealed vessel 2012.

Furthermore, one end of a refrigerant introducing tube 2094 for introducing the refrigerant gas into the lower cylinder 2040 is inserted into the sleeve 2142, and the one end of this refrigerant introducing tube 2094 communicates with the suction passage of the lower cylinder 2040. A refrigerant discharge tube 2096 is inserted into and connected to the sleeve 2143, and one end of this refrigerant discharge tube 2096 communicates with the discharge muffling chamber 2062.

On the other hand, the rotary compressor 2010 is provided with a communication path 2100 of the present invention. This communication path 2100 is a passage which connects a region having an intermediate pressure to a region having a low pressure which is a suction pressure of the first rotary compression element 2032. The communication path 2100 of the present embodiment connects the discharge muffling chamber 2064 of the first rotary compression element 2032 to a suction step region of the first rotary compression element 2032. Here, the intermediate pressure region is a region ranging from a discharge step region (i.e., the high pressure chamber side of the first rotary compression element 2032 at this time) of the first rotary compression element 2032 where there exists the discharge port 2041 surrounded with the lower roller 2048, the lower vane 2052 and the lower cylinder 2040 positioned at a time when the discharge valve 2128 of the first rotary compression element 2032 starts to open. The intermediate pressure region ranges from the above region through the discharge muffling chamber 2064 of the first rotary compression element 2032 to a suction step region (i.e., the low pressure chamber side of the second rotary compression element 2034 at this time) of the second rotary compression element 2034 where there exists the suction port 2160 surrounded with the upper roller 2046, the upper vane 2050 and the upper cylinder 2038 positioned at a time when the discharge valve 2127 of the second rotary compression element 2034 starts to open.

Moreover, the low pressure region is a region on a refrigerant upstream side of the suction step region (i.e., the low pressure chamber side of the first rotary compression element 2032 at this time) of the first rotary compression element 2032 where there exists the suction port 2161 surrounded with the lower roller 2048, the lower vane 2052 and the lower cylinder 2040 positioned at a time when the discharge valve 2128 of the first rotary compression element 2032 starts to open. This low pressure region is a region ranging to the refrigerant introducing tube 2094 in the rotary compressor 10 alone.

Figure 29:
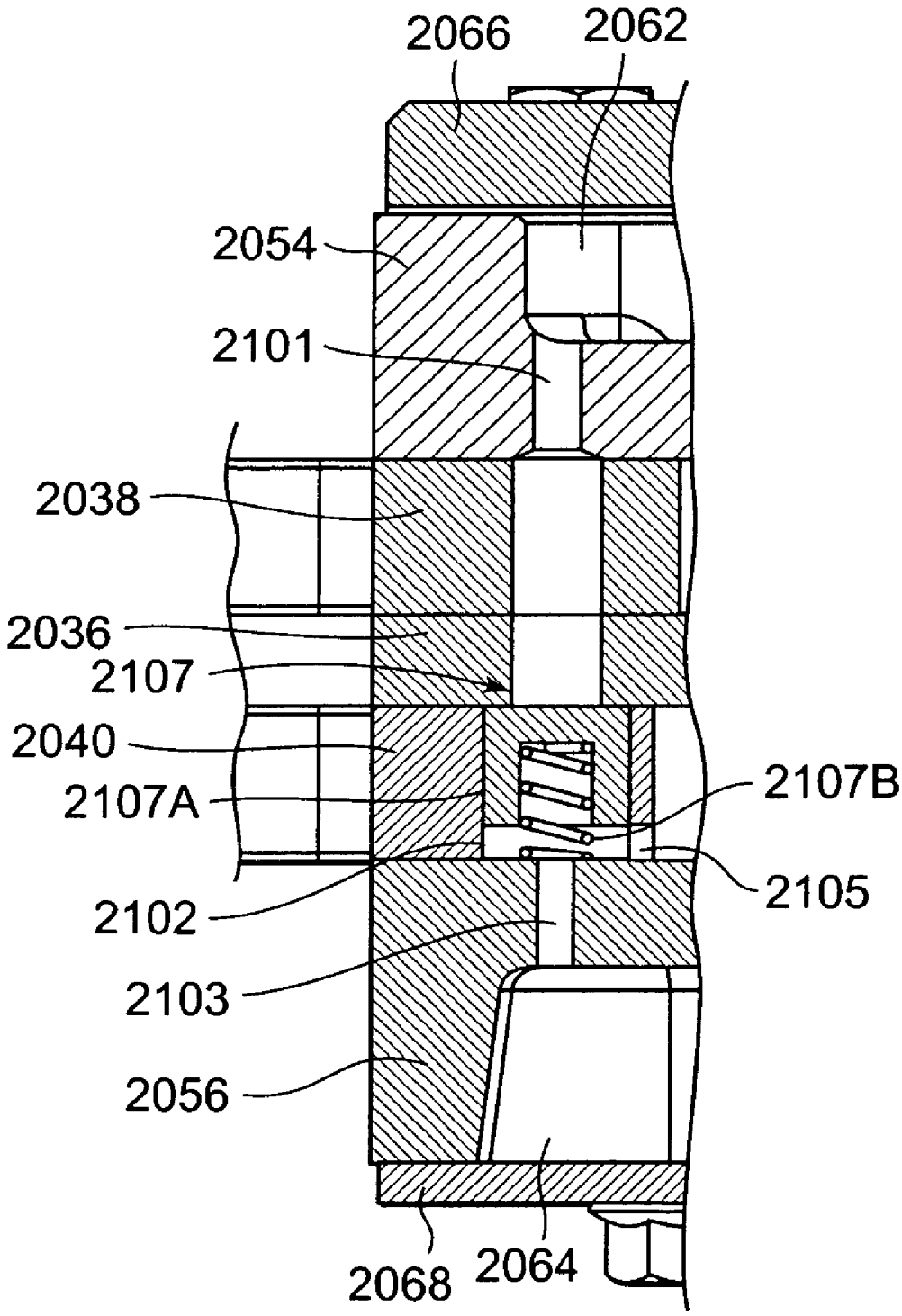
FIG. 29 is a partially enlarged view showing a state in which a communication path disposed in the multistage compression type rotary compressor of FIG. 24 is opened.
Figure 30:
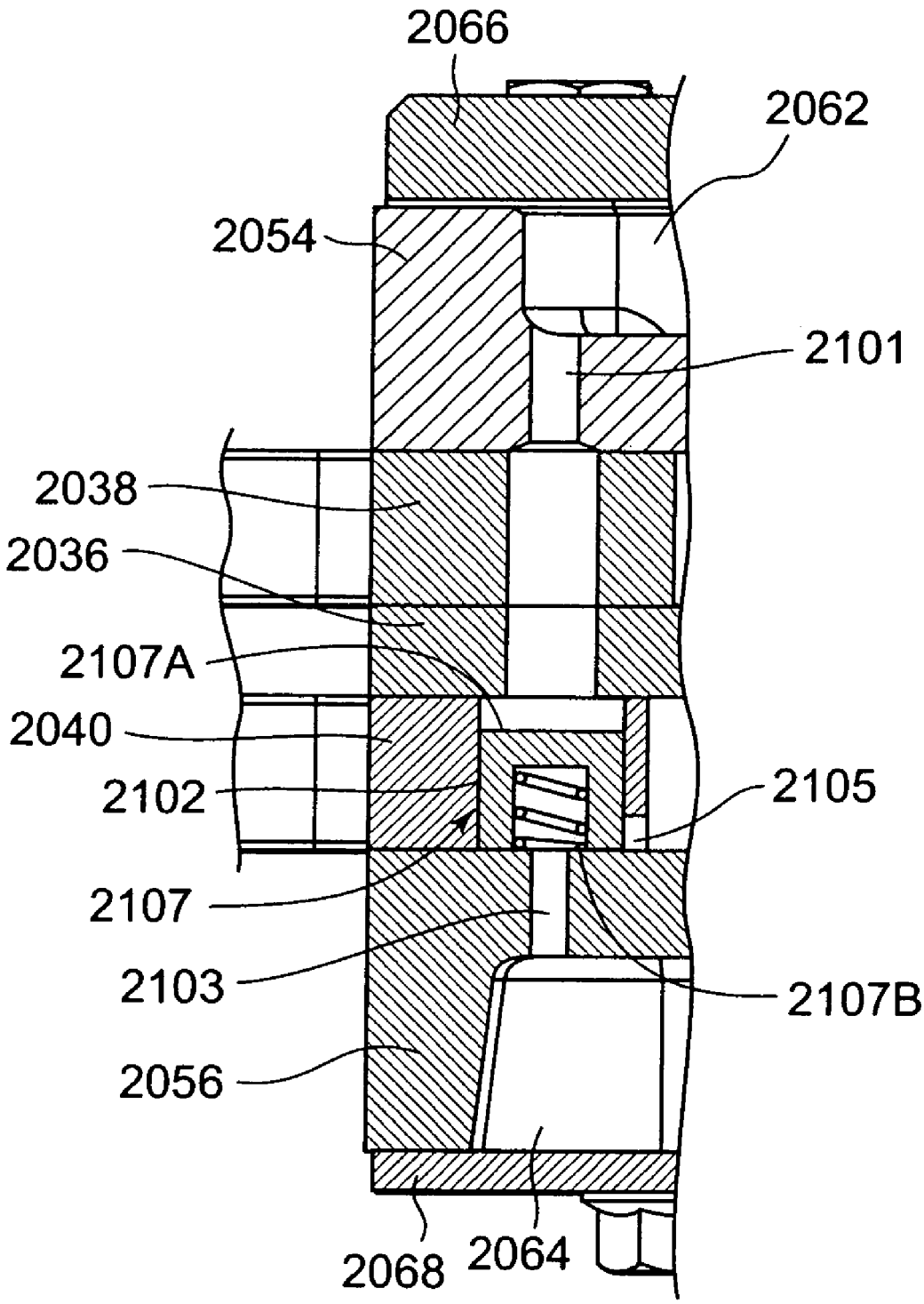
FIG. 30 is a partially enlarged view showing a state in which the communication path disposed in the multistage compression type rotary compressor of FIG. 24 is closed.

Furthermore, in the present embodiment, the high pressure is the discharge pressure of the second rotary compression element 2034. Therefore, the high pressure region is a region on a refrigerant downstream side of a region ranging through the discharge muffling chamber 2062 of the second rotary compression element 2034 from the suction step region (i.e., the high pressure chamber side of the second rotary compression element 2034 at this time) of the second rotary compression element 2034 where there exists the discharge port 2039 surrounded with the upper roller 2046, the upper vane 2050 and the upper cylinder 2038 positioned at a time when the discharge valve 2127 of the second rotary compression element 2034 starts to open. This high pressure region is a region ranging to the refrigerant discharge tube 2096 in the rotary compressor 10 alone. On the other hand, as shown in FIGS. 29 and 30, the communication path 2100 includes a first communication path 2103; a storage chamber 2102 connected to this first communication path 2103 and formed in the lower cylinder 2040; and a second communication path 2105 formed in a horizontal direction of the lower cylinder 2040 to connect the storage chamber 2102 to the suction step region of the lower cylinder 2040 (i.e., a compression chamber of the lower cylinder 2040). The first communication path 2103 is a passage which connects the storage chamber 2102 to the discharge muffling chamber 2064, and is formed in an axial direction (a vertical direction) of the lower support member 2056. The storage chamber 2102 is formed to extend through the lower cylinder 2040 in the axial direction (the vertical direction), one end (a lower end) of the chamber communicates with the first communication path 2103, and the other end thereof communicates with a communication hole 2101. This communication hole 2101 is a pressure passage for applying the pressure of the discharge muffling chamber 2062 to the other surface (an upper surface) of a valve device 2107 stored in the storage chamber 2102 as described later. The communication hole is constituted to extend through the upper support member 2054, the upper cylinder 2038, the intermediate partition plate 2036 and the lower cylinder 2040.

The valve device 2107 is vertically movably stored in the storage chamber 2102. The valve device 2107 is constituted of a sealing portion 2107A which has a U-shaped section and which openably blocks the communication hole 2101; and a spring member 2107B which abuts on one surface (a lower surface) of the sealing portion 2107A. The spring member 2107B of the present embodiment is constituted of a weak spring. The second communication path 2105 is a passage which connects the storage chamber 2102 to the suction step region of the lower cylinder 2040. In the present embodiment, the passage communicates with the storage chamber 2102 and a position of the lower cylinder 2040 rotated from the suction port 2161 as much as 68.5.degree. in a rotating direction of the roller 2048. It is to be noted that the position of the present embodiment is not limited, and the second communication path 2105 may be connected to any position of the suction step region of the lower cylinder 2040 or a region before reaching the discharge pressure of the first rotary compression element 2032 (i.e., the region before reaching a discharge step region of the first rotary compression element 2032) in the lower cylinder 2040. For example, the second communication path may be connected to the suction port 2161 (a broken line of FIG. 26). A top dead center to which the roller 2048 retreats most fro the lower cylinder 2040 (the compression space of the lower cylinder 2040) may be formed in a region in which the roller 2048 rotates as much as 180° in the rotating direction.

Moreover, the intermediate pressure (which is the suction pressure of the first rotary compression element 2032) applied into the discharge muffling chamber 2064 of the first rotary compression element 2032 through the first communication path 2103 of the lower support member 2056 is applied to the lower surface which is one surface of the valve device 2107 (the spring member 2107B side). The high pressure (the suction pressure of the second rotary compression element 2034) applied into the discharge muffling chamber 2062 of the second rotary compression element 2034 via the communication hole 2101 is applied to the lower surface which is the other surface of the valve device 2107 (the sealing portion 2107A side) via the communication hole 2101.

In addition, the valve device 2107 is constituted to open the communication path 2100 in a case where the intermediate pressure which is the discharge pressure of the first rotary compression element 2032 reaches a predetermined upper limit value, a case where a pressure difference between the pressure of the second rotary compression element 2034 on a refrigerant discharge side and the intermediate pressure indicates a predetermined value or a case where the difference reaches a predetermined pressure before reaching the high pressure. Specifically, the valve device 2107 of the present embodiment is constituted to open the communication path 2100 in a case where the pressure applied from the discharge muffling chamber 2064 of the first rotary compression element 2032 to one surface (the spring member 2107B side) is not less than the pressure applied from the discharge muffling chamber 2062 of the second rotary compression element 2034 to the other surface (the sealing portion 2107A side).

That is, in a case where the pressure applied from the discharge muffling chamber 2064 of the first rotary compression element 2032 to one surface (the spring member 2107B side) is not less than that applied from the discharge muffling chamber 2062 of the second rotary compression element 2034 to the other surface (the sealing portion 2107A side), the pressure in the discharge muffling chamber 2064 of the first rotary compression element 2032 pushes up the valve device 2107, and the valve device 2107 (the sealing portion 2107A) moves toward the other end of the storage chamber 2102 (FIG. 29). In consequence, the first communication path 2103 is connected to the second communication path 2105 to open the communication path 2100, and the refrigerant gas discharged into the discharge muffling chamber 2064 flows into the suction step region of the lower cylinder 2040 via the first communication path 2103, the storage chamber 2102 and the second communication path 2105.

As described above, in a case where the pressure applied from the discharge muffling chamber 2064 of the first rotary compression element 2032 to one surface (the spring member 2107B side) is not less than that applied from the discharge muffling chamber 2062 of the second rotary compression element 2034 to the other surface (the sealing portion 2107A side), the communication path 2100 is opened. In consequence, the intermediate pressure refrigerant gas compressed by the first rotary compression element 2032 and discharged into the discharge muffling chamber 2064 can be released to the low pressure region in the lower cylinder 2040 of the first rotary compression element 2032.

Next, there will be described an operation of the rotary compressor 2010 constituted as described above. When a power is supplied to the stator coil 2028 of the electromotive element 2014 via the terminal 2020 and the wiring line (not shown), the electromotive element 2014 starts to rotate the rotor 2024. When this rotor rotates, the upper and lower rollers 2046, 2048 are fitted into the upper and lower eccentric portions 2042, 2044 disposed integrally with the rotary shaft 2016 to eccentrically rotate in the upper and lower cylinders 2038, 2040.

In consequence, after the low pressure refrigerant is sucked in the low pressure chamber side of the lower cylinder 2040 from the suction port 2161 via the refrigerant introducing tube 2094 and the suction passage (not shown) formed in the cylinder 2040, the refrigerant is compressed by operations of the lower roller 2048 and the lower vane 2052 to reach the intermediate pressure. The discharge valve 2128 which closes the discharge port 2039 is then pushed, the discharge port 2041 opens, and the intermediate pressure refrigerant gas is discharged into the discharge muffling chamber 2064.

The intermediate pressure refrigerant gas discharged into the discharge muffling chamber 2064 is discharged into the sealed vessel 2012 from the discharge muffling chamber 2064 via a hole (not shown). In consequence, in the sealed vessel 2012, there is achieved the intermediate pressure which is the discharge side pressure of the first rotary compression element 2032. At this time, in a case where the pressure of the refrigerant discharged into the discharge muffling chamber 2064 is lower than the high pressure of the refrigerant compressed by the second rotary compression element 2034 and discharged into the discharge muffling chamber 2062, as shown in FIG. 30, the valve device 2107 is pushed by the high pressure of the refrigerant discharged from the discharge muffling chamber 2062, and the valve device 2107 (the sealing portion 2107A) is positioned at one end of the storage chamber 2102. Therefore, since the first communication path 2103 is not connected to the second communication path 2105 and the communication path 2100 is brought into a blocked state, the refrigerant discharged to the discharge muffling chamber 2064 is all discharged into the sealed vessel 2012 through the hole.

The intermediate pressure refrigerant gas discharged into the sealed vessel 2012 exits from the sleeve 2144 and is sucked in the upper cylinder 2038 on the low pressure chamber side from the suction port 2160 via the refrigerant introducing tube 2092 and the suction passage (not shown) formed in the cylinder 2038. The sucked intermediate pressure refrigerant gas is secondarily compressed by operations of the upper roller 2046 and the upper vane 2050 to constitute a high-temperature high-pressure refrigerant gas. In consequence, the discharge valve 2127 disposed in the discharge muffling chamber 2062 is opened, and the discharge muffling chamber 2062 communicates with the discharge port 2039. Therefore, the gas is discharged from the high pressure chamber side of the upper cylinder 2038 to the discharge muffling chamber 2062 formed in the upper support member 2054 through the discharge port 2039. Moreover, the high pressure refrigerant gas discharged to the discharge muffling chamber 2062 is discharged from the rotary compressor 2010 through the refrigerant discharge tube 2096.

On the other hand, when the pressure of the refrigerant discharged into the discharge muffling chamber 2064 is not less than the high pressure of the refrigerant compressed by the second rotary compression element 2034 and discharged into the discharge muffling chamber 2062, as shown in FIG. 29, the valve device 2107 is pushed upwards by the discharge pressure of the first rotary compression element 2032 applied into the discharge muffling chamber 2064 via the first communication path 2103. The sealing portion 2107A moves toward the other end of the storage chamber 2102, and the first communication path 2103 communicates with the second communication path 2105 via the storage chamber 2102. In consequence, the refrigerant discharged into the discharge muffling chamber 2064 flows into the suction step region of the lower cylinder 2040 via the first communication path 2103, the storage chamber 2102 and the second communication path 2105. Therefore, a part of the intermediate pressure refrigerant gas compressed by the first rotary compression element 2032 and discharged into the discharge muffling chamber 2064 can be released to the low pressure region of the lower cylinder 2040 of the first rotary compression element 2032.

In consequence, the pressure of the intermediate pressure refrigerant gas discharged to the discharge muffling chamber 2064 of the first rotary compression element 2032 is not more than that of the refrigerant gas discharged to the discharge muffling chamber 2062 of the second rotary compression element 2034. Moreover, when the pressure of the intermediate pressure refrigerant gas discharged to the discharge muffling chamber 2064 of the first rotary compression element 2032 drops below that of the refrigerant gas discharged to the discharge muffling chamber 2062 of the second rotary compression element 2034, as shown in FIG. 30, the valve device 2107 (the sealing portion 2107A) returns to one end of the storage chamber 2102. Therefore, the communication path 2100 is blocked. As described above, when the pressure of the refrigerant discharged into the discharge muffling chamber 2064 is not less than the high pressure of the refrigerant compressed by the second rotary compression element 2034 and discharged into the discharge muffling chamber 2062, the communication path 2100 is opened as described above. The refrigerant gas discharged into the discharge muffling chamber 2064 can be released to the suction step region of the first rotary compression element 2032. Therefore, the pressure of the refrigerant gas discharged to the discharge muffling chamber 2064 of the first rotary compression element 2032 is not more than that of the refrigerant gas discharged to the discharge muffling chamber 2062 of the second rotary compression element 2034. It is possible to eliminate pressure reversal of the refrigerant gas compressed by the first rotary compression element 2032 and the refrigerant gas compressed by the second rotary compression element 2034.

In consequence, it is possible to eliminate at an early stage of vane fly and unstable operation situation of the upper vane 2050 of the second rotary compression element 2034. When the refrigerant gas compressed by the first rotary compression element 2032 and discharged to the discharge muffling chamber 2064 is released to the suction step region of the first rotary compression element 2032, an amount of the refrigerant to be sucked in the first rotary compression element 2032 decreases. Therefore, it is possible to obtain a power saving effect at a time when the compressor has a light load.

As described above, it is possible to eliminate a disadvantage that the second rotary compression element 2034 comes into the unstable operation situation, and a stabilized operation of the multistage compression type rotary compressor 2010 can be realized.

It is to be noted that in the present embodiment, the spring member 2107B of the valve device 2107 is constituted of a weak spring. When the pressure applied from discharge muffling chamber 2064 of the first rotary compression element 2032 to one surface (the spring member 2107B side) is not less than the pressure applied from the discharge muffling chamber 2062 of the second rotary compression element 2034 to the other surface (the sealing portion 2107A side), the communication path 2100 is opened. However, the present invention is not limited to this embodiment. The spring member 2107B may be constituted of a usual spring. When the pressure applied from the discharge muffling chamber 2064 of the first rotary compression element 2032 to one surface (the spring member 2107B side) reaches the predetermined upper limit value, for example, the predetermined upper limit value before reaching the pressure applied from the discharge muffling chamber 2062 of the second rotary compression element 2034 to the other surface (the sealing portion 2107A side), the communication path 2100 may be connected.

In this case, the pressure of the refrigerant gas discharged to the discharge muffling chamber 2064 of the second rotary compression element 2034 can constantly be set to be lower than that of the refrigerant gas discharged to the discharge muffling chamber 2064 of the second rotary compression element 2034. Therefore, it is possible to secure the back pressure of the upper vane 2050 of the second rotary compression element 2034. That is, the pressure in the upper cylinder 2038 can constantly be set to be not more than the pressure of the storage portion 2070A of the upper vane 2050. It is therefore possible to avoid beforehand a disadvantage that the vane fly of the upper vane 2050 occurs owing to such a high pressure which is the discharge side pressure applied from the second rotary compression element 2034 to the storage portion 2070A and the urging force of the spring 2074. The stabilized operation situation of the second rotary compression element 2034 can be secured.

Moreover, the communication path 2100 may be connected in a case where the pressure difference between the discharge pressure of the second rotary compression element 2034 and the discharge pressure of the first rotary compression element 2032 indicates the pressure value.

Furthermore, it is assumed in the present embodiment that the intermediate inner pressure type rotary compressor is used as the rotary compressor 2010, but the present invention is not limited to this embodiment, and is effective even when applied to the high inner pressure type multistage compression rotary compressor in which the high pressure is achieved in the sealed vessel 2012. Furthermore, as the rotary compressor 2010 of the present embodiment, the two-stage compression type rotary compressor has been described, but the present invention may be applied to a rotary compressor including three or more stages of rotary compression elements.

What is claimed is:

1. A multistage compression type rotary compressor comprising, in a sealed vessel, a driving element; and first and second rotary compression elements driven by the driving element, the second rotary compression element comprising a cylinder; a roller fitted into an eccentric portion formed on a rotary shaft of the driving element to eccentrically rotate in the cylinder; and a vane which abuts on the roller to separate a low pressure chamber side and a high pressure chamber side from each other, the rotary compressor being configured to apply a pressure of the second rotary compression element on a refrigerant discharge side as a back pressure of the vane, suck, in the second rotary compression element, an intermediate pressure refrigerant gas compressed by the first rotary compression element and discharged, compress and discharge the refrigerant gas, the rotary compressor further comprising:

a communication path which connects a region having an intermediate pressure to a region having a low pressure as a suction pressure of the first rotary compression element or a region before reaching the intermediate pressure; and a valve device which opens or closes the communication path, the valve device being configured to open the communication path in a case where a pressure difference between the pressure of the second rotary compression element on the refrigerant discharge side and the intermediate pressure reaches a predetermined value.

2. A multistage compression type rotary compressor comprising, in a sealed vessel, a driving element; and first and second rotary compression elements driven by the driving element, the second rotary compression element comprising a cylinder; a roller fitted into an eccentric portion formed on a rotary shaft of the driving element to eccentrically rotate in the cylinder; and a vane which abuts on the roller to divide the inside of the cylinder into a low pressure chamber side and a high pressure chamber side, the rotary compressor being configured to apply a pressure of the second rotary compression element on a refrigerant discharge side as a back pressure of the vane, suck, in the second rotary compression element, a refrigerant gas compressed by the first rotary compression element and discharged, compress and discharge the refrigerant gas, the rotary compressor further comprising:

a communication path which connects a discharge muffling chamber of the first rotary compression element to a suction step region of the first rotary compression element or a region before reaching a discharge pressure of the first rotary compression element;

a valve device having one surface to which a pressure in the discharge muffling chamber of the first rotary compression element is applied and having the other surface to which a pressure in a discharge muffling chamber of the second rotary compression element is applied to open or close the communication path; and a communication hole communicating the other surface with the discharge muffling chamber of the second rotary compression element to provide the pressure to the other surface; wherein the valve device is configured to open the communication path in a case where the pressure applied from the discharge muffling chamber of the first rotary compression element to the one surface reaches a predetermined upper limit value.

* * * * *